US012245630B2

(12) United States Patent
Patel et al.

(10) Patent No.: US 12,245,630 B2
(45) Date of Patent: Mar. 11, 2025

(54) CONTAINER FOR ORAL PRODUCTS

(71) Applicant: Nicoventures Trading Limited, London (GB)

(72) Inventors: Pankaj C. Patel, Clemmons, NC (US); Nicholas H. Watson, Westfield, NC (US); Wesley S. Jones, Lexington, NC (US); Ryan A. Bailey, Raleigh, NC (US); Michael E. Laut, Raleigh, NC (US); Luke Giduz, Raleigh, NC (US)

(73) Assignee: Nicoventures Trading Limited, London (GB)

( * ) Notice: Subject to any disclaimer, the term of this patent is extended or adjusted under 35 U.S.C. 154(b) by 151 days.

(21) Appl. No.: 18/297,912

(22) Filed: Apr. 10, 2023

(65) Prior Publication Data

US 2023/0329334 A1 Oct. 19, 2023

Related U.S. Application Data

(60) Provisional application No. 63/362,990, filed on Apr. 14, 2022.

(51) Int. Cl.
*A24F 23/02* (2006.01)
*B65D 17/34* (2006.01)
(Continued)

(52) U.S. Cl.
CPC ..... *A24F 23/02* (2013.01); *B65D 17/34* (2018.01); *B65D 43/0254* (2013.01); *B65D 50/045* (2013.01); *B65D 51/28* (2013.01); *B65D 2203/02* (2013.01); *B65D 2209/00* (2013.01); *B65D 2251/0003* (2013.01);
(Continued)

(58) Field of Classification Search
CPC ..... B65D 17/34; B65D 43/0254; B65D 43/0249; B65D 43/0239; B65D 43/0237; B65D 43/0235; B65D 43/0264; B65D 2251/0003; B65D 2251/20; A24F 23/00; A24F 23/02
See application file for complete search history.

(56) References Cited

U.S. PATENT DOCUMENTS 4,098,421 A 7/1978 Foster
4,190,170 A 2/1980 Boyd
(Continued)

FOREIGN PATENT DOCUMENTS

WO WO-2017125405 A1 * 7/2017 ..... A24F 23/00
WO WO-2019154971 A1 8/2019
(Continued)

OTHER PUBLICATIONS

World Intellectual Property Organization, International Search Report for application No. PCT/IB2023/053834, dated Aug. 7, 2023, pp. 1-103.

*Primary Examiner* — Javier A Pagan
(74) *Attorney, Agent, or Firm* — Womble Bond Dickinson (US) LLP; Chris Humphrey; John V. Forcier

(57) ABSTRACT

The present disclosure relates to containers and methods of making same for oral products made or derived from tobacco, incorporate tobacco, or may be tobacco-free and are intended for human consumption. The disclosed containers incorporate one or more of an alignment mechanism, a seal arrangement, a retention mechanism, or a tamper-evident feature to suit a particular application.

29 Claims, 35 Drawing Sheets

(51) Int. Cl.
*B65D 43/02* (2006.01)
*B65D 50/04* (2006.01)
*B65D 51/28* (2006.01)

(52) U.S. Cl.
CPC ..... *B65D 2251/20* (2013.01); *B65D 2543/00212* (2013.01); *B65D 2543/0074* (2013.01)

(56) References Cited

U.S. PATENT DOCUMENTS

| | | | | |
|---|---|---|---|---|
| 6,668,839 | B2 | 12/2003 | Williams | |
| 6,834,654 | B2 | 12/2004 | Williams | |
| 6,953,040 | B2 | 10/2005 | Atchley et al. | |
| 7,032,601 | B2 | 4/2006 | Atchley et al. | |
| D574,709 | S | 8/2008 | Crotts et al. | |
| 7,694,686 | B2 | 4/2010 | Atchley et al. | |
| 7,810,507 | B2 | 10/2010 | Dube et al. | |
| 7,819,124 | B2 | 10/2010 | Strickland et al. | |
| 7,861,728 | B2 | 1/2011 | Holton, Jr. et al. | |
| 7,901,512 | B2 | 3/2011 | Quinter et al. | |
| D649,284 | S | 11/2011 | Patel et al. | |
| 8,353,421 | B2 | 1/2013 | Rosazza et al. | |
| 8,440,023 | B2 | 5/2013 | Carroll et al. | |
| 8,458,996 | B2 | 6/2013 | Bried et al. | |
| 8,567,597 | B2 * | 10/2013 | Gibson | B65D 51/28 206/242 |
| 8,627,828 | B2 | 1/2014 | Strickland et al. | |
| 8,701,881 | B2 * | 4/2014 | Gibson | A24F 23/00 206/236 |
| 8,869,980 | B2 | 10/2014 | Berggren | |
| 8,881,896 | B2 | 11/2014 | Gibson et al. | |
| 8,910,781 | B2 | 12/2014 | Pipes et al. | |
| 9,538,785 | B2 | 1/2017 | Loos et al. | |
| 10,112,743 | B2 * | 10/2018 | Beardsall | B65D 51/28 |
| 10,306,921 | B2 | 6/2019 | Hermans | |
| 10,463,075 | B2 | 11/2019 | Beardsall | |
| 10,618,707 | B2 | 4/2020 | Straughan | |
| D885,919 | S | 6/2020 | Beardsall | |
| 11,076,640 | B2 | 8/2021 | Bjoerkholm | |
| 11,246,334 | B2 | 2/2022 | Atchley | |
| 11,291,237 | B2 | 4/2022 | Rushforth et al. | |
| 2008/0196730 | A1 | 8/2008 | Engstrom et al. | |
| 2008/0202956 | A1 | 8/2008 | Welk et al. | |
| 2008/0305216 | A1 | 12/2008 | Crawford et al. | |
| 2009/0293889 | A1 | 12/2009 | Kumar et al. | |
| 2010/0012534 | A1 | 1/2010 | Hoffman | |
| 2010/0018883 | A1 | 1/2010 | Patel | |
| 2010/0065076 | A1 | 3/2010 | Tue et al. | |
| 2010/0065077 | A1 | 3/2010 | Lofgreen-Ohrn et al. | |
| 2010/0291245 | A1 | 11/2010 | Gao et al. | |
| 2011/0139164 | A1 | 6/2011 | Mua et al. | |
| 2012/0024301 | A1 | 2/2012 | Carroll et al. | |
| 2012/0037175 | A1 | 2/2012 | Cantrell et al. | |
| 2012/0055494 | A1 | 3/2012 | Hunt et al. | |
| 2012/0138073 | A1 | 6/2012 | Cantrell et al. | |
| 2012/0138074 | A1 | 6/2012 | Cantrell et al. | |
| 2012/0193265 | A1 | 8/2012 | Patel et al. | |
| 2013/0074855 | A1 | 3/2013 | Holton, Jr. | |
| 2013/0074856 | A1 | 3/2013 | Holton, Jr. | |
| 2013/0152953 | A1 | 6/2013 | Mua et al. | |
| 2013/0206153 | A1 | 8/2013 | Beeson et al. | |
| 2013/0274296 | A1 | 10/2013 | Jackson et al. | |
| 2014/0197054 | A1 | 7/2014 | Pipes et al. | |
| 2015/0068545 | A1 | 3/2015 | Moldoveanu et al. | |
| 2015/0101627 | A1 | 4/2015 | Marshall et al. | |
| 2015/0230515 | A1 | 8/2015 | Lampe et al. | |
| 2019/0352046 | A1 | 11/2019 | Pohlman et al. | |
| 2021/0169121 | A1 | 6/2021 | St. Charles | |
| 2021/0169122 | A1 | 6/2021 | St. Charles | |
| 2021/0169132 | A1 | 6/2021 | Holton, Jr. et al. | |
| 2021/0169792 | A1 | 6/2021 | Holton, Jr. et al. | |
| 2021/0169867 | A1 | 6/2021 | Holton, Jr. et al. | |
| 2021/0177038 | A1 | 6/2021 | Gerardi et al. | |
| 2021/0177043 | A1 | 6/2021 | Gerardi et al. | |
| 2021/0177754 | A1 | 6/2021 | Keller et al. | |
| 2021/0186081 | A1 | 6/2021 | Gerardi et al. | |
| 2021/0330590 | A1 | 10/2021 | Hutchens et al. | |
| 2021/0378948 | A1 | 12/2021 | Gerardi et al. | |
| 2022/0071280 | A1 | 3/2022 | Patel et al. | |
| 2022/0071984 | A1 | 3/2022 | Poole et al. | |
| 2022/0104543 | A1 | 4/2022 | Patel et al. | |
| 2022/0160675 | A1 | 5/2022 | Gerardi et al. | |
| 2023/0013978 | A1 * | 1/2023 | Patel | B65D 43/0212 |

FOREIGN PATENT DOCUMENTS

| | | | |
|---|---|---|---|
| WO | WO-2022242954 | A1 | 11/2022 |
| WO | WO-2022263038 | A1 | 12/2022 |

* cited by examiner

CONTAINER FOR ORAL PRODUCTS

CROSS-REFERENCE TO RELATED APPLICATION

This application claims priority to and the benefit of U.S. Provisional Patent Application No. 63/362,990, filed Apr. 14, 2022; the disclosure of which is hereby incorporated by reference in its entirety.

TECHNOLOGICAL FIELD

The present disclosure relates to containers and methods of making same for oral products made or derived from tobacco, incorporate tobacco, or may be tobacco-free and are intended for human consumption.

BACKGROUND

There are many categories of products intended for oral use and enjoyment. For example, oral tobacco products containing nicotine, which is known to have both stimulant and anxiolytic properties, have been available for many years. Conventional formats for so-called "smokeless" tobacco products include moist snuff, snus, and chewing tobacco, which are typically formed almost entirely of particulate, granular, or shredded tobacco, and which are either portioned by the user or presented to the user in individual portions, such as in single-use pouches or sachets. See for example, the types of smokeless tobacco formulations, ingredients, and processing methodologies set forth in U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; U.S. Pat. No. 7,810,507 to Dube et al.; U.S. Pat. No. 7,819,124 to Strickland et al.; U.S. Pat. No. 7,861,728 to Holton, Jr. et al.; U.S. Pat. No. 7,901,512 to Quinter et al.; U.S. Pat. No. 8,627,828 to Strickland et al.; U.S. Pat. No. 11,246,334 to Atchley, each of which is incorporated herein by reference.

In addition, traditional tobacco materials and non-tobacco materials have been combined with other ingredients to form product formats distinct from traditional smokeless products, with example formats including lozenges, pastilles, gels, and the like. See, for example, the types of products described in US Patent App. Pub. Nos. 2008/0196730 to Engstrom et al.; 2008/0305216 to Crawford et al.; 2009/0293889 to Kumar et al.; 2010/0291245 to Gao et al; 2011/0139164 to Mua et al.; 2012/0037175 to Cantrell et al.; 2012/0055494 to Hunt et al.; 2012/0138073 to Cantrell et al.; 2012/0138074 to Cantrell et al.; 2013/0074855 to Holton, Jr.; 2013/0074856 to Holton, Jr.; 2013/0152953 to Mua et al.; 2013/0274296 to Jackson et al.; 2015/0068545 to Moldoveanu et al.; 2015/0101627 to Marshall et al.; and 2015/0230515 to Lampe et al., each of which is incorporated herein by reference.

There is continuing interest in the development of new types of oral products that deliver advantageous sensorial or biological activity. Such products typically contain flavorants and/or active ingredients such as nicotine, caffeine, botanicals, or cannabidiol. The format of such products can vary, and include pouched products containing a powdered or granular composition, lozenges, pastilles, liquids, gels, emulsions, meltable compositions, and the like. See, for example, the types of products described in US Patent App. Pub. Nos. 2022/0160675 to Gerardi et al.; 2022/0071984 to Poole et al.; 2021/0378948 to Gerardi et al.; 2021/0330590 to Hutchens et al.; 2021/0186081 to Gerardi et al.; 2021/0177754 to Keller et al; 2021/0177043 to Gerardi et al.; 2021/0177038 to Gerardi et al.; 2021/0169867 to Holton, Jr. et al.; 2021/0169792 to Holton, Jr. et al.; 2021/0169132 to Holton, Jr. et al.; 2021/0169121 to St. Charles, and 2021/0169122 to St. Charles, each of which is incorporated herein by reference.

Various types of containers for holding, carrying, storing, and dispensing traditional oral products are known in the art. Such containers are often characterized by a hand-held size that can be easily stored and transported. For example, snus products have been packaged in tins, "pucks" or "pots" that are manufactured from metal or plastic. See, for example, those types of containers generally disclosed in U.S. Pat. No. 4,098,421 to Foster; U.S. Pat. No. 4,190,170 to Boyd and U.S. Pat. No. 8,440,023 to Carroll et al.; and U.S. Patent Pub. Nos. 2010/0065076 to Bergstrom et al.; 2010/0065077 to Lofgreen-Ohrn et al.; 2012/0024301 to Carroll et al. and 2012/0193265 to Patel et al.; each of which is incorporated by reference herein. Yet other types of containers for smokeless types of tobacco products are set forth in U.S. Pat. No. 8,458,996 to Bried et al.; D574,709 to Crotts et al. and D649,284 to Patel et al.; U.S. Patent Pub. Nos. 2008/0202956 to Welk et al., 2010/0012534 to Hoffman, 2010/0018883 to Patel et al., and 2014/0197054 to Pipes et al.; as well as the various types of containers referenced in U.S. Patent Pub. No. 2013/0206153 to Beeson et al.; each of which is incorporated by reference herein. Further, U.S. Pat. No. 8,567,597 to Gibson et al. discloses a compartment container for snus, and is incorporated herein by reference in its entirety.

BRIEF SUMMARY

In various implementations, the present disclosure relates to containers having a base or body portion and a cover or lid, where the cover, the body portion, or both include structure to improve the barrier sealing properties of the containers. The containers may also include structure to improve other characteristics of the container and the interface between the body portion and the lid, such as, for example, child-resistant features that make it difficult for a child to separate the cover and the body portion, thereby reducing the risk of children accessing the contents of the container. Examples of containers that may incorporate such structures are described in U.S. Patent Publication No. US2022/0071280 and U.S. patent application Ser. No. 17/464,979, filed Sep. 2, 2021, the entire disclosures of which are hereby incorporated by reference herein.

Embodiment 1: A container comprising a body portion defining an internal space accessible via an opening, the body portion comprising a bottom wall and a sidewall extending upwardly from a peripheral edge of the bottom wall, wherein the sidewall comprises a primary wall extending along a perimeter of the bottom wall and having an inner surface, an outer surface, and an upper rim defining the opening, wherein a first alignment mechanism is disposed on the outer surface of the primary wall; and a secondary wall spaced outwardly from and at least partially surrounding the outer surface of the primary wall thereby defining an open channel between the primary and secondary walls, the open channel extending along a perimeter of the body portion, wherein the secondary wall comprises an upper edge and a lower edge and the secondary wall is coupled to the primary wall along at least a portion of the lower edge; and a cover configured to securely and removably engage the body portion, the cover comprising a top wall and a primary sidewall extending downwardly from a peripheral edge of the top wall and having an inner surface, an outer surface, and a second alignment mechanism disposed on the inner surface of the primary sidewall, the second alignment mechanism configured to engage with the first alignment mechanism.

Embodiment 2: The container of the preceding Embodiment, wherein the first alignment mechanism comprises a plurality of raised structures oriented about the outer surface of the primary wall of the body portion so as to define a plurality of grooves therebetween.

Embodiment 3: The container of any of Embodiments 1 and 2, or any combination thereof, wherein the second alignment mechanism comprises a plurality of ribs disposed along the inner surface of the primary sidewall of the cover and oriented so as to mate with the plurality of grooves on the body portion in a particular orientation.

Embodiment 4: The container of any of Embodiments 1 to 3, or any combination thereof, wherein each of the raised structures comprises an upper edge angled downwardly towards the defined grooves and configured to guide the ribs into their respective grooves.

Embodiment 5: The container of any of Embodiments 1 to 4, or any combination thereof, wherein the first and second alignment mechanisms prevent rotational movement between the cover and body portion when engaged.

Embodiment 6: The container of any of Embodiments 1 to 5, or any combination thereof, wherein the primary sidewall of the cover circumscribes the primary wall of the body portion when the cover engages the body portion.

Embodiment 7: The container of any of Embodiments 1 to 6, or any combination thereof, wherein the cover further comprises an inner sidewall extending downwardly from the top wall and spaced inwardly from the primary sidewall, wherein the primary and inner sidewalls define a receptacle configured to engage at least a portion of the primary wall of the body portion.

Embodiment 8: The container of any of Embodiments 1 to 7, or any combination thereof, further comprising a seal arrangement disposed within the receptacle and configured to sealingly engage the upper rim of the primary wall.

Embodiment 9: The container of any of Embodiments 1 to 8, or any combination thereof, wherein the cover further comprises an outer sidewall extending outwardly from the peripheral edge of the top wall and configured so that an outer surface thereof is substantially flush with an outer surface of the secondary wall of the body portion when engaged.

Embodiment 10: The container of any of Embodiments 1 to 9, or any combination thereof, wherein an inner surface of the secondary wall comprises a retention mechanism configured to engage a mating structure on the cover to secure the cover to the body portion.

Embodiment 11: The container of any of Embodiments 1 to 10, or any combination thereof, wherein the retention mechanism comprises one or more recesses formed in the inner surface of the secondary wall and the mating structure comprises one or more protuberances disposed on the outer surface of the primary sidewall and configured to engage the one or more recesses.

Embodiment 12: The container of any of Embodiments 1 to 11, or any combination thereof, wherein one or more portions of the secondary wall flexes relative to the primary wall upon application of a force thereto and the cover is removable by flexing one of the one or more portions of the secondary wall inwardly to expose an edge of the cover.

Embodiment 13: The container of any of Embodiments 1 to 12, or any combination thereof, wherein the secondary wall returns to an unflexed position after removal of the force.

Embodiment 14: The container of any of Embodiments 1 to 13, or any combination thereof, wherein the upper edge of the secondary wall defines at least one cut-out configured to provide access to an edge of the cover.

Embodiment 15: The container of any of Embodiments 1 to 14, or any combination thereof, wherein the cover engages the body portion via an interference fit (aka a press or friction fit) or a snap fit.

Embodiment 16: The container of any of Embodiments 1 to 15, or any combination thereof, wherein the primary wall of the body portion defines a generally cylindrical shape and the secondary wall defines a generally prismatic or polyhedral shape. Prismatic and polyhedral may be used interchangeably herein to represent three-dimensional shapes.

Embodiment 17: The container of any of Embodiments 1 to 16, or any combination thereof, wherein the primary sidewall of the cover defines a generally cylindrical shape and the outer sidewall of the cover defines a generally prismatic or polyhedral shape corresponding to the generally prismatic or polyhedral shape of the secondary wall of the body portion.

Embodiment 18: The container of any of Embodiments 1 to 17, or any combination thereof, further comprising a tamper evident feature.

Embodiment 19: The container of any of Embodiments 1 to 18, or any combination thereof, wherein the tamper evident feature comprises a substrate disposed on at least one of the bottom wall or the top wall and at least two tabs extending outwardly from the substrate and attached to the body portion and the cover, each tab spanning an interface between the body portion and the cover.

Embodiment 20: The container of any of Embodiments 1 to 19, or any combination thereof, wherein the substrate comprises a label or other indicia.

Embodiment 21: The container of any of Embodiments 1 to 20, or any combination thereof, wherein the at least two tabs are perforated.

Embodiment 22: A container comprising a body portion defining an internal space accessible via an opening, the body portion comprising a bottom wall and a sidewall extending upwardly from a peripheral edge of the bottom wall, wherein the sidewall comprises a primary wall extending along a perimeter of the bottom wall and having an inner surface, an outer surface, and an upper rim defining the opening and a secondary wall spaced outwardly from and at least partially surrounding the outer surface of the primary wall thereby defining an open channel between the primary and secondary walls, the open channel extending along a perimeter of the body portion, wherein the secondary wall comprises an upper edge and a lower edge and the secondary wall is coupled to the primary wall along at least a portion of the lower edge; and a cover configured to securely and removably engage the body portion, the cover comprising a top wall, a primary sidewall extending downwardly from a peripheral edge of the top wall, and an inner sidewall extending downwardly from the top wall and spaced inwardly from the primary sidewall, wherein the primary and inner sidewalls define a receptacle configured to engage at least a portion of the primary wall of the body portion.

Embodiment 23: The container of the preceding Embodiment, further comprising a seal arrangement disposed within the receptacle and configured to sealingly engage the upper rim of the primary wall.

Embodiment 24: The container of any of Embodiments 22 and 23, or any combination thereof, wherein the primary sidewall of the cover circumscribes the primary wall of the body portion when the cover engages the body portion.

Embodiment 25: The container of any of Embodiments 22 to 24, or any combination thereof, further comprising a first alignment mechanism is disposed on the outer surface of the primary wall and a second alignment mechanism disposed on the inner surface of the primary sidewall, the second alignment mechanism configured to engage with the first alignment mechanism.

Embodiment 26: The container of any of Embodiments 22 to 25, or any combination thereof, wherein the first alignment mechanism comprises a plurality of raised structures oriented about the outer surface of the primary wall of the body portion so as to define a plurality of grooves therebetween and the second alignment mechanism comprises a plurality of ribs disposed along the inner surface of the primary sidewall of the cover and oriented so as to mate with the plurality of grooves on the body portion in a particular orientation.

Embodiment 27: The container of any of Embodiments 22 to 26, or any combination thereof, wherein each of the raised structures comprises an upper edge angled downwardly towards the defined grooves and configured to guide the ribs into their respective grooves.

Embodiment 28: The container of any of Embodiments 22 to 27, or any combination thereof, wherein the first and second alignment mechanisms prevent rotational movement between the cover and body portion when engaged.

Embodiment 29: The container of any of Embodiments 22 to 28, or any combination thereof, wherein the cover further comprises an outer sidewall extending outwardly from the peripheral edge of the top wall and configured so that an outer surface thereof is substantially flush with an outer surface of the secondary wall of the body portion when engaged.

Embodiment 30: The container of any of Embodiments 22 to 29, or any combination thereof, wherein an inner surface of the secondary wall comprises a retention mechanism configured to engage a mating structure on the cover to secure the cover to the body portion.

Embodiment 31: The container of any of Embodiments 22 to 30, or any combination thereof, wherein the retention mechanism comprises one or more recesses formed in the inner surface of the secondary wall and the mating structure comprises one or more protuberances disposed on the outer surface of the primary sidewall and configured to engage the one or more recesses.

Embodiment 32: The container of any of Embodiments 22 to 31, or any combination thereof, wherein one or more portions of the secondary wall flexes relative to the primary wall upon application of a force thereto and the cover is removable by flexing one of the one or more portions of the secondary wall inwardly to expose an edge of the cover.

Embodiment 33: The container of any of Embodiments 22 to 32, or any combination thereof, wherein the secondary wall returns to an unflexed position after removal of the force.

Embodiment 34: The container of any of Embodiments 22 to 33, or any combination thereof, wherein the upper edge of the secondary wall defines at least one cut-out configured to provide access to an edge of the cover.

Embodiment 35: The container of any of Embodiments 22 to 34, or any combination thereof, wherein the cover engages the body portion via an interference fit or a snap fit.

Embodiment 36: The container of any of Embodiments 22 to 35, or any combination thereof, wherein the primary wall of the body portion defines a generally cylindrical shape and the secondary wall defines a generally prismatic or polyhedral shape.

Embodiment 37: The container of any of Embodiments 22 to 36, or any combination thereof, wherein the primary sidewall of the cover defines a generally cylindrical shape and the outer sidewall of the cover defines a generally prismatic or polyhedral shape corresponding to the generally prismatic or polyhedral shape of the secondary wall of the body portion.

Embodiment 38: The container of any of Embodiments 22 to 37, or any combination thereof, further comprising a tamper evident feature.

Embodiment 39: The container of any of Embodiments 22 to 38, or any combination thereof, wherein the tamper evident feature comprises a substrate disposed on at least one of the bottom wall or the top wall and at least two tabs extending outwardly from the substrate and attached to the body portion and the cover, each tab spanning an interface between the body portion and the cover.

Embodiment 40: The container of any of Embodiments 22 to 39, or any combination thereof, wherein the substrate comprises a label or other indicia.

Embodiment 41: The container of any of Embodiments 22 to 40, or any combination thereof, wherein the at least two tabs are perforated.

Embodiment 42: The container of any of Embodiments 22 to 41, or any combination thereof, wherein at least one of the body portion or the cover are manufactured via injection molding.

Embodiment 43: The container of any of Embodiments 22 to 42, or any combination thereof, wherein at least one of the body portion or the cover comprises a polypropylene.

Embodiment 44: The container of any of Embodiments 22 to 43, or any combination thereof, wherein at least one of the body portion or the cover further comprises a waste compartment.

Embodiment 45: The container of any preceding embodiment, or any combination of any preceding embodiment, wherein a top or horizontal edge of the outer surface of the sidewall is at least partially coupled to the inner surface of the sidewall via a bridge spanning the channel and enclosing a top opening of the channel.

Embodiment 46: The container of any preceding embodiment, or any combination of any preceding embodiment, wherein the bridge comprises a lower yield strength than the sidewall.

These and other features, aspects, and advantages of the present disclosure will be apparent from a reading of the following detailed description together with the accompanying figures, which are briefly described below. The present disclosure includes any combination of two, three, four or more features or elements set forth in this disclosure, regardless of whether such features or elements are expressly combined or otherwise recited in a specific example implementation described herein. This disclosure is intended to be read holistically such that any separable features or elements of the disclosure, in any of its aspects and example implementations, should be viewed as combinable, unless the context of the disclosure clearly dictates otherwise.

It will therefore be appreciated that this Brief Summary is provided merely for purposes of summarizing some example implementations so as to provide a basic understanding of some aspects of the disclosure. Accordingly, it will be appreciated that the above described example implementations are merely examples and should not be construed to narrow the scope or spirit of the disclosure in any way. Other example implementations, aspects and advantages will become apparent from the following detailed description taken in conjunction with the accompanying figures which illustrate, by way of example, the principles of some described example implementations.

BRIEF DESCRIPTION OF THE FIGURES

Figure 1A:
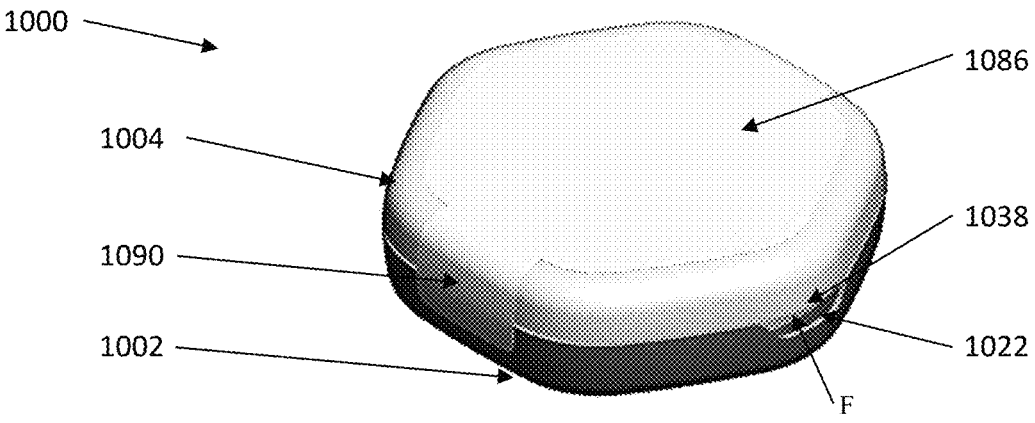
Figure 1B:
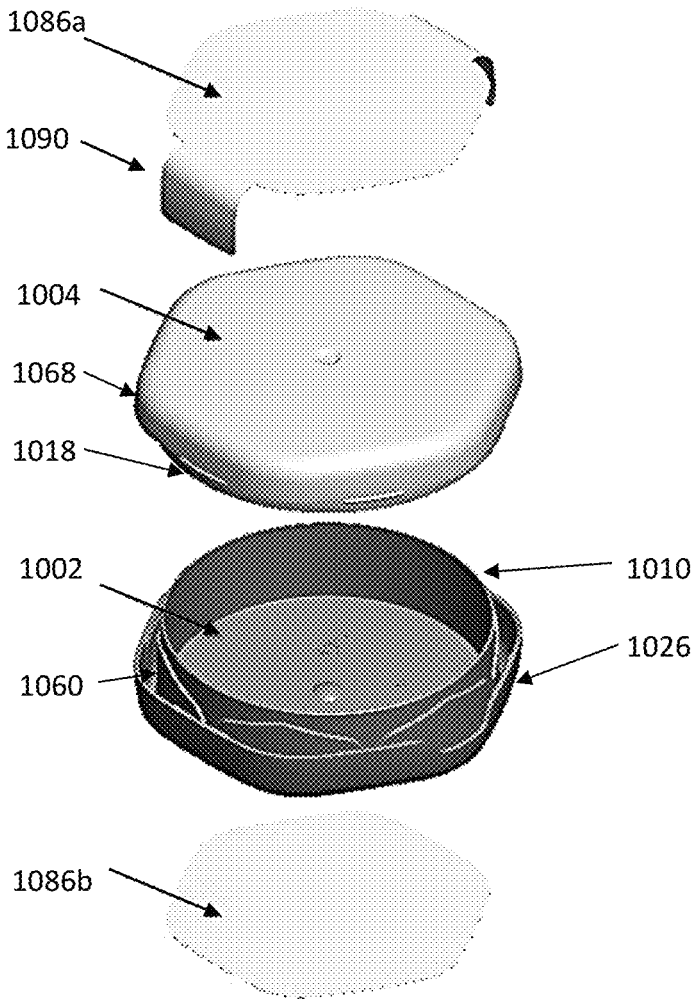
Figure 2:
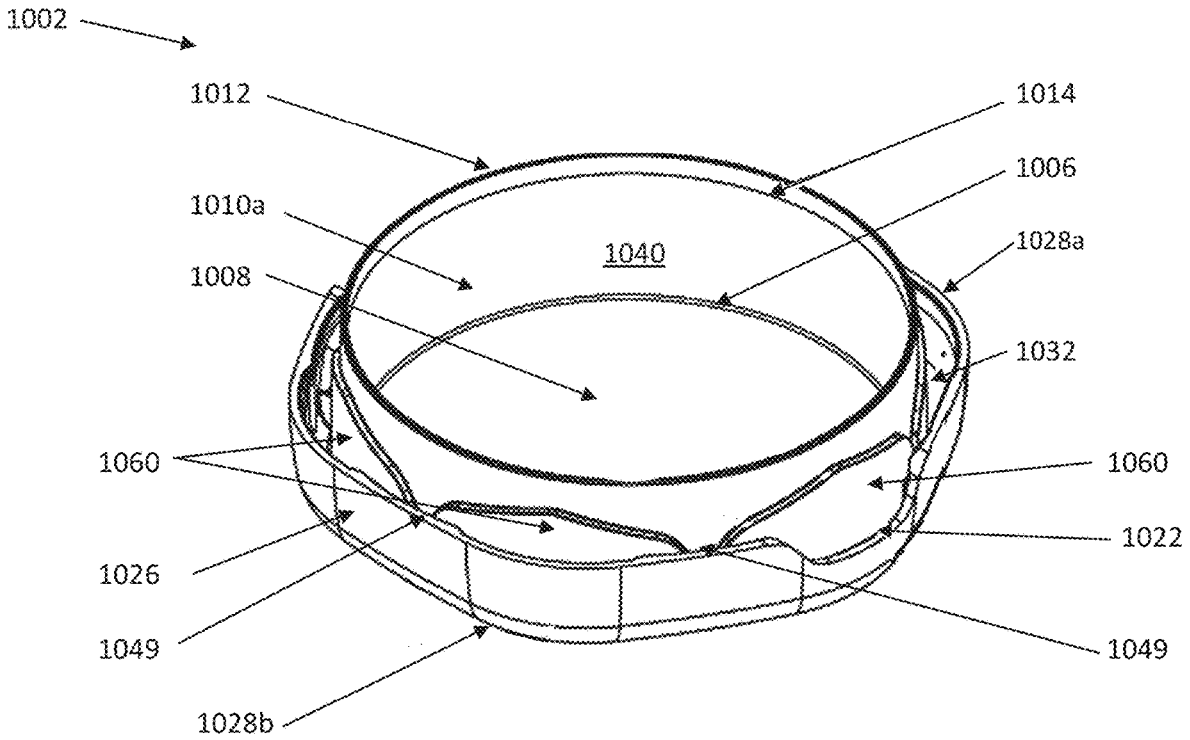
Figure 3A:
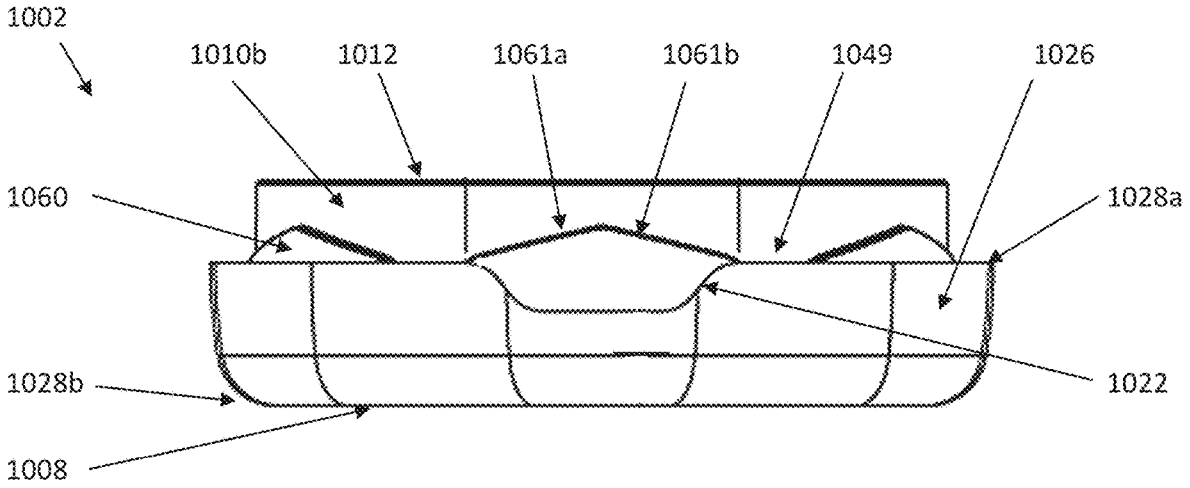
Figure 3B:
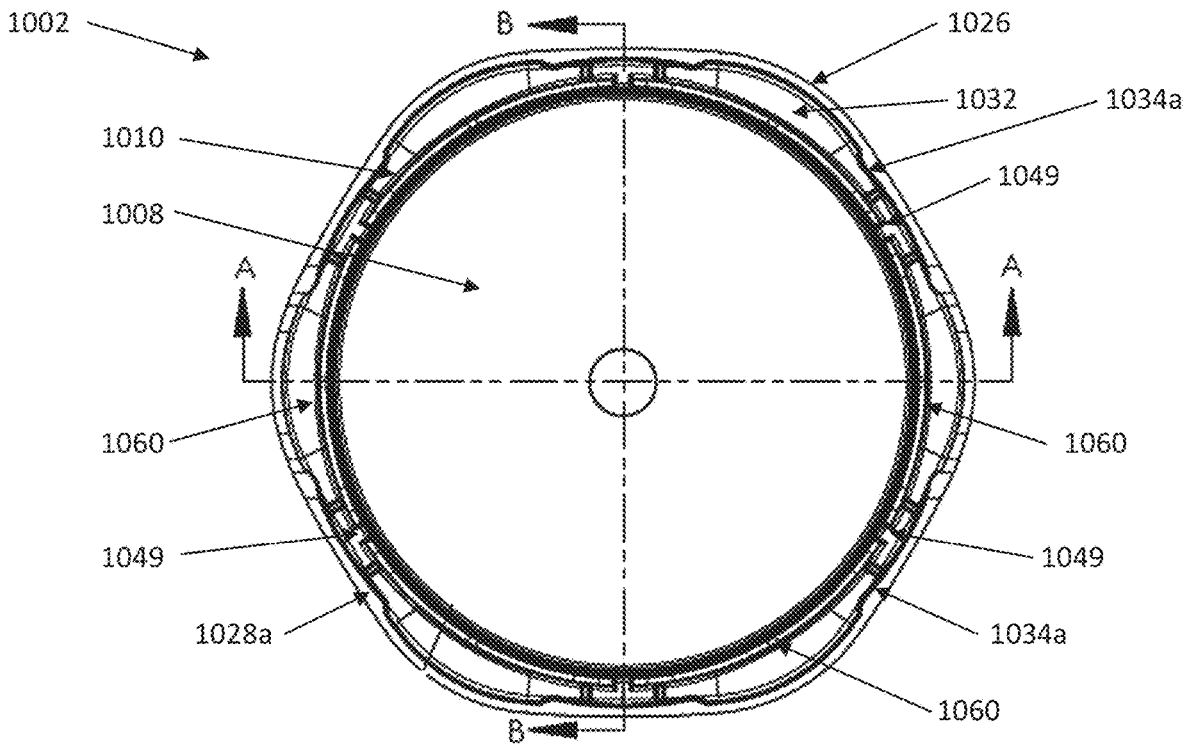
Figure 3C:
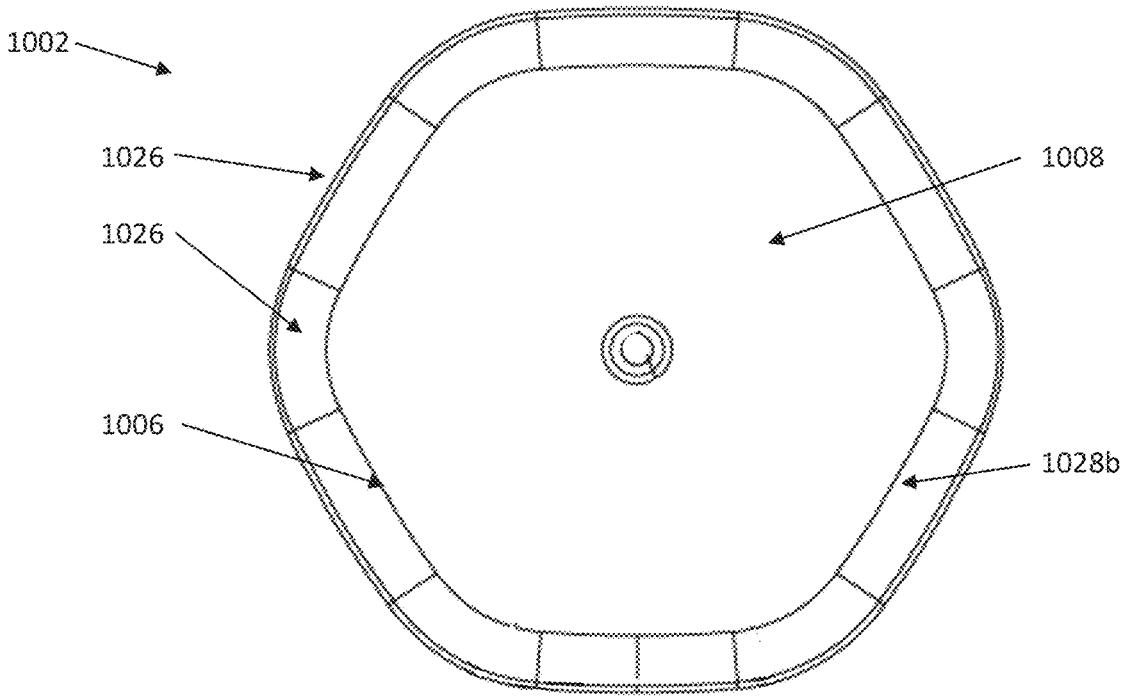
Figure 4A:
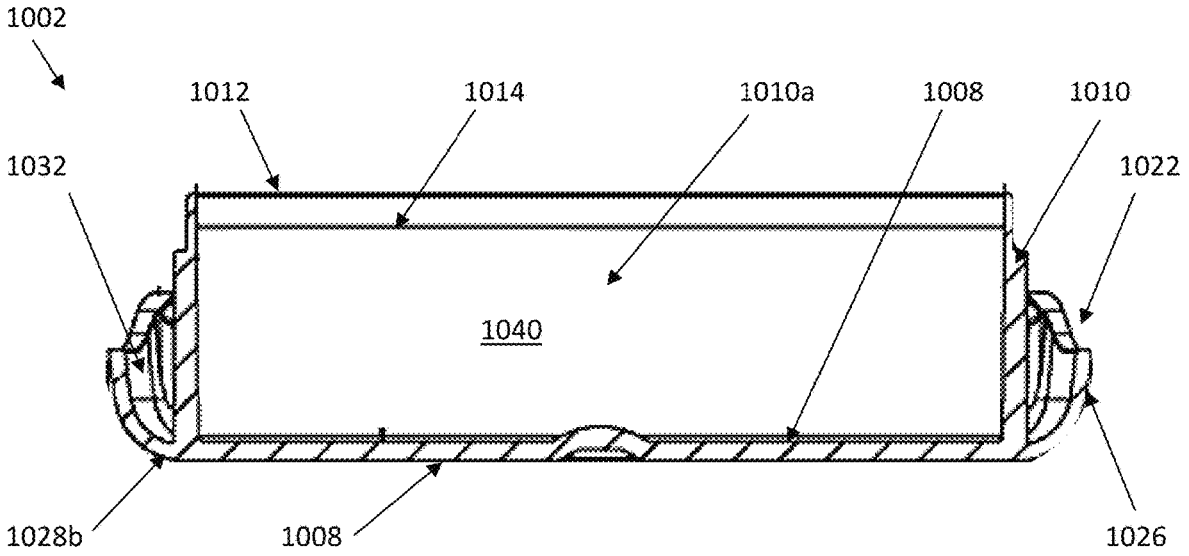
Figure 4B:
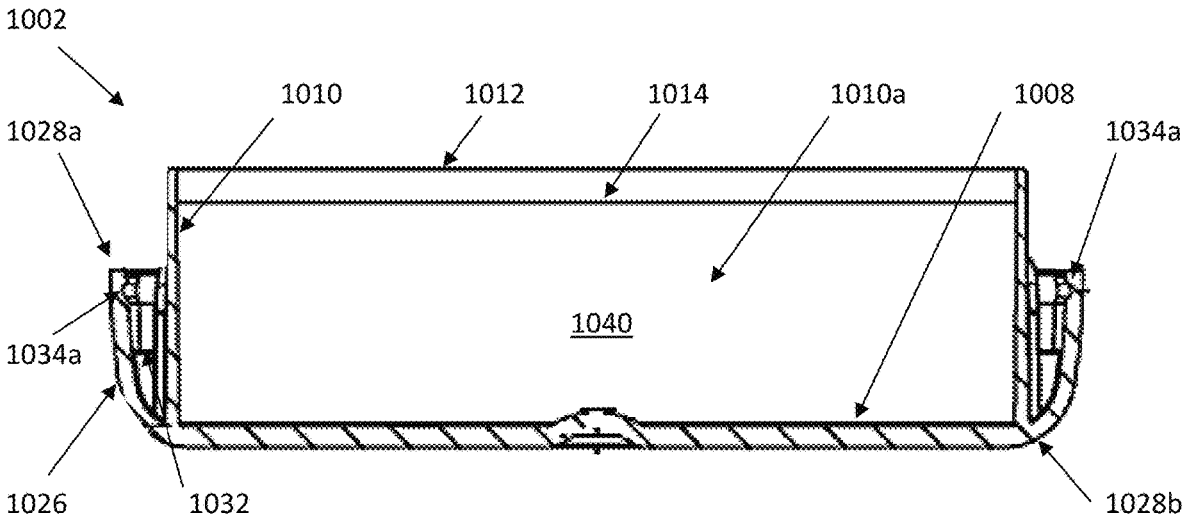
Figure 5:
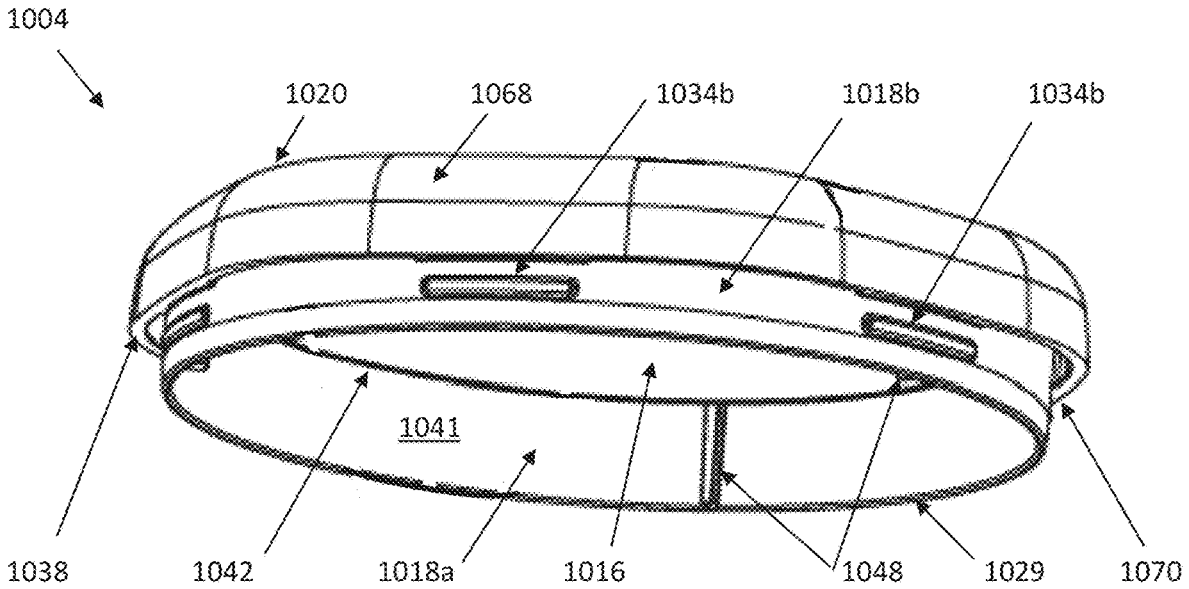
Figure 6A:
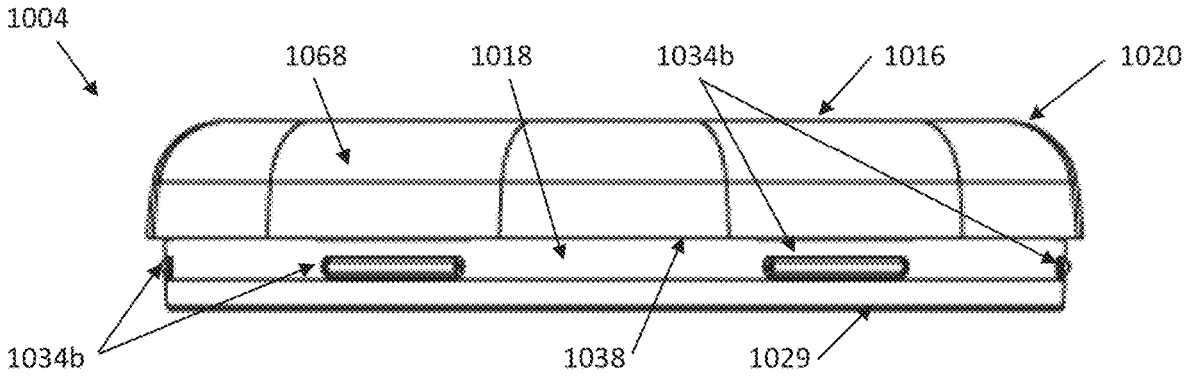
Figure 6B:
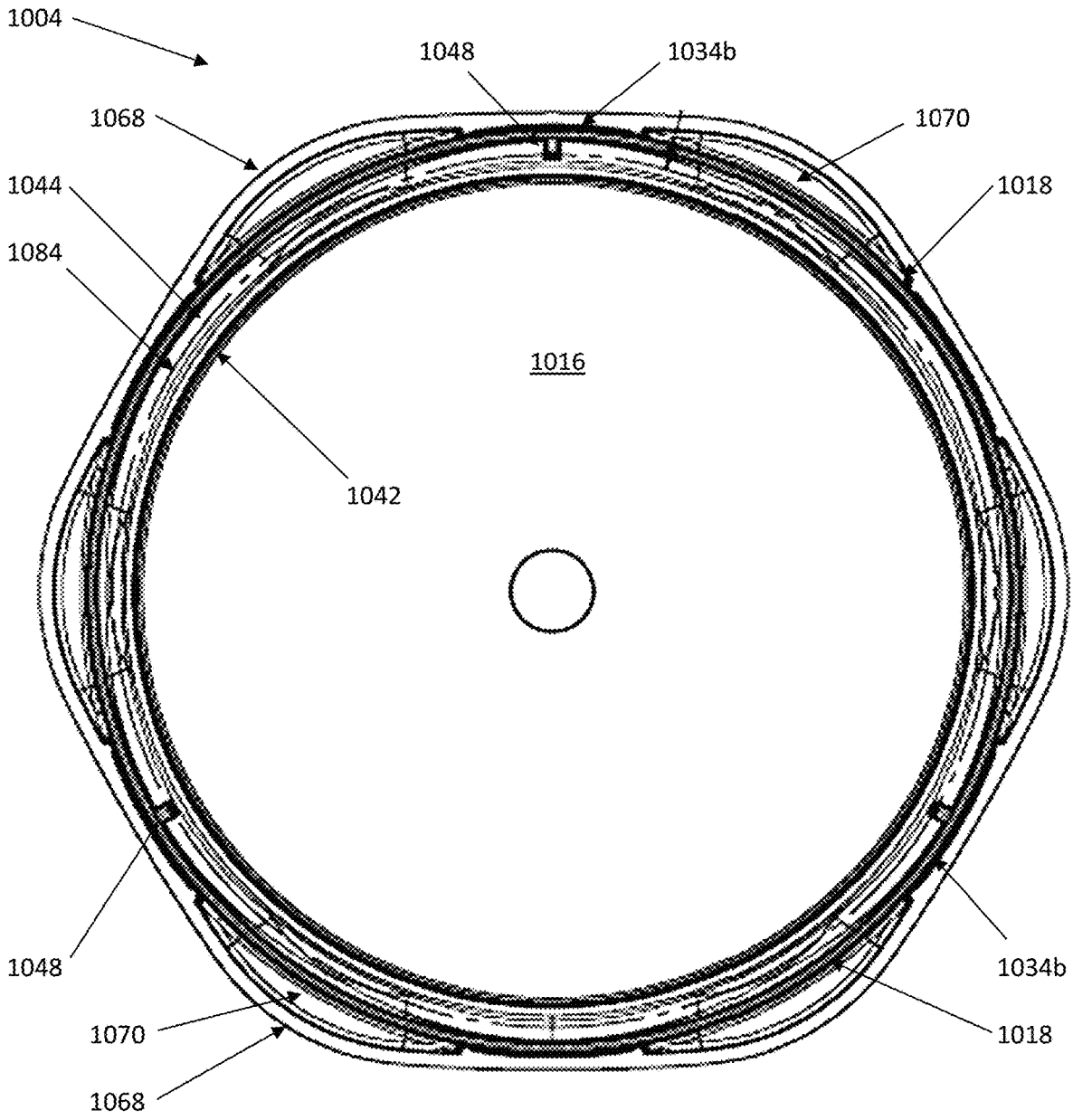
Figure 6C:
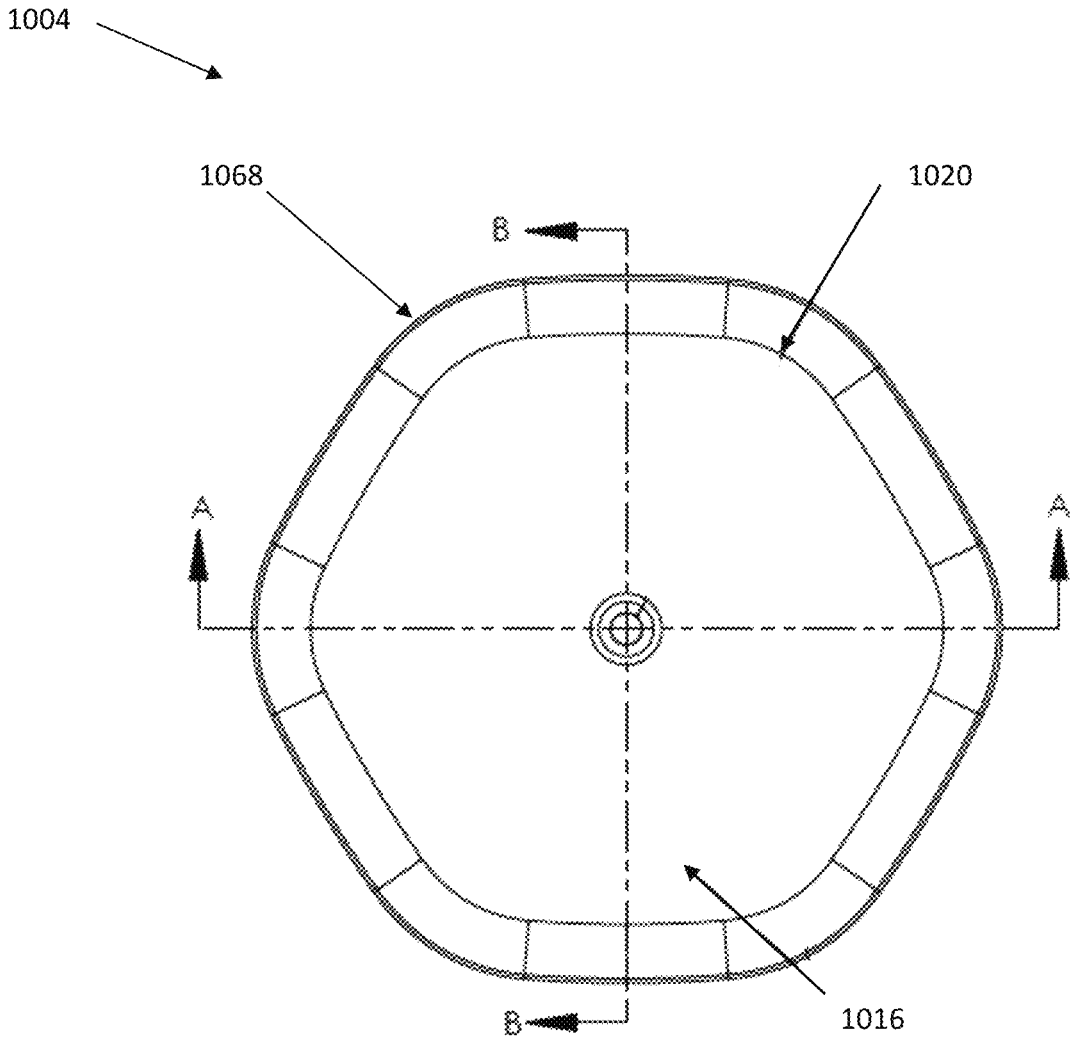
Figure 7A:
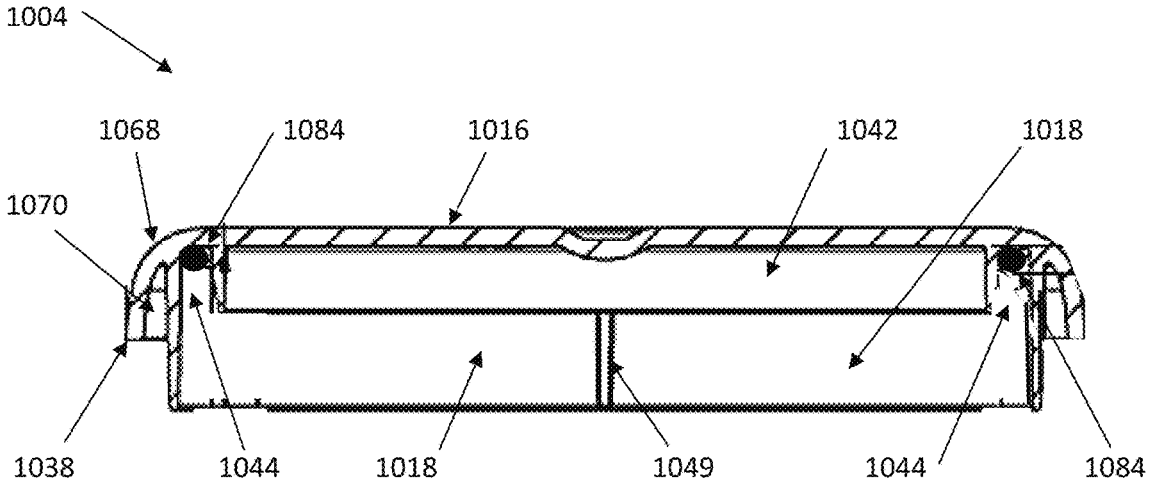
Figure 7B:
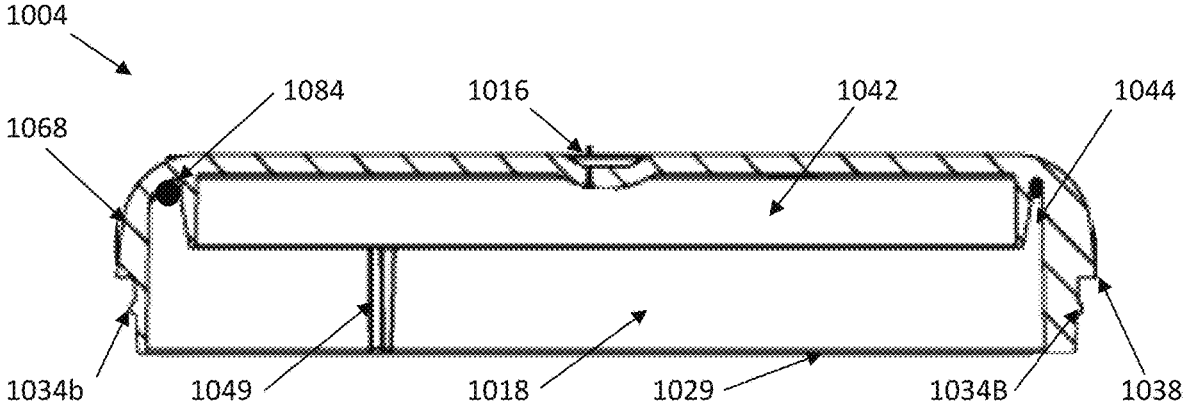
Figure 8:
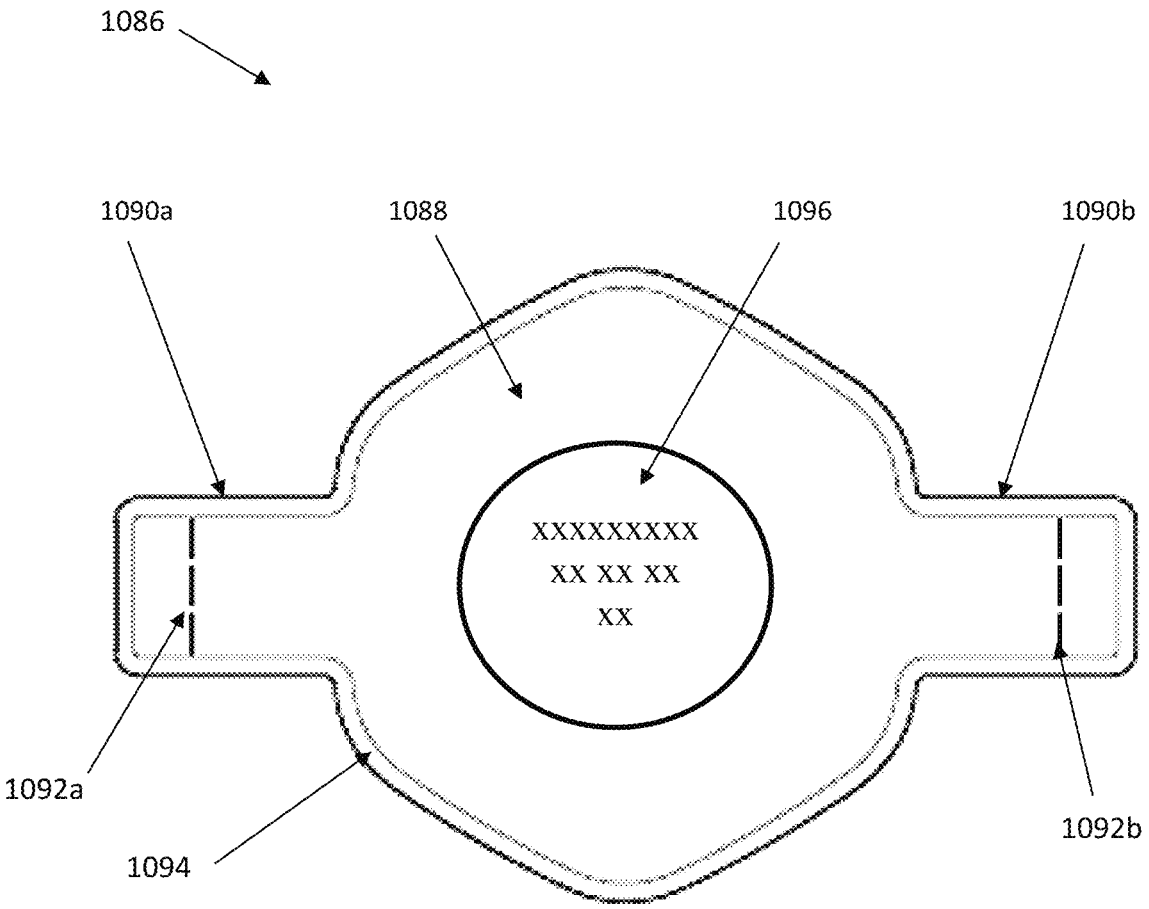
Figure 9:
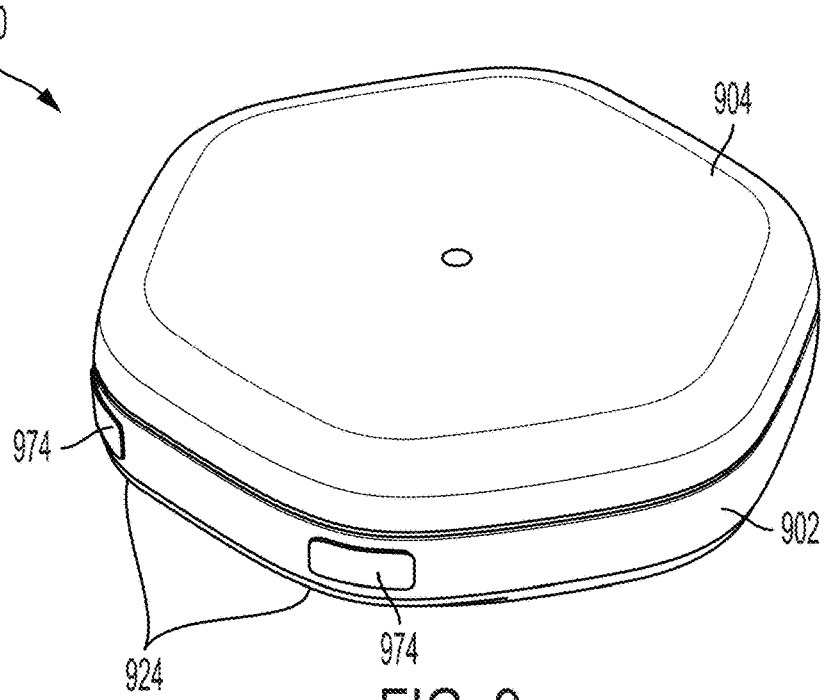
Figure 10:
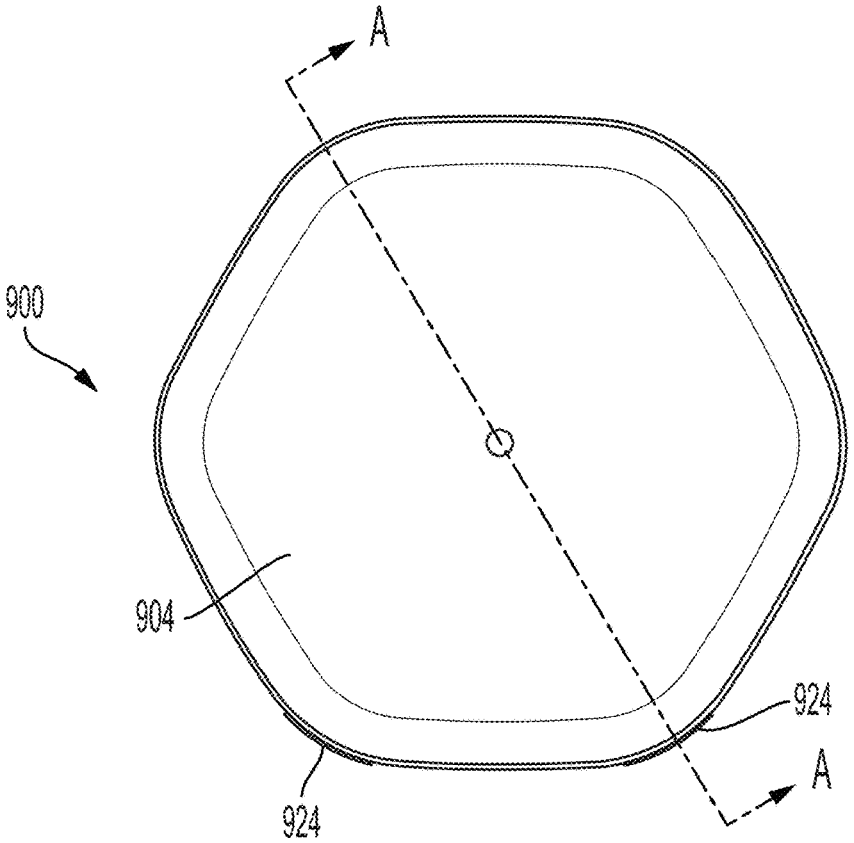
Figure 11:
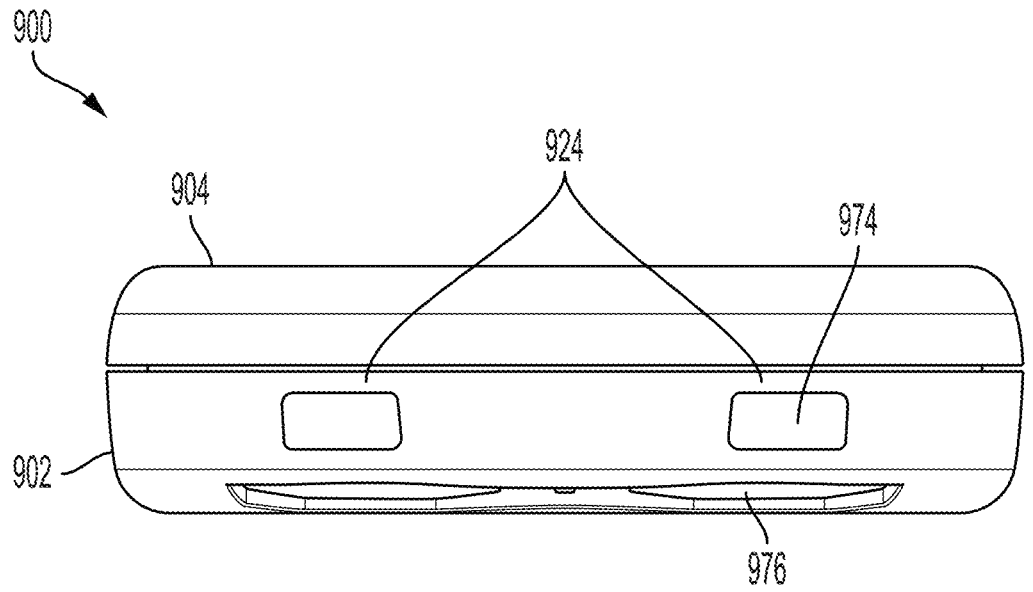
Figure 12:
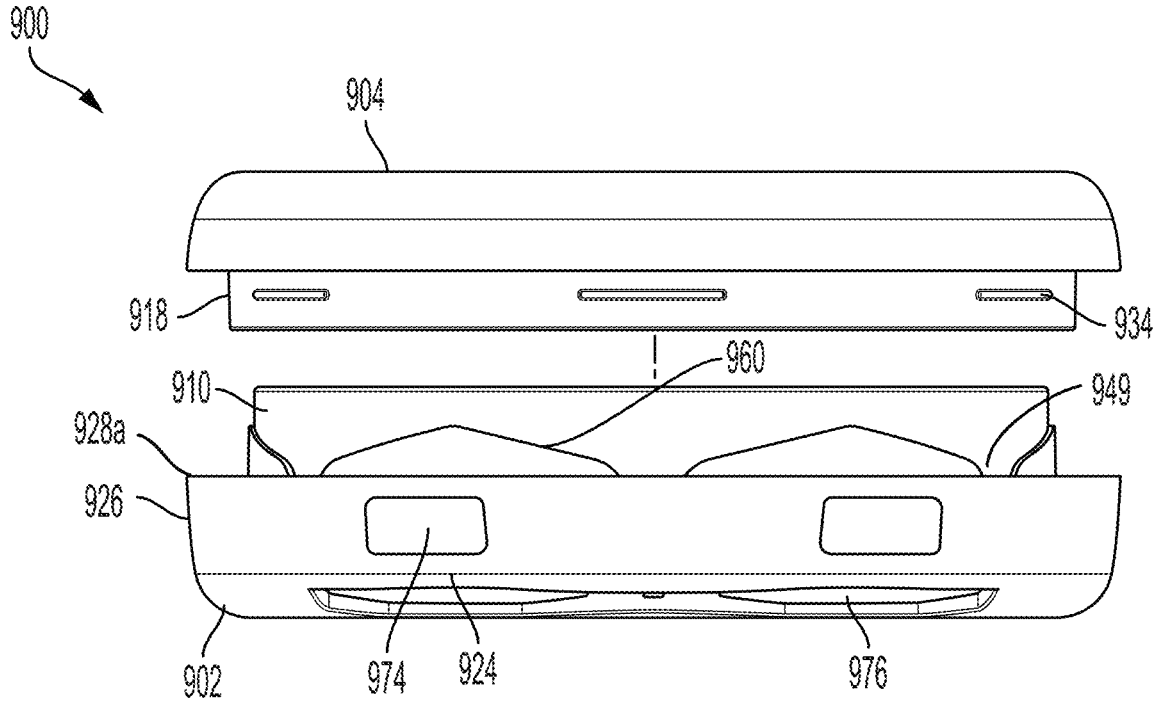
Figure 13A:
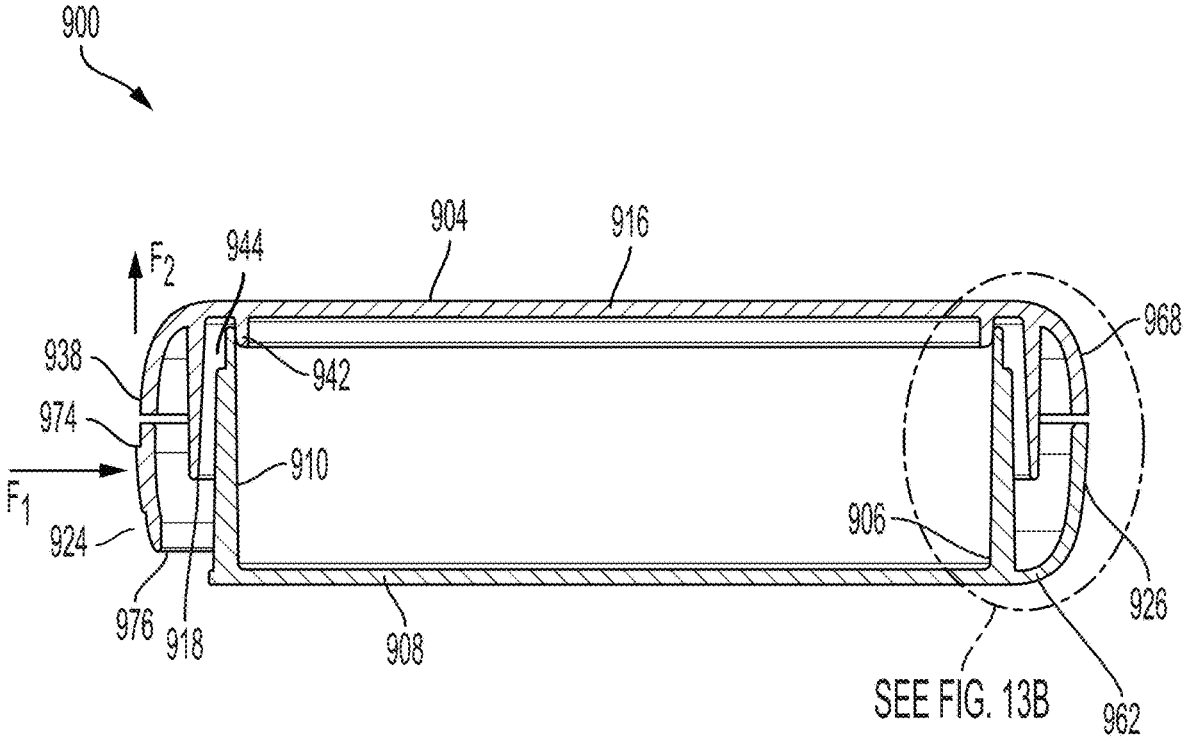
Figure 13B:
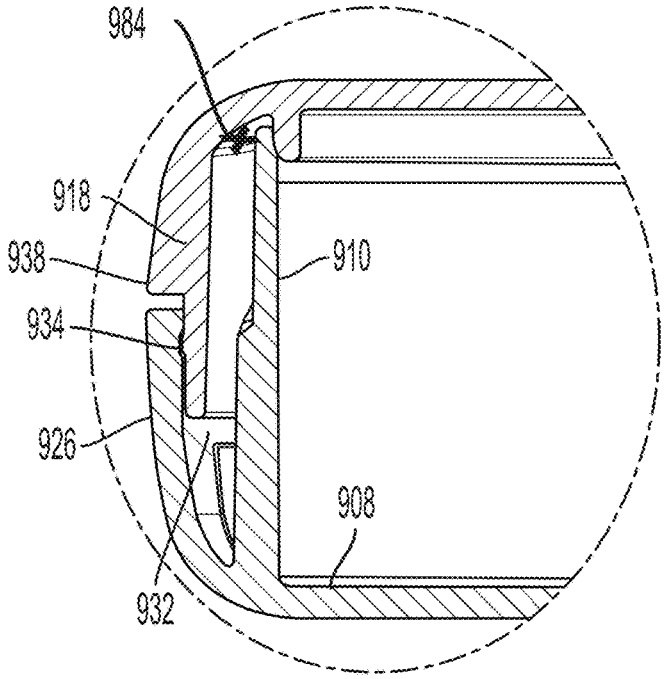
Figure 14:
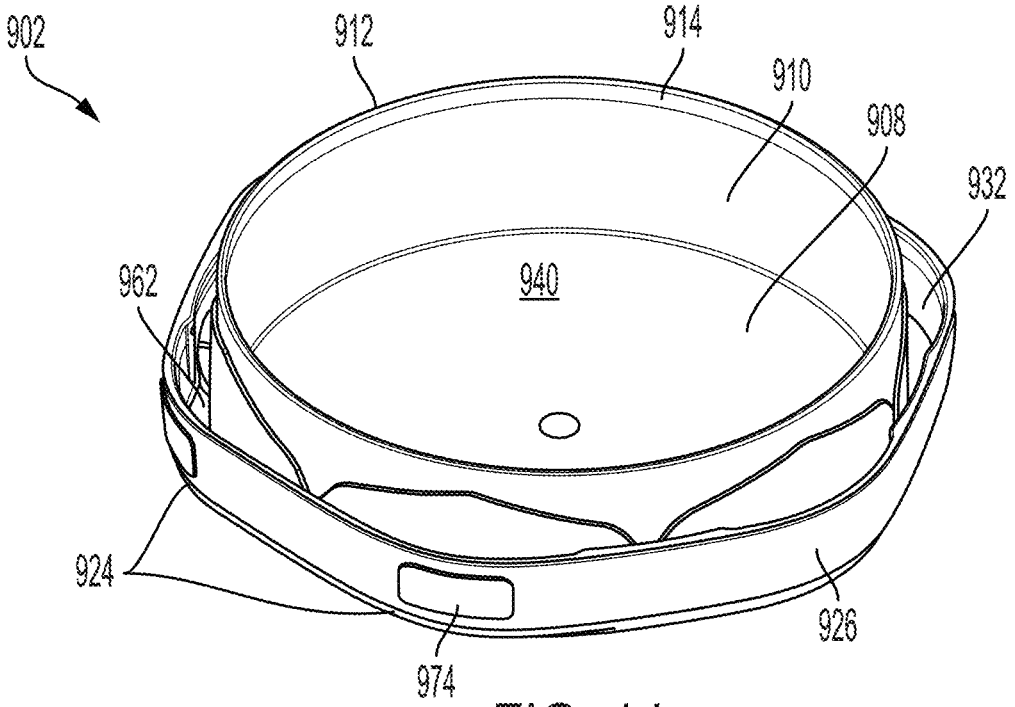
Figure 15:
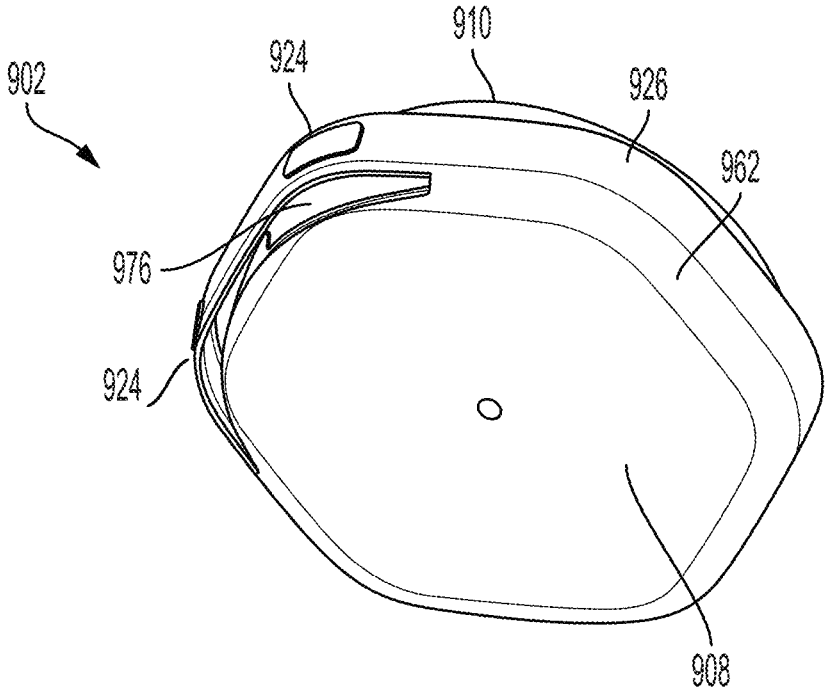
Figure 16:
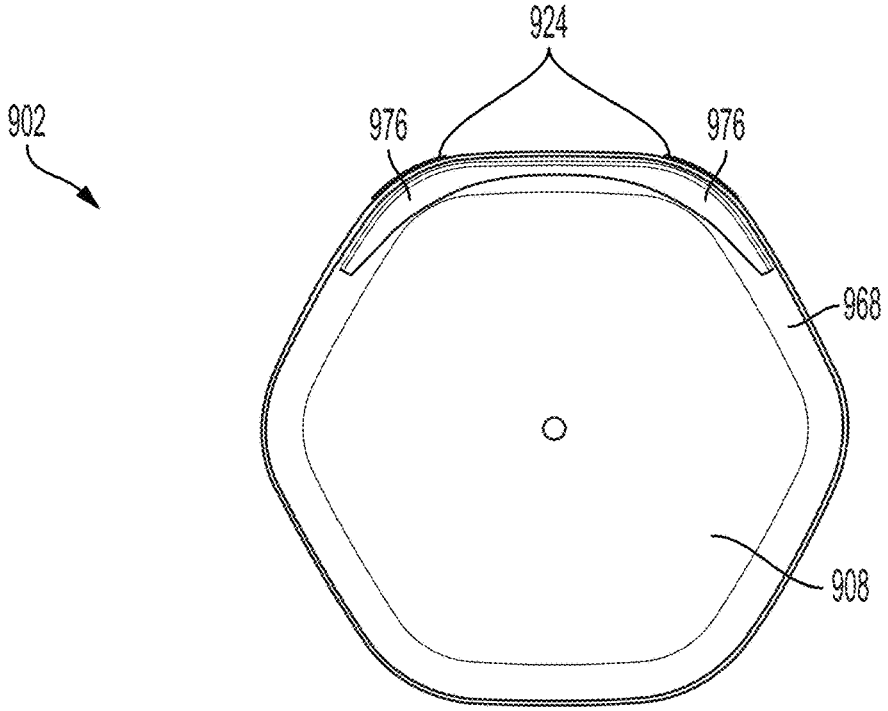
Figure 17:
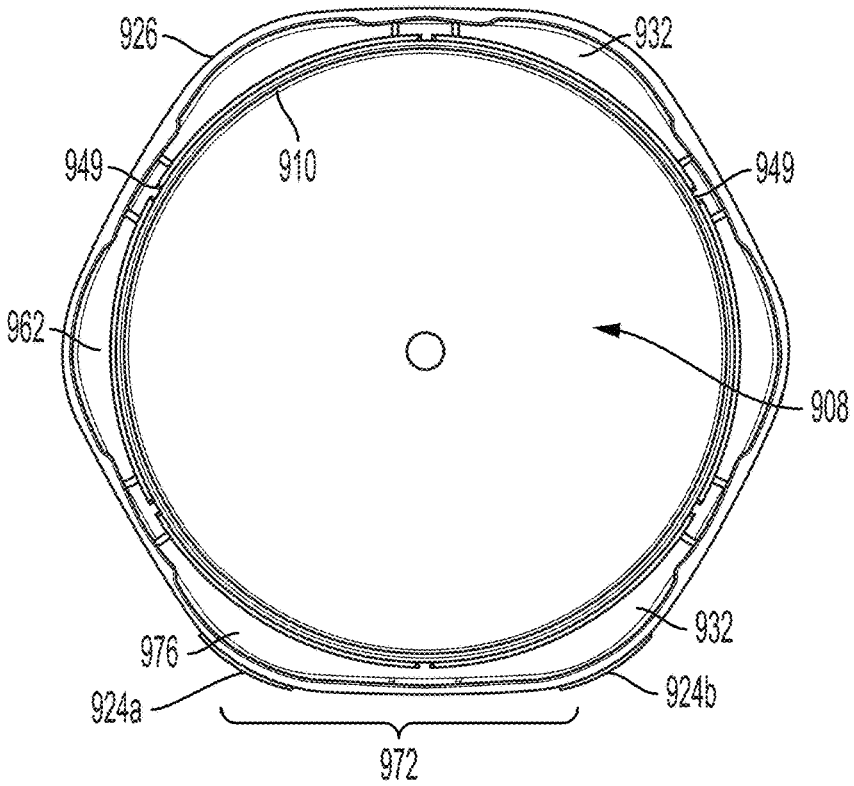
Figure 18A:
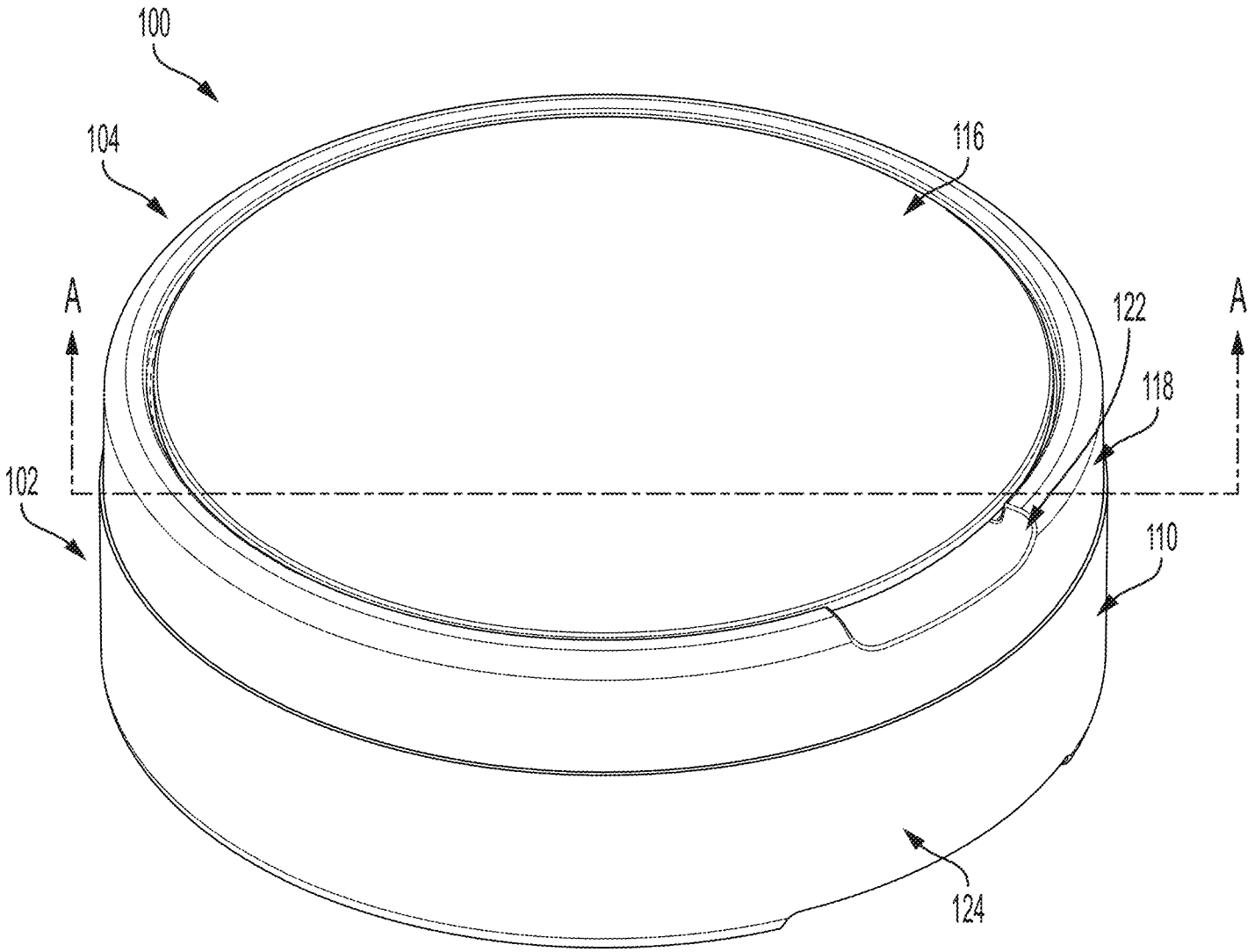
Figure 18B:
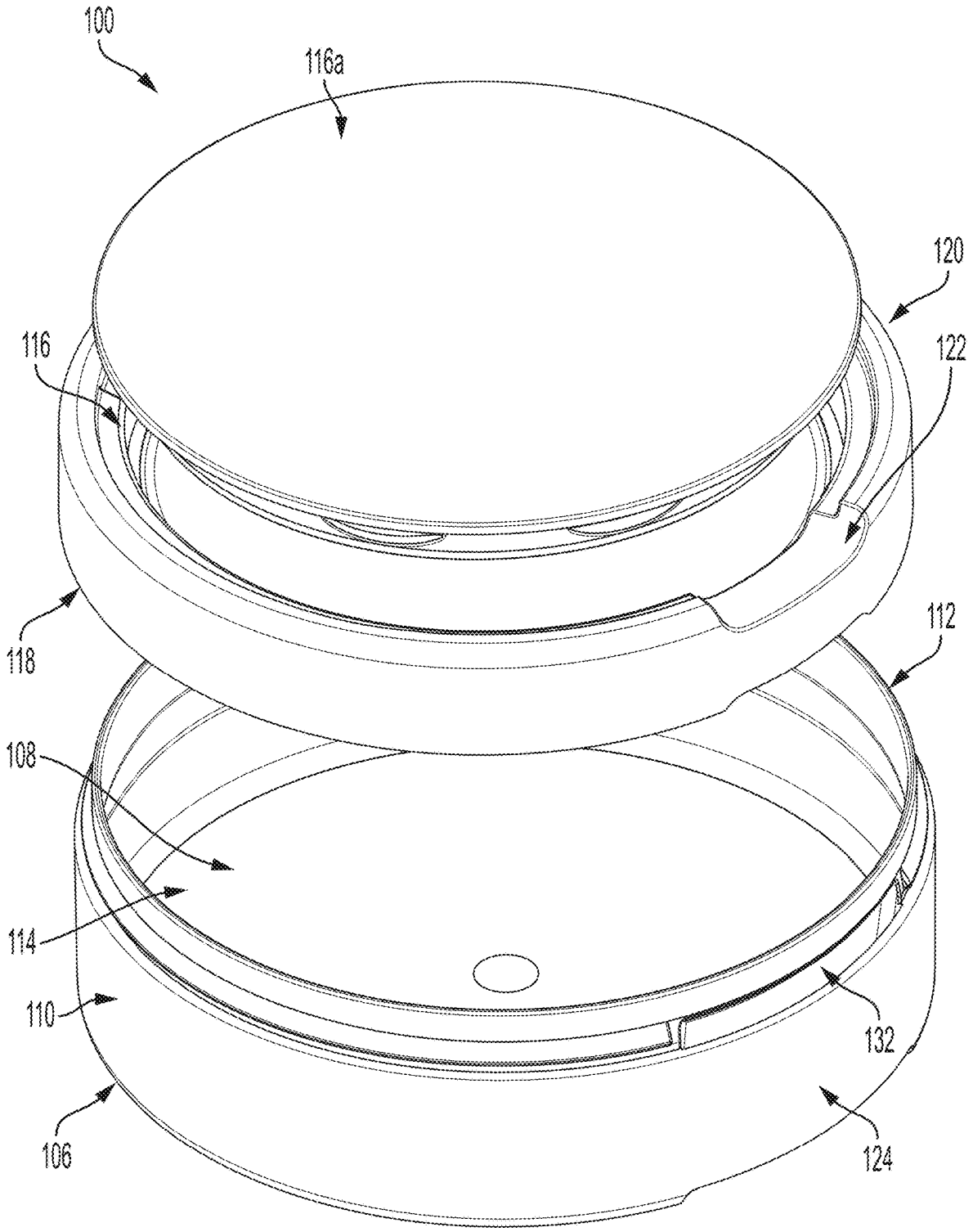
Figure 19:
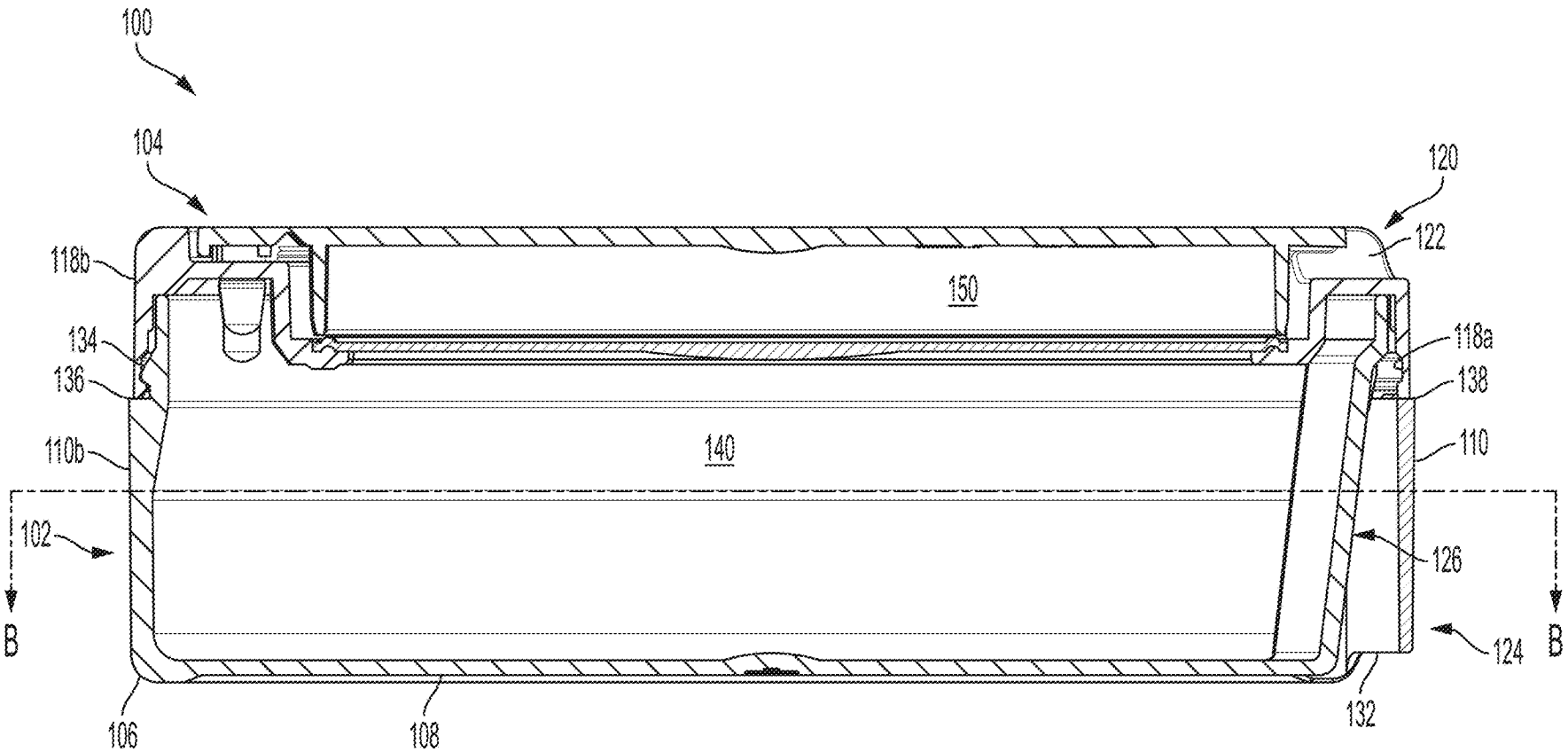
Figure 19A:
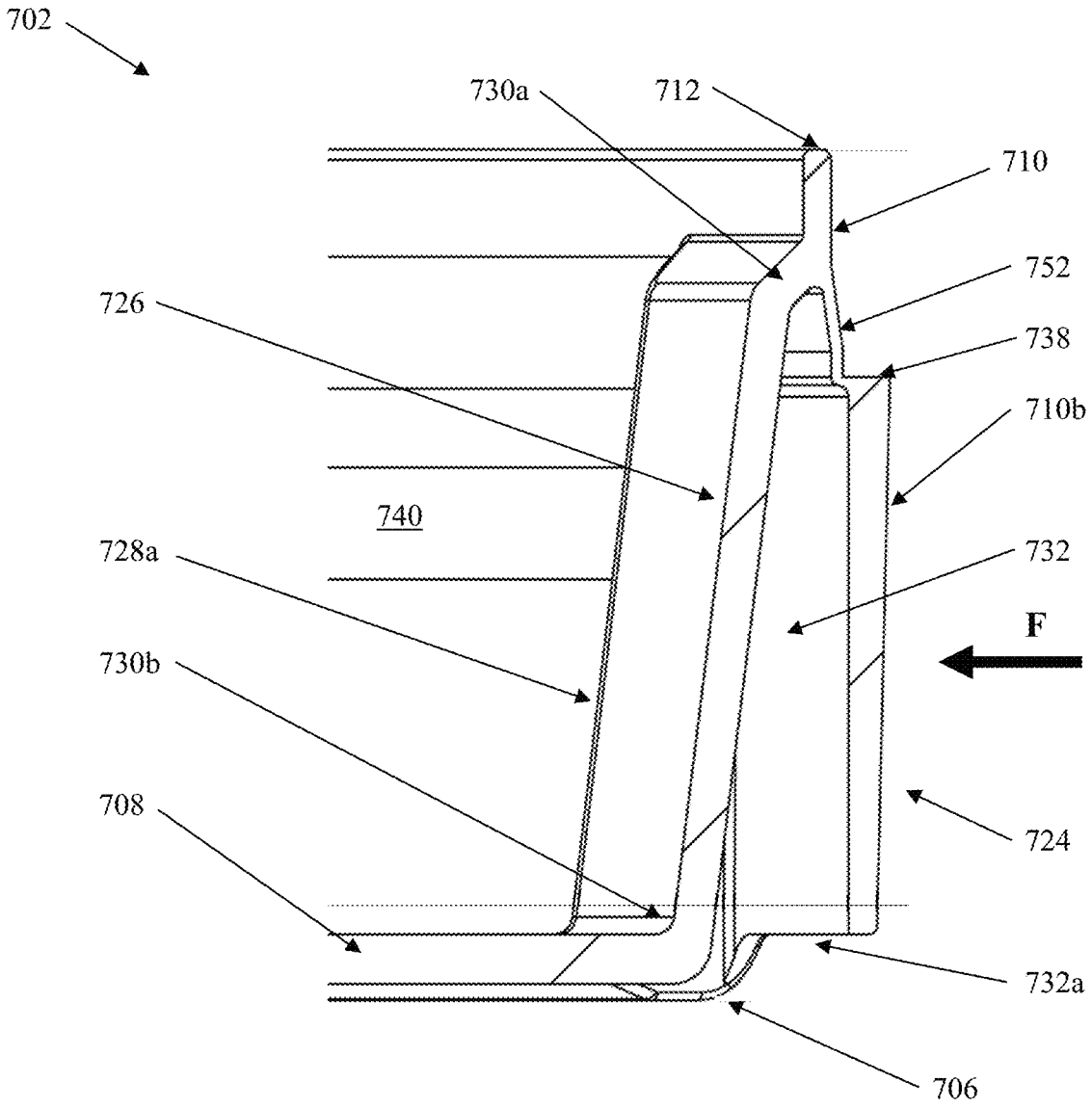
Figure 20:
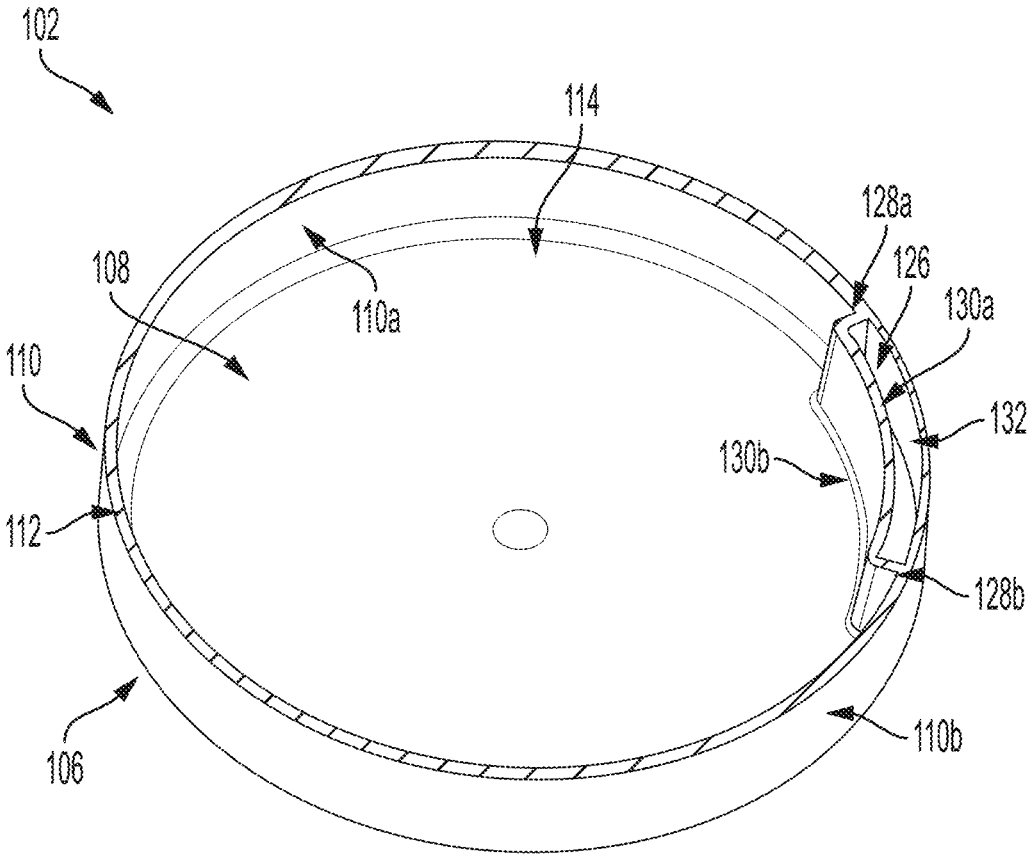
Figure 22A:
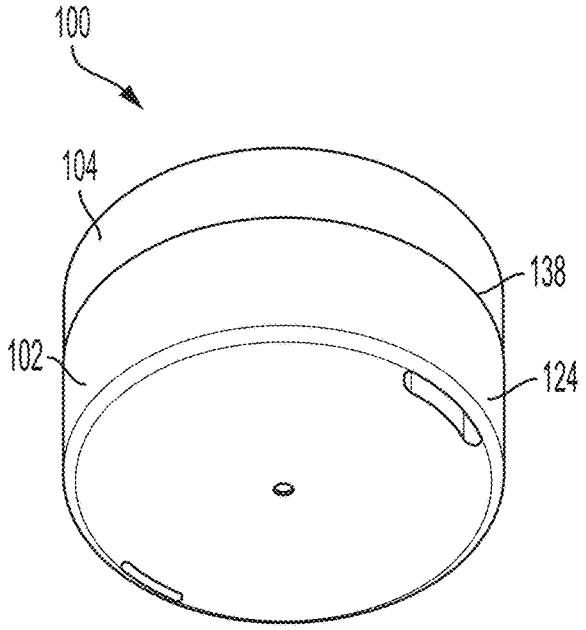
Figure 22B:
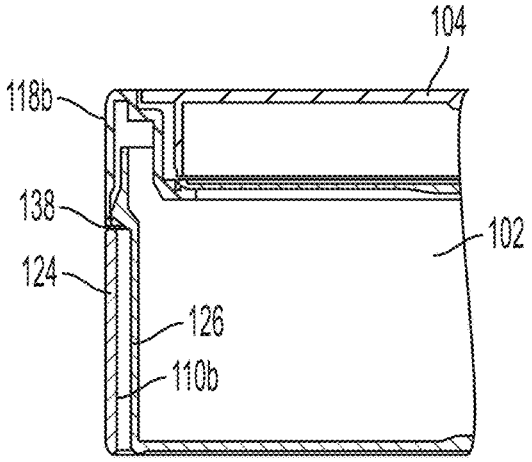
Figure 22C:
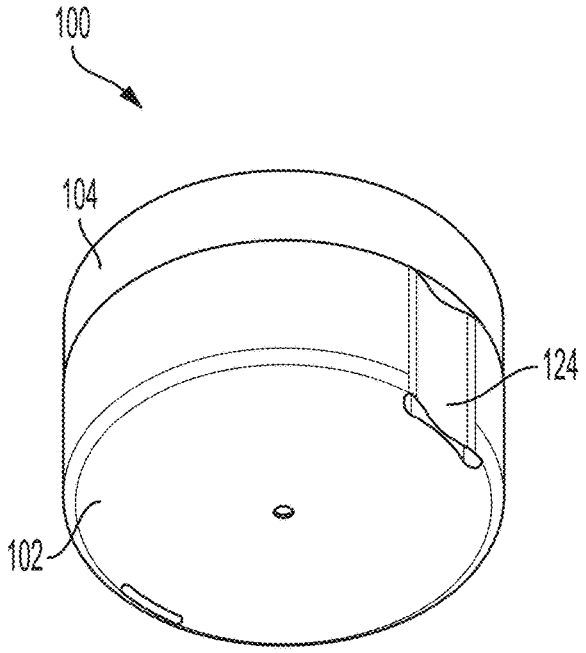
Figure 22D:
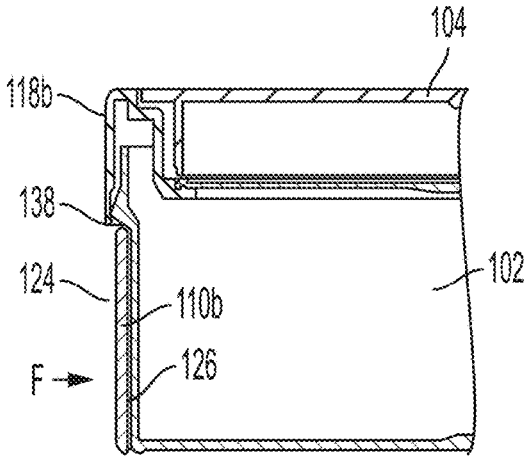
Figure 23:
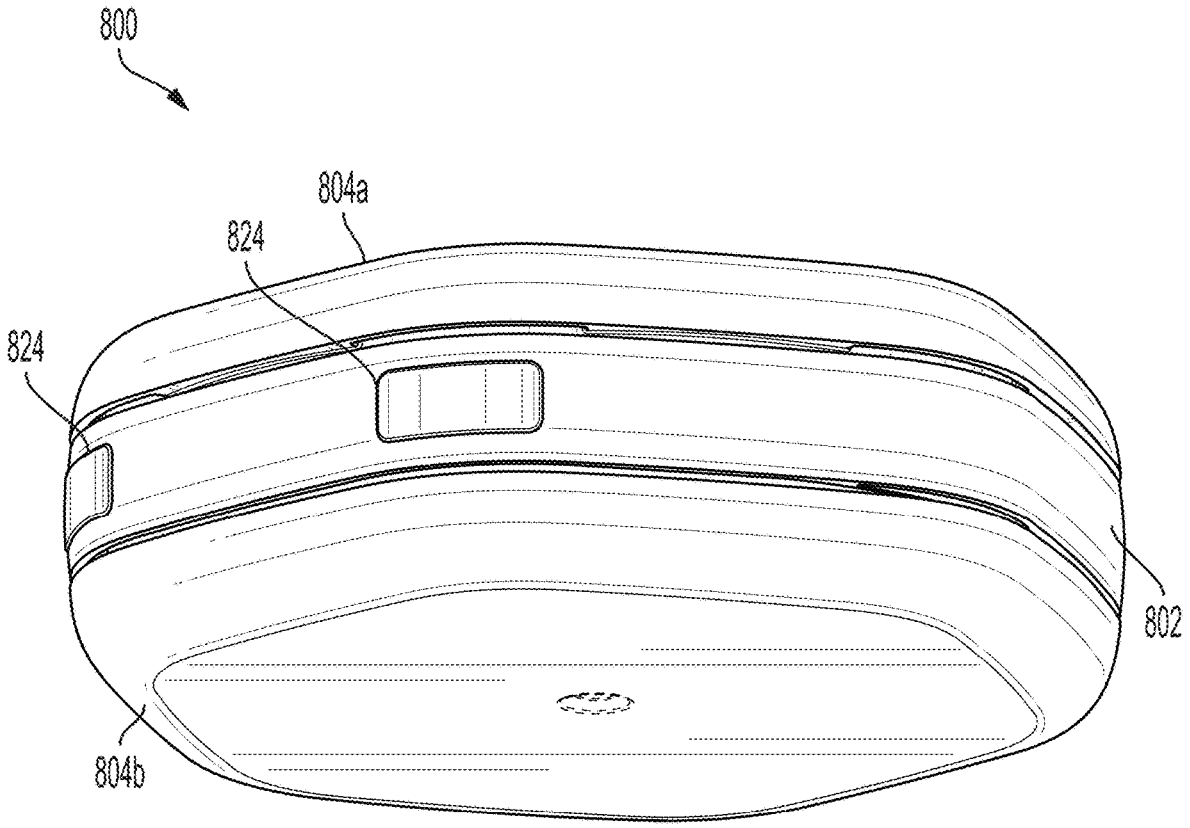
Figure 24:
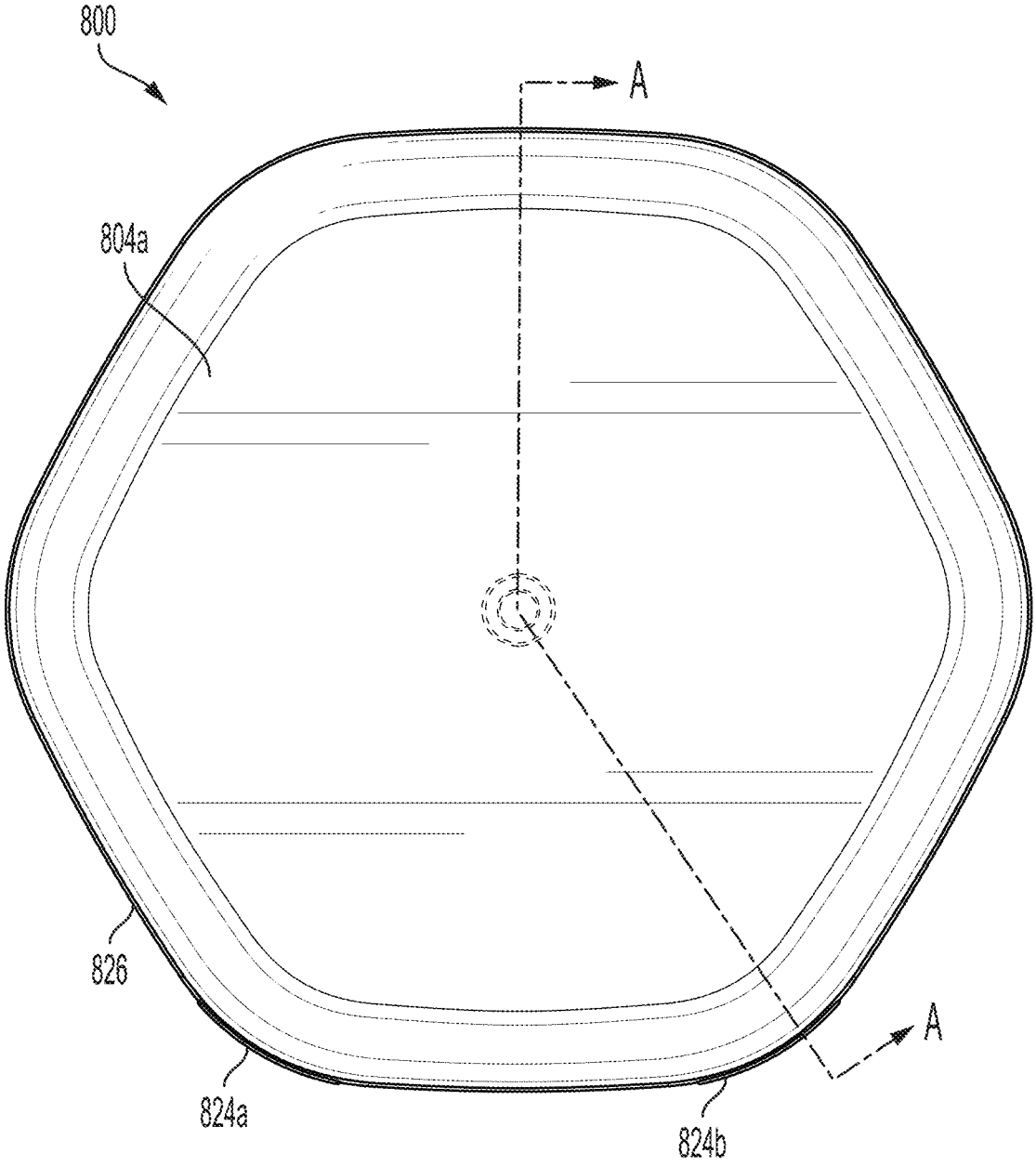
Figure 25:
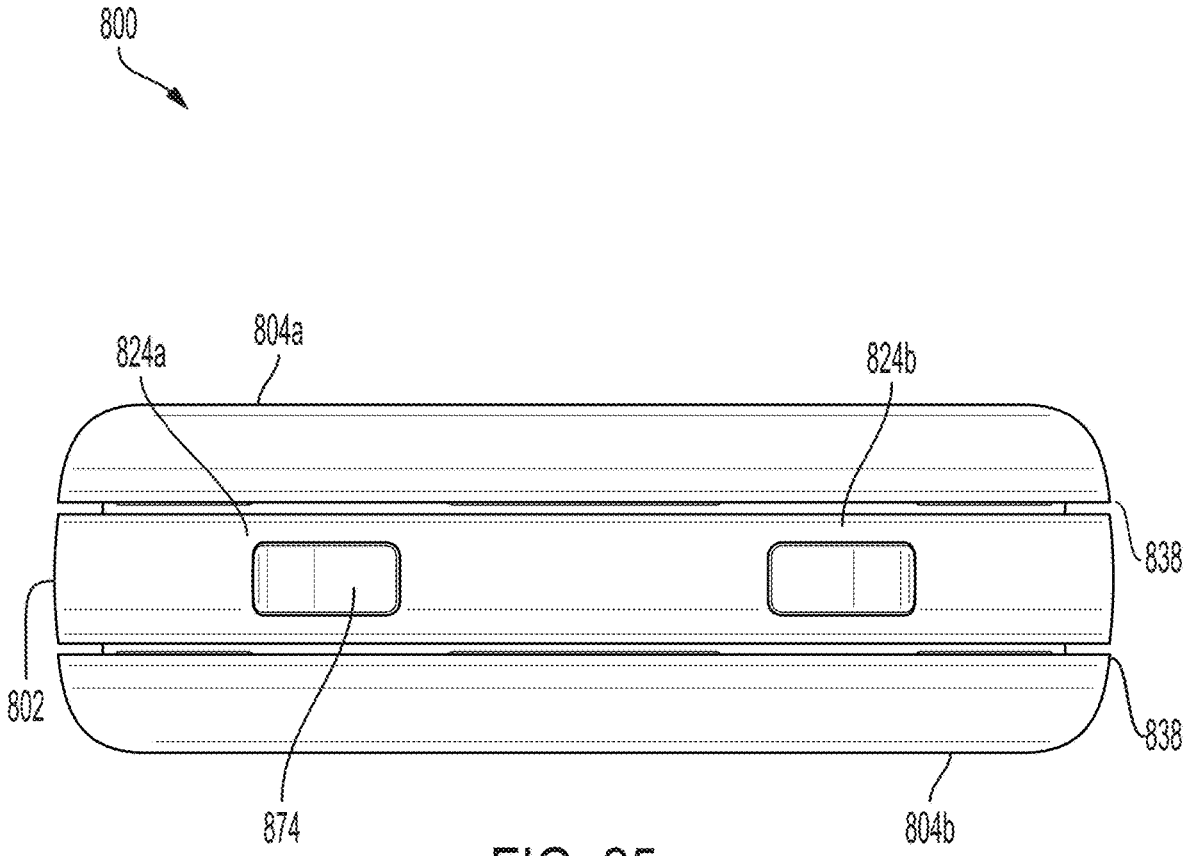
Figure 26:
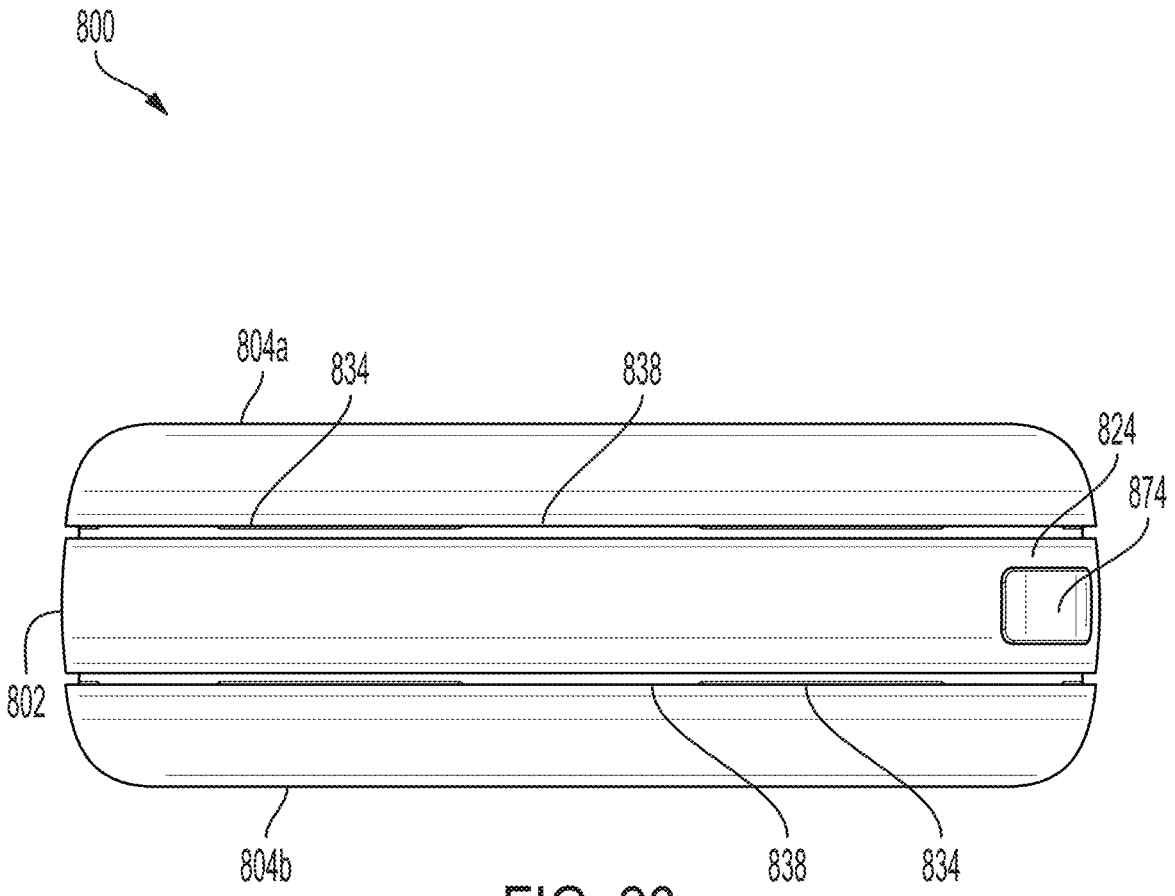
Figure 27:
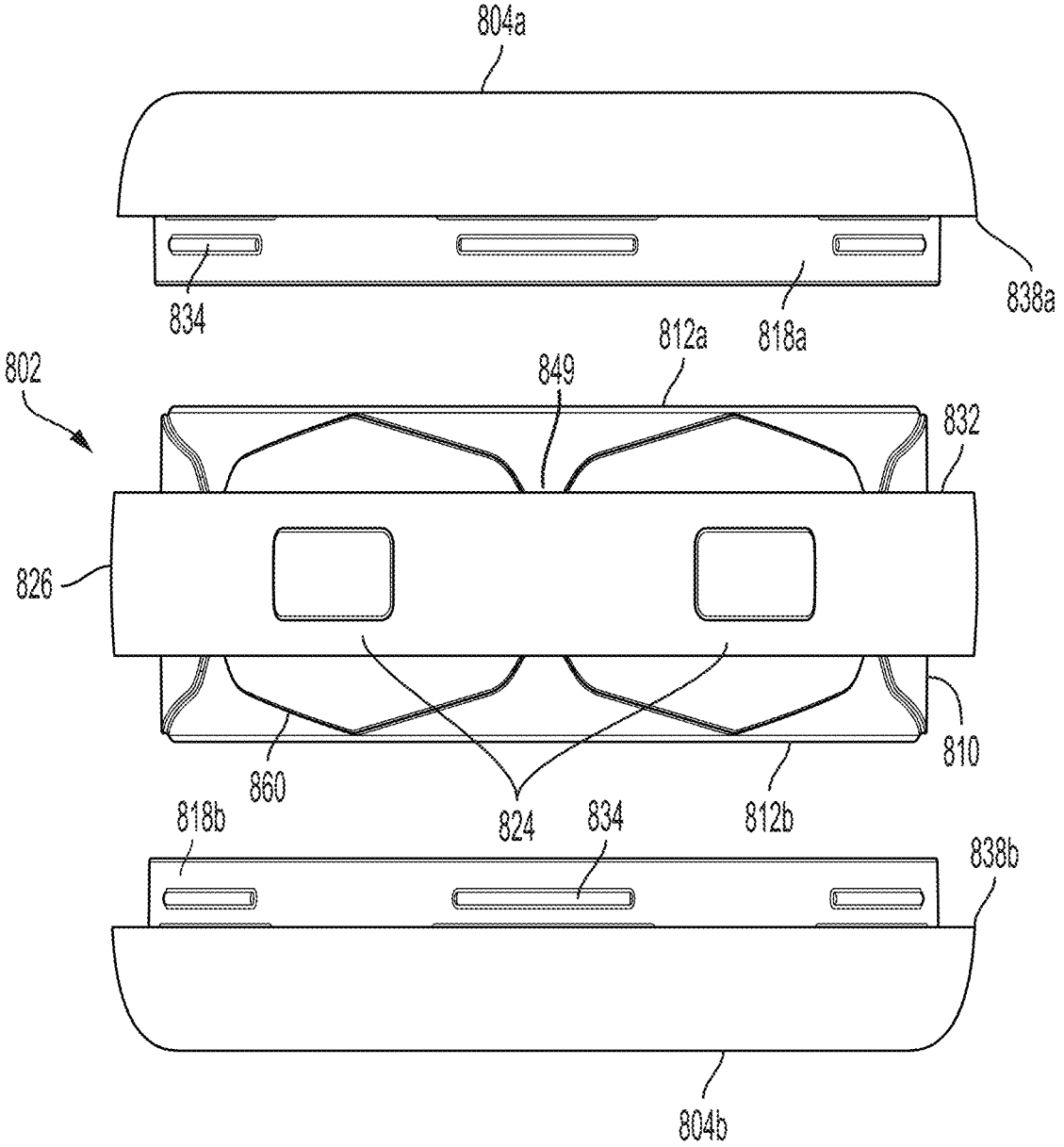
Figure 28A:
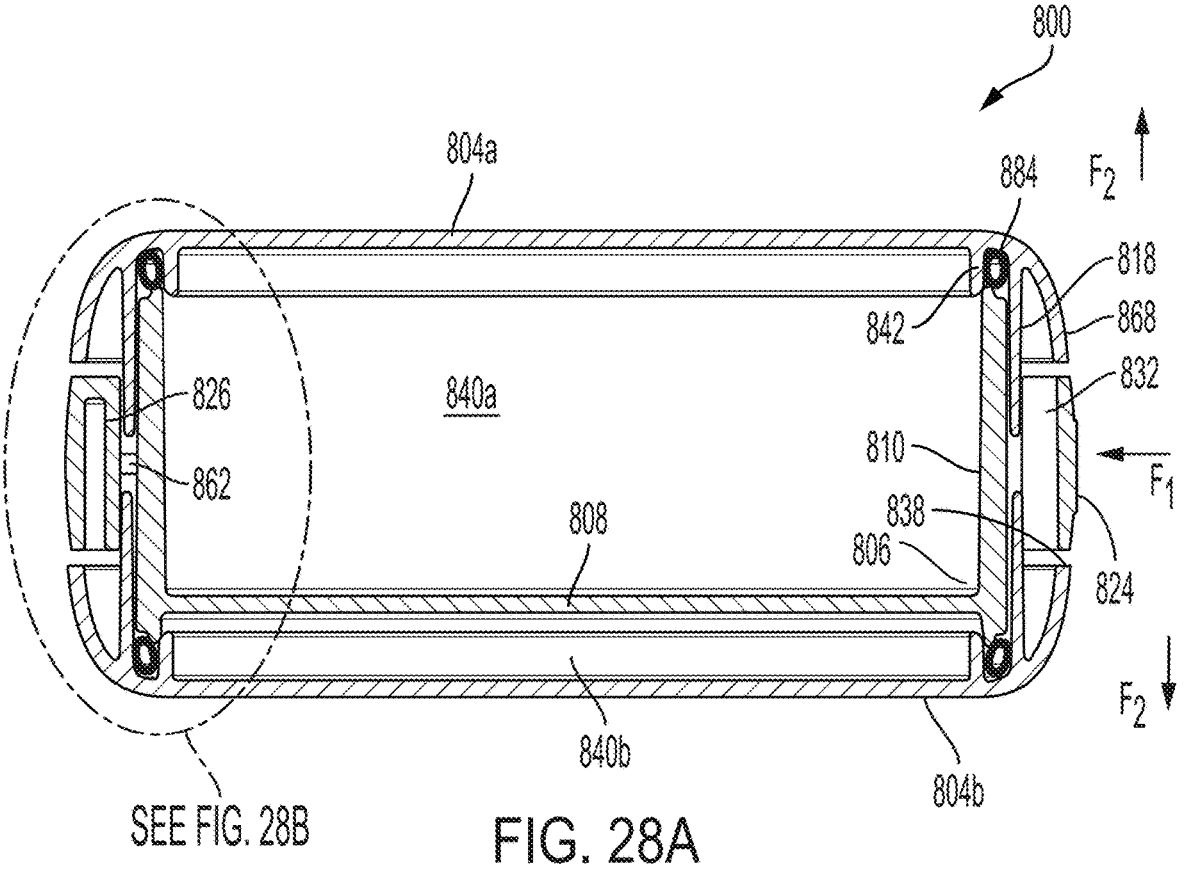
Figure 28B:
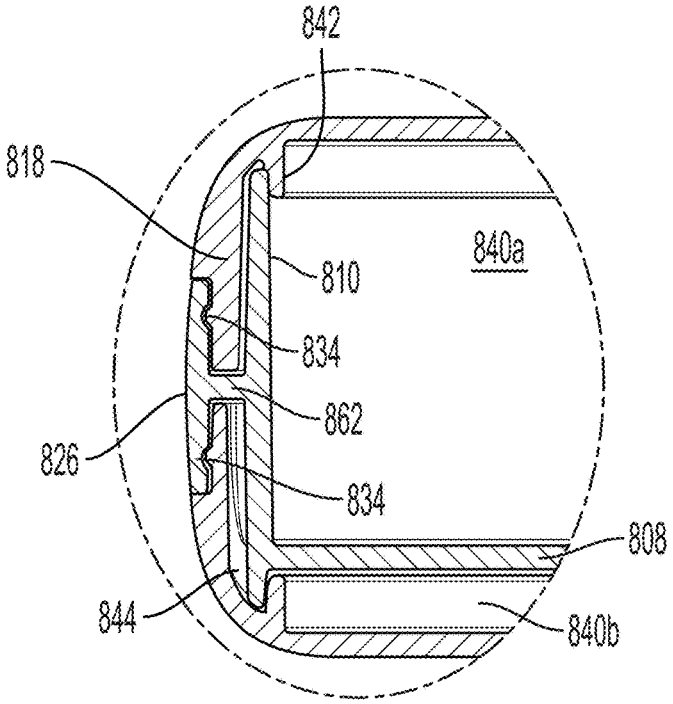
Figure 29:
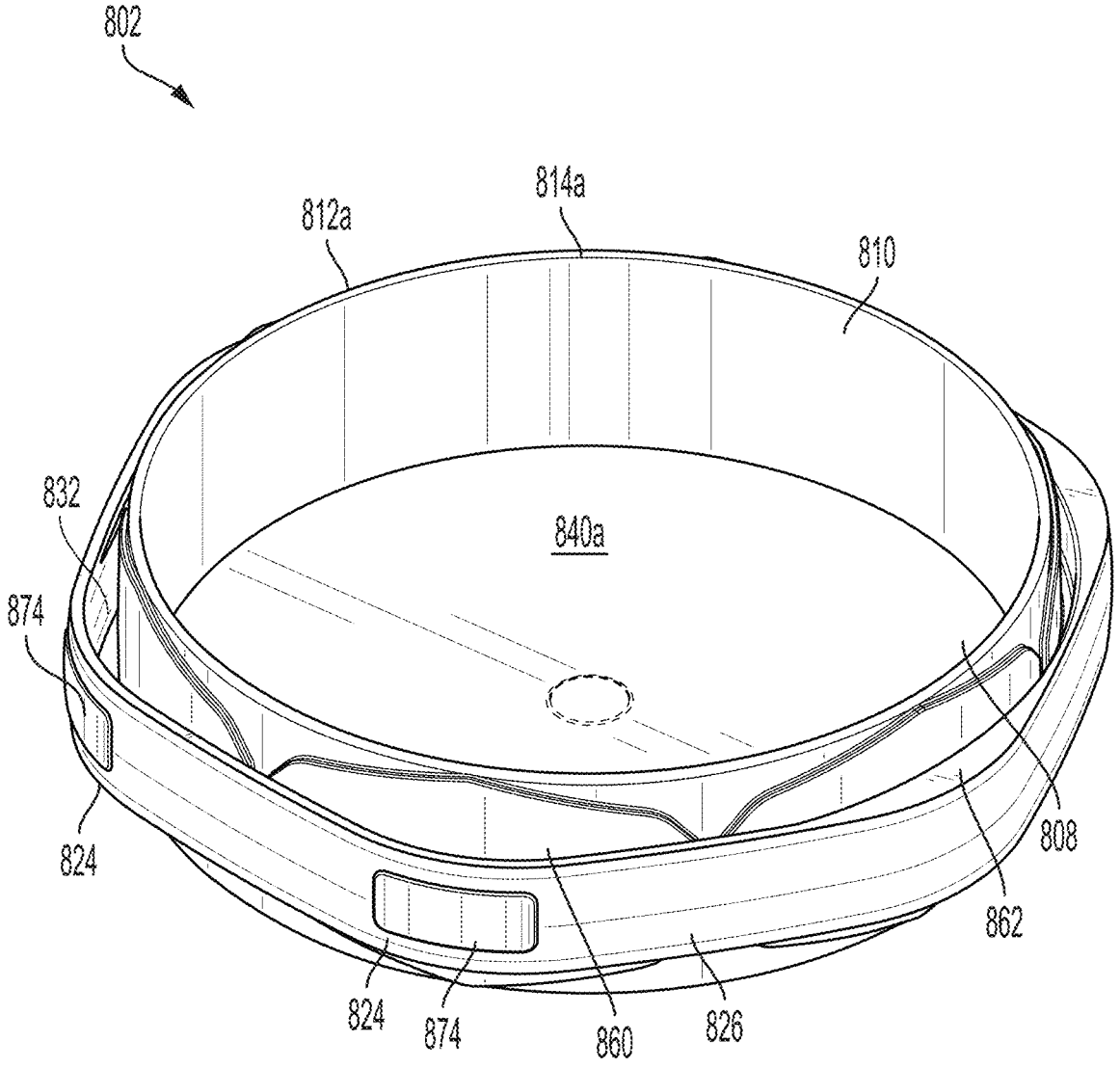
Figure 30:
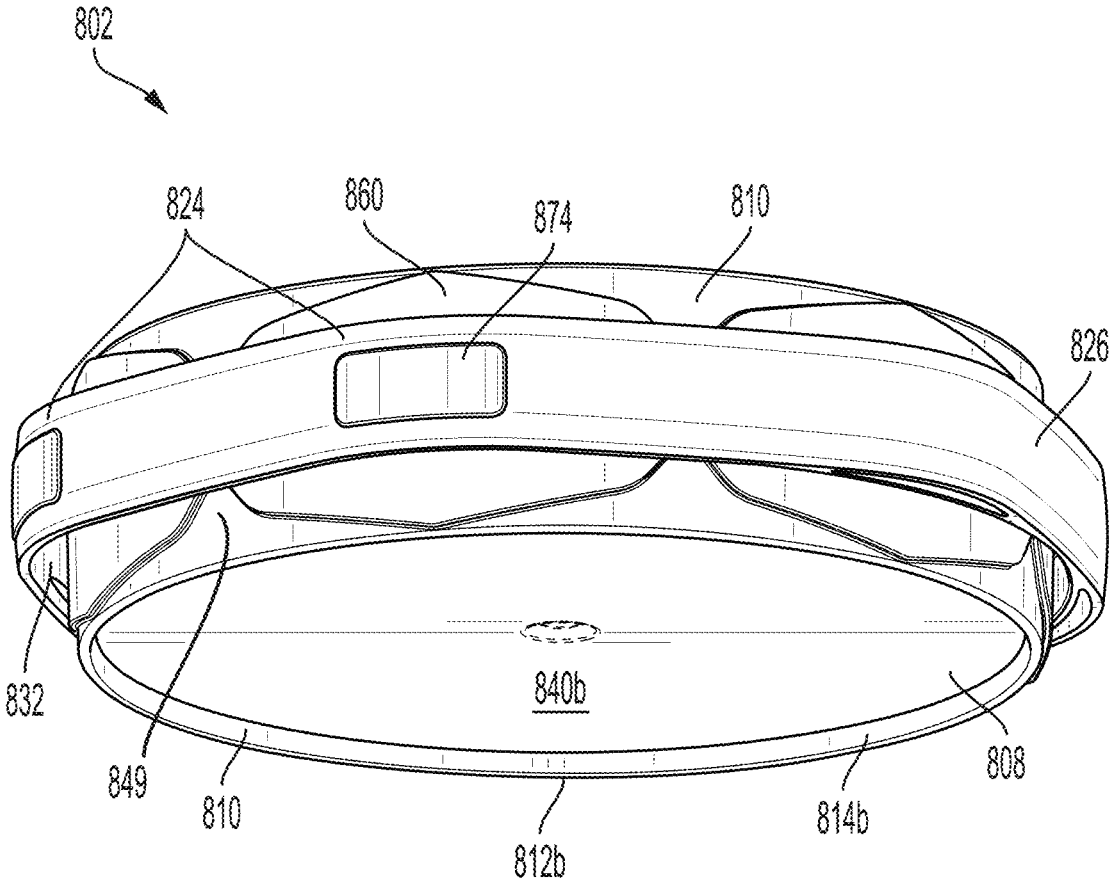
Figure 31:
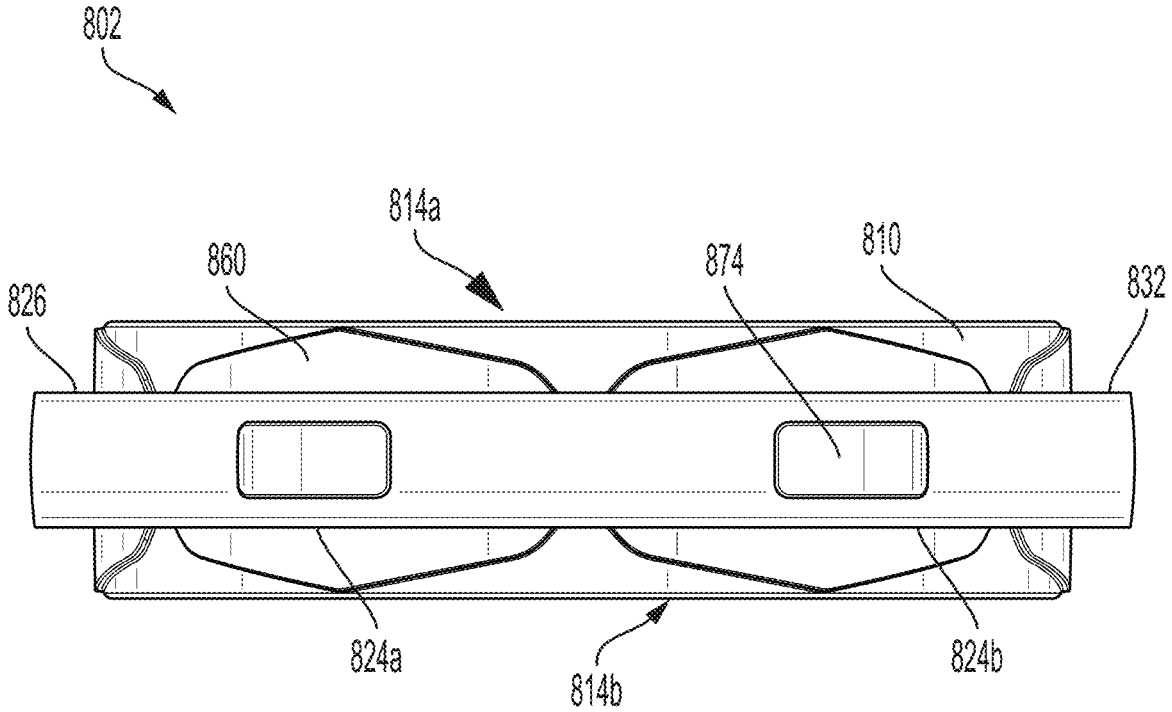
Figure 32:
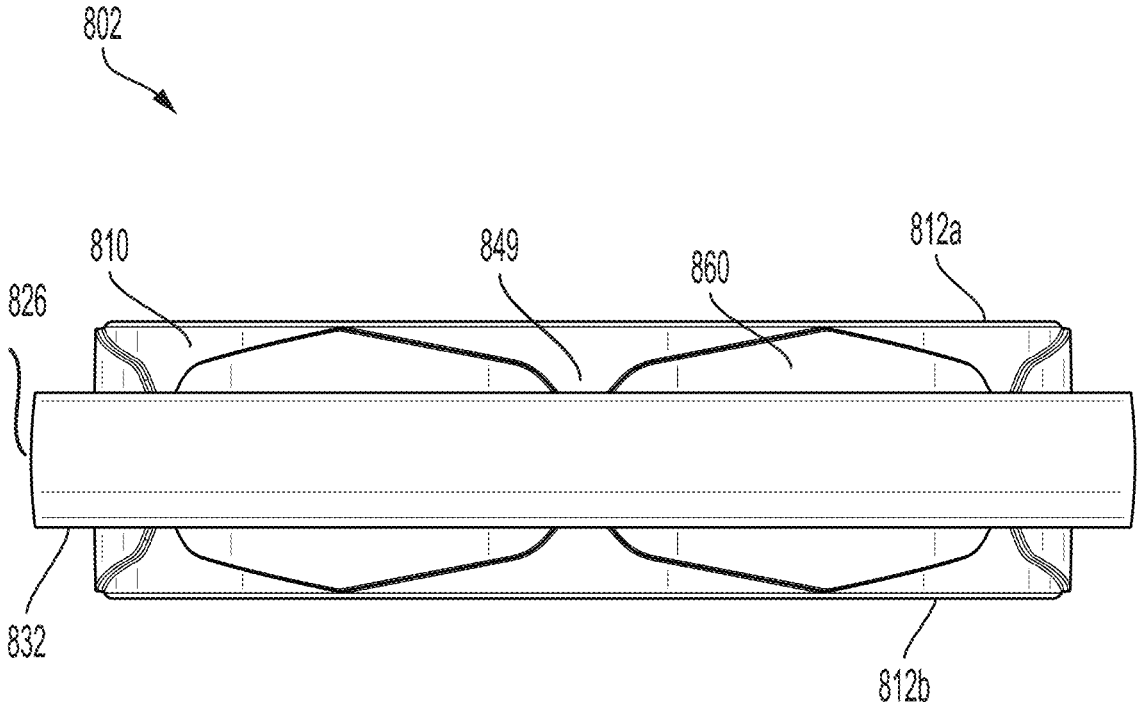
Figure 33:
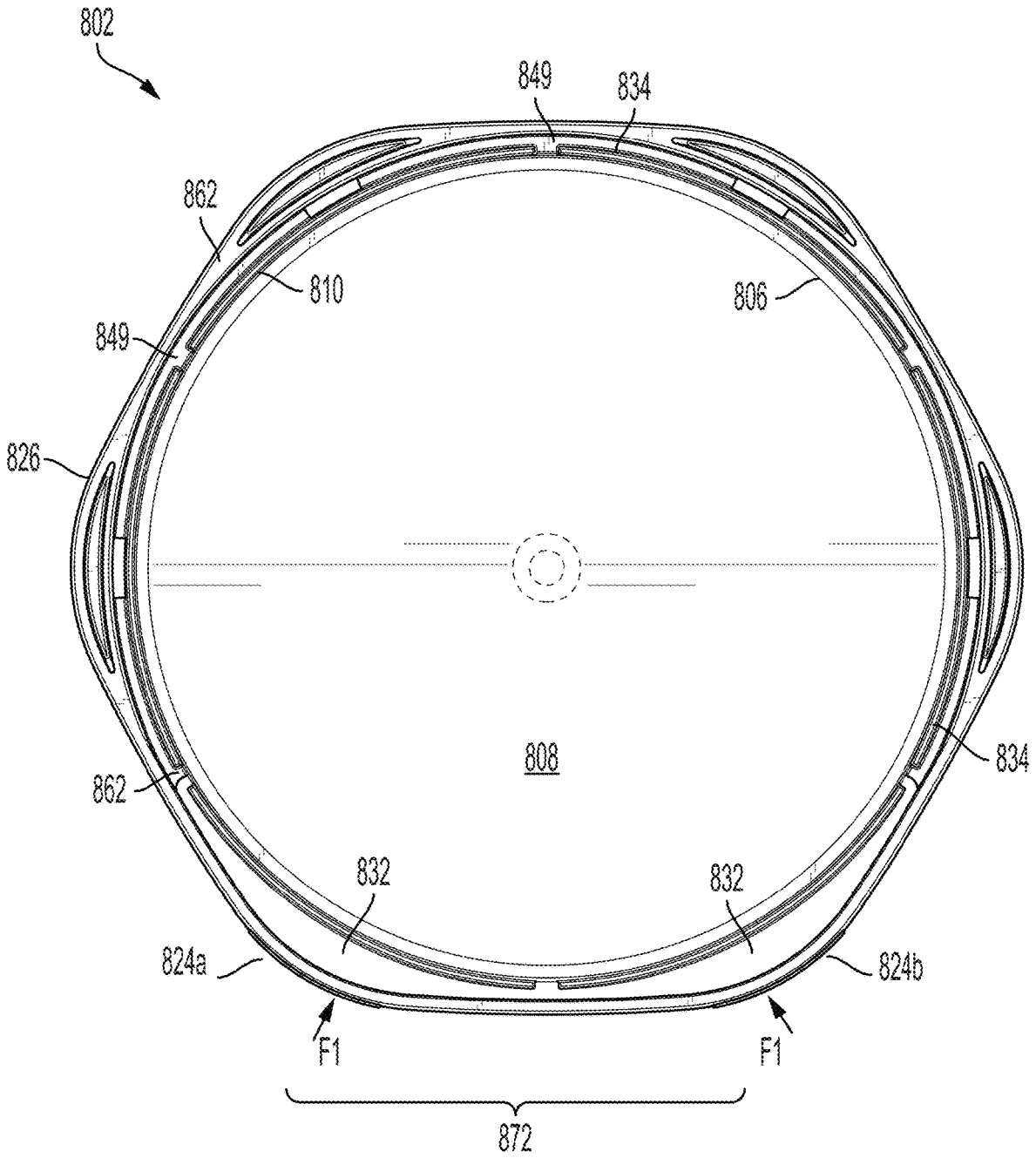

Having thus described aspects of the disclosure in the foregoing general terms, reference will now be made to the accompanying figures, which are not necessarily drawn to scale, and wherein:

FIG. 1A is a schematic perspective view of a container for holding an oral product according to some example implementations of the present disclosure;

FIG. 1B is a schematic exploded perspective view of the container of FIG. 1A according to some example implementations of the present disclosure;

FIG. 2 is a schematic perspective view of a body portion of the container of FIG. 1A according to some example implementations of the present disclosure;

FIGS. 3A-3C are schematic side, top, and bottom views of the body portion of FIG. 2 according to some example implementations;

FIG. 4A is a schematic cross-sectional view of the body portion of FIG. 2 taken at line A-A in FIG. 3B according to some example implementations;

FIG. 4B is a schematic cross-sectional view of the body portion of FIG. 2 taken at line B-B in FIG. 3B according to some example implementations;

FIG. 5 is a schematic perspective view of a cover of the container of FIG. 1A according to some example implementations of the present disclosure;

FIGS. 6A-6C are schematic side, bottom, and top views of the cover of FIG. 5 according to some example implementations;

FIG. 7A is a schematic cross-sectional view of the cover of FIG. 5 taken at line A-A in FIG. 6C according to some example implementations;

FIG. 7B is a schematic cross-sectional view of the cover of FIG. 5 taken at line B-B in FIG. 6C according to some example implementations;

FIG. 8 is a schematic plan view of a tamper-evident feature of the container of FIG. 1A according to some example implementations of the present disclosure;

FIG. 9 is a schematic perspective view of another container for holding an oral product according to some example implementations of the present disclosure;

FIG. 10 is a schematic top view of the container of FIG. 9 according to some example implementations of the present disclosure;

FIG. 11 is a schematic front view of the container of FIG. 9 according to some example implementations of the present disclosure;

FIG. 12 is a schematic exploded front view of the container of FIG. 9 according to some example implementations of the present disclosure;

FIG. 13A is a schematic cross-sectional view of the container of FIG. 9 taken at line A-A in FIG. 10 according to some example implementations;

FIG. 13B is an enlarged portion of the schematic cross-sectional view of FIG. 13A according to some example implementations;

FIG. 14 is a schematic perspective top view of a base portion of the container of FIG. 9 according to some example implementations of the present disclosure;

FIG. 15 is a schematic perspective bottom view of the base portion of the container of FIG. 9 according to some example implementations of the present disclosure;

FIG. 16 is a schematic bottom view of the base portion of the container of FIG. 9 according to some example implementations of the present disclosure;

FIG. 17 is a schematic top view of the base portion of the container of FIG. 9 according to some example implementations of the present disclosure;

FIG. 18A is a schematic perspective view of yet another container for holding an oral product according to some example implementations of the present disclosure;

FIG. 18B is a schematic exploded perspective view of the container of FIG. 18A according to some example implementations of the present disclosure;

FIG. 19 is a schematic cross-sectional view of the container of FIG. 18A taken at line A-A in FIG. 18A according to some example implementations;

FIG. 19A is an enlarged schematic cross-sectional view of an alternative embodiment of the container shown in FIG. 19 according to some example implementations of the present disclosure;

FIG. 20 is a schematic cross-sectional perspective view of the body portion of the container of FIG. 18A taken at line B-B in FIG. 19 according to some example implementations;

FIGS. 21A-21D are schematic top, side, front, and bottom views of the body portion of FIG. 20 according to some example implementations;

FIGS. 22A and 22B are schematic bottom perspective and corresponding cross-sectional views illustrating the container of FIG. 18A in an unactuated state according to some example implementations of the present disclosure;

FIGS. 22C and 22D are schematic bottom perspective and corresponding cross-sectional views illustrating the operation of the container of FIG. 18A in an actuated state according to some example implementations of the present disclosure;

FIG. 23 is a schematic perspective view of still another container for holding an oral product according to some example implementations of the present disclosure;

FIG. 24 is a schematic top view of the container of FIG. 23 according to some example implementations of the present disclosure;

FIG. 25 is a schematic front view of the container of FIG. 23 according to some example implementations of the present disclosure;

FIG. 26 is a schematic side view of the container of FIG. 23 according to some example implementations of the present disclosure;

FIG. 27 is a schematic exploded front view of the container of FIG. 23 according to some example implementations of the present disclosure;

FIG. 28A is a schematic cross-sectional view of the container of FIG. 23 taken at line A-A in FIG. 24 according to some example implementations;

FIG. 28B is an enlarged portion of the schematic cross-sectional view of FIG. 28A according to some example implementations;

FIG. 29 is a schematic perspective top view of a base portion of the container of FIG. 23 according to some example implementations of the present disclosure;

FIG. 30 is a schematic perspective bottom view of the base portion of the container of FIG. 23 according to some example implementations of the present disclosure;

FIG. 31 is a schematic front view of the base portion of the container of FIG. 23 according to some example implementations of the present disclosure;

FIG. 32 is a schematic side view of the base portion of the container of FIG. 23 according to some example implementations of the present disclosure; and FIG. 33 is a schematic top view of the base portion of the container of FIG. 27 according to some example implementations of the present disclosure.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

Unless specified otherwise or clear from context, references to first, second or the like should not be construed to imply a particular order. A feature described as being above another feature (unless specified otherwise or clear from context) may instead be below, and vice versa; and similarly, features described as being to the left of another feature else may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Furthermore, it should be understood that unless otherwise specified, the terms "data," "content," "digital content," "information," and similar terms may be at times used interchangeably. Additionally, where multiples of the same components are described, the multiples may be referred to individually (e.g., ##a, ##b, ##c, etc.) or collectively (##).

Example implementations of the present disclosure are generally directed to containers used to store various solid products, but are particularly well-suited for products designed for oral consumption. Exemplary consumable products that are often packaged in such containers include a wide variety of consumer products, including tobacco products of the type that have a smokeless form. Various forms of suitable smokeless tobacco products are those types products set forth and described generally in U.S. Patent Pub. Nos. 2012/0193265 to Patel et al. and 2013/0206153 to Beeson et al.; which are incorporated by reference herein. Of particular interest, are exemplary tobacco products that include tobacco formulations in a loose form, such as moist snuff products. Other exemplary types of smokeless tobacco products include the types of products set forth in U.S. Patent Pub No. 2012/0024301 to Carroll et al., the disclosure of which is incorporated by reference herein. Exemplary loose form tobacco used with the containers of the present disclosure may include tobacco formulations associated with, for example, commercially available GRIZZLY moist tobacco products and KODIAK moist tobacco products that are marketed by American Snuff Company, LLC. Exemplary snus forms of tobacco products are commercially available as CAMEL Snus by R. J. Reynolds Tobacco Company.

The shape of the outer surface of the containers of the disclosure can vary. Although the container embodiments illustrated in the drawings have certain contours and shapes, containers with other exterior and interior surface designs also can be suitably adapted and used. For example, the sides or edges of the containers of the disclosure can be flattened, rounded, chamfered, or beveled, and the various surfaces or edges of the container exterior can be concave or convex. Further, the opposing sides, ends, or edges of the container can be parallel or non-parallel such that the container becomes narrower in one or more dimensions. See, for example, the types of containers, components, component arrangements and configurations, and constructions thereof set forth in U.S. Pat. No. 8,458,996 to Bried et al., U.S. Pat. No. 8,910,781 to Pipes et al., and D649,284 to Patel et al.; U.S. Patent Pub. Nos. 2010/0018883, 2023/0013978, and 2022/0104543, all to Patel et al; U.S. application Ser. No. 29/794,622, filed Jun. 14, 1921 to Bailey et al.; U.S. application Ser. No. 29/794,626, filed Jun. 14, 1921 to Bailey et al.; U.S. application Ser. No. 29/801,745, filed Jul. 30, 1921 to Horton et al.; U.S. application Ser. No. 29/806,411, filed Sep. 2, 1921 to Bailey et al.; as well as the various types of containers referenced in U.S. Patent Pub. No. 2013/0206153 to Beeson et al.; each of which is incorporated by reference herein.

The shapes and sizes of the containers described herein can vary without departing from the disclosure. In certain embodiments, the containers can be described as having a cylindrical shape suitable for handheld manipulation and operation; however, other multi-sided shapes (e.g., rectangular, hexagonal, pentagonal, octagonal, oblong, etc.) are contemplated and considered within the scope of the disclosure. Exemplary dimensions for such handheld generally cylindrical embodiments include diameters in the range of about 50 mm to about 100 mm, and more typically about 60 mm to about 80 mm. Exemplary wall thicknesses include the range of about 0.5 mm to about 1.5 mm, and more typically about 0.8 mm to about 1.4 mm. Exemplary depths for handheld container embodiments of the present disclosure range from about 5 mm to about 50 mm, more typically about 8 mm to about 30 mm, and most often about 15 mm to about 25 mm. An exemplary general outward appearance of the container is comparable in many regards to that which has been used for commercially available GRIZZLY and KODIAK products that are marketed by American Snuff Company, LLC.

Further, the size of the containers described herein may be changed. For example, the containers may be sized for promotional purposes by providing either increased or decreased dimensions. For example, the dimensions of the containers may be scaled upwardly or downwardly by certain multipliers. By way of further example, the dimensions of the container may be scaled upwardly or downwardly by a multiple of about 1 to about 10 times. In this regard, whereas a conventional container according to embodiments of the present disclosure may be configured to store about 1.2 ounces of an oral product, an oversized container may be configured to store, for example, 2.4 ounces or 7.2 ounces of the tobacco containing material. In specialty markets the containers may define a larger cylindrical configuration having a diameter from about 100 mm to about 125 mm (e.g., about 114 mm) and a depth from about 30 mm to about 50 mm (e.g., about 38 mm). Accordingly, the dimensions and capacities disclosed herein are provided for example purposes only and may be modified to suit particular purposes.

FIGS. 1-8 depict one implementation of a container 1000 in accordance with one or more embodiments of the disclosure, with FIGS. 2-4B depicting the base or body portion 1002 in greater detail, FIGS. 5-7B depicting the cover 1004 in greater detail, and FIG. 8 depicting the tamper evident feature in greater detail. As shown in FIG. 1B, the container 1000 includes the base or body portion 1002 defining an internal space 1040 accessible via an opening and the cover or lid portion 1004 configured to be securely, but removably, coupled to the body portion 1002 so as to enclose the internal space 1040. In some embodiments, the cover or lid portion 1004 sealingly engages with the body portion 1002 so as to enclose the internal space 1040 in a manner that helps alleviate moisture loss to any oral products housed inside the container 1000. The sealed engagement may be via, for example, the inclusion of a seal arrangement or sealing member (e.g., an O-ring) 1084 disposed within the lid portion 1004 that abuts an upper edge or rim of a sidewall of the body portion 1002 (see, e.g., item 884 in FIG. 28A). However, in some embodiments, the sealing engagement may be affected by the manner in which the lid portion and body portion engage (e.g., an interference fit or the coupling of complimentary structures), with or without an additional seal arrangement.

As shown in FIG. 1A, the cover 1004 and body portion 1002 generally abut one another when engaged and their respective outer surfaces are substantially flush with one another, which makes it difficult to separate the parts from their engaged or sealed position. In some implementations, the cover 1004 is secured to the body portion 1002 via a snap or interference fit, which provides additional resistance to separating the parts. The container also includes one or more labels 1086*a*, 1086*b* (collectively 1086) attached to the base 1002, the lid 1004, or both. In some implementations, the label 1086 acts as a tamper-evident feature as described in greater detail below.

As shown in FIGS. 2-4B, the body portion 1002 defines the internal space 1040, which is accessible via an opening 1014. The internal space 1040 may be configured to hold a fresh product, such as chewing tobacco, snus, or additional oral products such as active pouches, pastilles, lozenges, melts, chews, gums, and the like. In some implementations, the body portion may comprise a transparent or translucent material that allows a user to detect a level of freshness, or other condition, of the product contained therein without the need for opening the container, which may negatively impact the freshness of the product depending on the frequency of opening. The body portion 1002 of the container 1000 includes a bottom wall 1008 and sidewall assembly comprising a primary wall 1010 extending along a peripheral edge 1006 of the bottom wall 1008 and extending upwardly (defining the internal space 1040). The primary wall 1010 has an inner surface 1010*a*, an outer surface 1010*b*, and an upper rim 1012 defining the opening 1014. The sidewall assembly also includes a secondary wall 1026 coupled to (or extending from) the outer surface of the primary wall 1010 and spaced outwardly therefrom to define an open channel 1032 between the primary and secondary walls 1010, 1026 such that one or more portions of the secondary wall may flex relative to the primary wall upon application of a force thereto. The secondary wall 1026 at least partially surrounds the outer surface of the primary wall 1010 with the open channel 1032 extending along a perimeter of the body portion, wherein the secondary wall 1026 comprises an upper edge 1028*a* and a lower edge 1028*b* and the secondary wall is coupled to the primary wall 1010 along at least a portion of the lower edge.

The bottom wall 1008 is shown having a circular shape; however, the shape of the bottom wall 1008 may vary to suit a particular application (e.g., type of product held by the container, aesthetic purposes, etc.). Similarly, the sidewall 1010 depicted in the figures is a single, contiguous circular wall; however, the wall 1010 may comprise multiple wall portions or linear segments as would be necessary, for example, if the container 1000 had a non-cylindrical shape (e.g., rectangular, hexagonal, pentagonal, octagonal, etc.). The sidewall 1010 extends around the entire perimeter of the body portion 1002. In certain implementations, the outer surface of the sidewall 1010 includes a plurality of raised structures 1060 disposed thereon that make up at least a first portion of an alignment mechanism for interfacing the cover 1004 with the body portion 1002 as described in greater detail below. In some implementations, the structures 1060 may be configured to also add strength to the sidewall 1010, for aesthetic purposes, and/or other functions. As shown, the secondary wall 1026 defines a generally hexagonal prismatic shape (see FIG. 1A or 3B); however, the shapes of the primary and secondary walls may vary to suit a particular application and may comprise any combination of linear and arcuate segments (e.g., a polyhedral, an irregular polygon, or a D-shape).

As shown in FIG. 5, the cover 1004 defines an internal space 1041, which generally corresponds to the internal space 1040 of the body portion 1002. The cover comprises a top wall 1016 and a primary sidewall 1018 extending downwardly from a peripheral edge 1020 of the top wall 1016 and having an inner surface 1018*a*, an outer surface 1018*b*, a bottom edge 1029, and a second portion of the alignment mechanism 1048 disposed on the inner surface 1018*a* of the primary sidewall 1018. The second portion of the second alignment mechanism 1048 is configured to engage with the first alignment mechanism 1060 as described in greater detail below. In some cases, the second alignment mechanism 1048 provides additional stiffening to the cover. Additionally, the primary sidewall 1018 of the cover 1004 circumscribes the primary wall 1010 of the body portion 1002 when the cover engages the body portion (see, for example, wall 918 and wall 910 of FIG. 13B).

The number and orientation of the first portion of the alignment mechanism/structures 1060 will be selected to suit a particular application. For example, in the depicted implementation, six (6) structures 1060 are disposed equidistant about the outer surface 1010*b* and spaced apart to define a plurality of grooves 1049 therebetween that are configured to mate with vertical, rib-like structures that make up the second portion of the alignment mechanism 1048. Alternatively, the first and second portions of the alignment mechanism may comprise a variety of other corresponding shapes that align the cover 1004 and body portion 1002 into a particular orientation when engaged and prevent rotational movement between the cover and body portion. As depicted in FIGS. 2 and 3A, each of the raised structures 1060 comprises an upper edge angled downwardly towards the defined grooves 1049 and configured to guide the ribs 1048 into their respective grooves. Specifically, the upper edge of each structure 1060 includes divergent, downward sloping edges 1061*a*, 1061*b* configured, so that when contacted by the ribs/second portions of the alignment mechanism 1049, guide or otherwise cam the second portions 1048 into engagement with the first portions 1049, 1060. However, other upper edge shapes and arrangements are contemplated and considered within the scope of the invention, such as, for example, curved or stepped.

Referring back to FIGS. 3B and 4B, the body portion 1002 further comprises one or more first portions of a retention mechanism 1034*a* disposed along an inner surface of the secondary sidewall 1026. In the depicted implementation, a plurality of first portions of a retention mechanism 1034*a* are spaced equidistant about the inner surface of the secondary wall 1026 and configured to mate with corresponding second portions of the retention mechanism 1034*b*. In some implementations, the first portions 1034*a* comprise recesses formed in the inner surface of the secondary wall, where the recesses are sized and shaped to receive mating protuberances disposed on the outer surface 1018*b* of the primary sidewall 1018 of the cover as described below.

FIG. 4A is a cross-sectional view of the body portion 1002 rotated 90 degrees from the view of FIG. 4B and further illustrates the relationship between the primary wall 1010 and the secondary wall 1026, specifically that the walls 1010, 1026 define the channel 1032 therebetween. The channel 1032 is configured to at least partially receive the primary sidewall 1018 of the cover 1004.

Referring back to FIG. 5 and FIGS. 6A-7B, the cover 1004 is described in greater detail. Specifically, FIGS. 7A and 7B depict cross-sectional views of the cover 1004 with the view of FIG. 7B rotated 90 degrees from the view of FIG. 7A. As shown, the cover 1004 includes the top wall 1016, the primary sidewall 1018 extending downwardly from a peripheral edge 1020 of the top wall 1016, and an inner sidewall 1042 extending downwardly from the top wall and spaced inwardly from the primary sidewall 1018 so as to define a receptacle 1044 therebetween that is configured to sealingly engage at least a portion of the primary wall 1010 of the body portion 1002. The length of the inner sidewall 1042 may vary to suit a particular application, e.g., increased depth of receptacle, increased surface engagement between an outer surface of the inner sidewall 1042 and an inner surface of the primary wall 1010. Disposed within the receptacle 1044 is a seal arrangement 1084 configured to engage the top rim 1012 of the primary wall 1010 of the body portion 1002 (see FIGS. 2, 3A, and 4A) when the cover 1004 is engaged therewith. The seal arrangement 1084 may be held within the cover via, for example, an interference fit or an adhesive.

In some embodiments, the seal arrangement 1084 is an O-ring or a generally flat gasket that fully engages the generally planar surface of the upper rim 1012. In other embodiments, a face of the seal arrangement may have a concave or convex surface and/or define a geometric shape that is configured to engage with the upper rim 1012 of the body portion 1002 (e.g., a U-shape that may partially receive a portion of the sidewall 1010). Additionally, the seal arrangement 1084 may be compressible (e.g., as a function of material and/or having a hollow core) and may comprise rubber, neoprene, nitrile, silicone, polyethylene film, a foil, or the like.

In some implementations the seal arrangement 1084 is configured with certain moisture and/or air barrier properties. For example, the seal arrangement 1084 may provide a barrier that selectively or non-selectively inhibits the passage of compositions such as moisture and oxygen therethrough, e.g., inhibiting ingress of moisture while allowing for egress of gas. In other implementations, the seal arrangement 1084 may provide a "total" seal that does not allow the ingress or egress of any substance.

Generally, the seal arrangement 1084 will designed to suit a particular application, such as, for example, minimizing moisture loss from the container and/or affecting fit between the lid and the body portion. For example, Applicant subjected various sized and shaped containers to testing to characterize moisture loss therefrom. The testing methodology included placing 1.5 grams (g) of water into a container creating 100% relative humidity (RH) within the containers. The containers are then placed in a conditioned environmental chamber at 25° C. and 60% RH, with weight loss from the containers monitored over time. The weight loss is attributed to moisture transmission lost through the seal of the container. Results are converted into the Moisture Vapor Transmission Rate (MVTR) industry standard of 38° C. at 90% RH. Generally, containers embodying the features disclosed herein experienced an improvement (i.e., reduction) in moisture loss of about 5% to about 10% over conventional containers without the seal arrangement 1084, which is beneficial in maintaining product integrity and stability/shelf life of oral products.

In the depicted implementation, the cover 1004 further comprises an outer sidewall 1068 extending outwardly from the peripheral edge 1020 of the top wall 1016 and configured to sit substantially flush with an outer surface of the secondary wall 1026 of the body portion 1002 when engaged. The primary sidewall 1018 of the cover 1004 defines a generally cylindrical shape and the outer sidewall 1068 of the cover defines a generally prismatic shape corresponding to the generally prismatic shape of the secondary wall of the body portion. The outer sidewall 1068 terminates at a lower edge 1038 that abuts, or is at least disposed proximate, the upper edge 1028*a* of the secondary wall 1026 when engaged. The outer sidewall 1068 and the primary sidewall 1018 define a plurality of gaps 1070 spaced equidistant about a perimeter of the cover; however, in some cases, the number of gaps and their specific location will vary based, in part, on the relative shapes of the primary sidewall 1018 and the secondary sidewall 1068. In the depicted implementation, the container 1000 has an overall hexagonal shape and the gaps 1070 correspond to the corners of the hexagonal shape. In some implementations, at least a portion of the plurality of gaps 1070 may be allow the outer sidewall 1068 to be flexed inwardly to assist with handling or removing the cover 1004.

The cover 1004 is configured to engage the body portion 1002 via an interference fit or a snap fit. For example, the outer surface 1018*b* of the primary sidewall 1018 comprises one or more second portions 1034*b* of the retention mechanisms that are configured to engage with the first portions of the retention mechanisms 1034*a*. As shown, the second portion of the retention mechanism 1034*b* comprises a plurality of protuberances equally spaced about the outer surface of the primary sidewall 1018. In the depicted implementation, the retention mechanisms 1034*a*, 1034*b* (collectively 1034) comprise six (6) pairs of mating portions that oriented to align with the alignment mechanisms 1048, 1049; however, the number and placement of retention mechanisms and alignment mechanisms with be selected to suit a particular application.

Referring back to FIG. 1A, the base portion 1002 includes a cut-out or recess 1022 in the primary wall 1010 that provides access to the lower edge 1038 of the cover sidewall 1018 to assist in removing or otherwise disengaging the cover 1004 from the body portion 1002, for example, by applying an upward force (F) to the lower edge 1038 of the cover (e.g., with a user's thumb or finger nail). In the depicted implementation, the base includes two (2) recesses 1022 oriented about 180 degrees apart. Alternatively, or additionally, the secondary wall 1026 is coupled to the outer surface of the primary wall 1010 such that one or more portions of the secondary wall flex relative to the primary wall upon application of a force thereto. Generally, the channel 1032 allows the secondary wall 1026 to be flexed inwardly (i.e., pressed towards the primary wall 1010) upon application of a force to certain portions thereof, thereby providing access to the edge 1038 of the cover 1004 to assist in removing the cover 1004. The amount of force required may vary to suit a particular application and may depend on, for example, the wall thicknesses, materials of construction, and/or the size of the channel 1032 or channel openings. The container 1000 may be configured to meet any minimum force required for a particular application (e.g., making the container child-resistant), such as, for example, materials of construction and number of and location of certain structural features. The secondary wall 1026 returns to an unflexed position after removal of the force.

FIG. 8 depicts a label 1086 configured with a tamper evident feature. The label/tamper evident feature comprises a substrate 1088 with at least two tabs 1090*a*, 1090*b* (collectively 1090) that extend outwardly from the substrate 1088. In the depicted implementation, two tabs 1090 are shown spaced about 180 degrees apart; however, any number and orientation of tabs 1090 may be included to suit a particular application. The substrate 1088 has a shape that generally corresponds to the shape of the container and includes a pressure sensitive adhesive 1094 disposed on a bottom surface thereof to enable attaching the label 1086 to the top surface of the cover, the bottom surface of the body portion, or both (e.g., when two labels are provided).

Referring also to FIG. 1A, with the label 1086 attached to the container 1000, the tabs 1090 extend over the outer sidewall 1068 of the cover 1004 and the secondary wall 1026 of the body portion 1002, thereby spanning an interface between the body portion and the cover (e.g., where the lower edge 1038 of the outer wall 1068 of the cover proximately abuts the upper edge 1028 of the secondary wall 1026 of the body portion). The pressure sensitive adhesive 1094 is also disposed on the bottom surfaces of the tabs 1090 so as to attach the tabs to the outer walls 1026, 1068. The tabs 1090 also include lines of perforations 1092*a*, 1092*b* (collectively 1092) that are generally oriented proximate the interface between the body portion 1002 and the cover 1004. The perforations 1092 are configured to separate or otherwise tear, splitting the tabs 1090, when the cover is at least partially disengaged from the body portion, thereby providing evidence that the container has been opened or otherwise tampered with. The labels 1086 may be made from paper, a film, vinyl or a lamination of materials and may include indicia printed or otherwise deposited thereon including, for example, a logo, product information, or similar.

FIGS. 9-17 depict another example implementation of a container 900 in accordance with one or more embodiments of the disclosure and similar to container 1000 described above, except with a child-resistant feature incorporated therein. The cover 904 is essentially identical to the cover 1004 described above and will not be described again. Specifically, the container 900 is similar to the other containers described above and includes a base or body portion 902 defining an internal space 940 accessible via an opening 914. The internal space 940 may be configured to hold a fresh product, such as chewing tobacco, snus, or oral products.

The container 900 includes a cover 904 configured to be securely, but removably, coupled to the body portion 902 so as to enclose the internal space 940. As shown in FIGS. 9 and 11, the cover 904 and body portion 902 generally abut one another when engaged and their respective outer surfaces are substantially flush with one another, which makes it difficult to separate the parts. In some implementations, the cover 904 is secured to the body portion 902 via a snap or interference fit, which provides additional resistance to separating the parts. The engagement of the cover 904 and body portion 902 are described in greater detail below.

As shown in the figures, the body portion 902 of the container 900 includes a bottom wall 908, a primary wall 910 disposed about a peripheral edge 906 of the bottom wall 908 and extending upwardly (defining the internal space 940), and a secondary wall 926 comprising an upper edge 921*a*. The secondary wall 926 is coupled to an outer surface of the primary wall 910 and spaced outwardly therefrom to define a channel 932 between the primary and secondary walls 910, 926 such that one or more portions 924 of the secondary wall flexes relative to the primary wall 910 upon application of a force thereto. As further shown in the figures, the container 900 includes the cover 904 configured to securely and removably engage the opening 914 of the body portion 902, where the cover is removable by flexing one of the one or more portions of the secondary wall 926 inwardly to expose an edge 938 of the cover 904.

Referring to FIGS. 10-17, the structure and operation of the body portion 902 is described in greater detail. The bottom wall 908 is shown having a circular shape; however, the shape of the bottom wall 908 may vary to suit a particular application (e.g., type of product held by the container, aesthetic purposes, etc.). Similarly, the primary wall 910 depicted in the figures is a single, contiguous circular wall; however, the primary wall 910 may comprise multiple wall portions or linear segments as would be necessary, for example, if the container 900 had a non-cylindrical shape (e.g., rectangular, hexagonal, octagonal, etc.). The primary wall 910 extends around the entire perimeter of the body portion 902 and has an inner surface and an outer surface. In certain implementations, the outer surface of the primary wall 910 includes a plurality of raised structures 960 disposed thereon to form the alignment mechanism as described above, i.e., the structures 960 are disposed equidistant about the outer surface and spaced apart to define a plurality of grooves 949 about the outer surface of the primary wall 910 that are configured to mate with rib-like structures 948 within the cover 904. As shown, the primary wall 910 of the body portion 902 defines a generally cylindrical shape and the secondary wall 926 defines a generally hexagonal prismatic shape (see FIGS. 14 and 17); however, the shapes of the primary and secondary walls may vary to suit a particular application.

In the depicted implementation, the secondary wall 926 surrounds the primary wall 910 and has an upper edge 928*a* that is recessed relative to the top edge 912 of the primary wall 910. The secondary wall 926 is coupled to the outer surface of the primary wall 910 via one or more lateral extensions 962 and spaced outwardly therefrom and so as to define a channel 932 between the primary and secondary walls such that one or more portions (or flex features) 924 of the secondary wall flex relative to the primary wall upon application of a force thereto. In the depicted implementation, the lateral extension 962 extends from the peripheral edge 906 of the bottom wall 908; however, in some implementations, the secondary wall 926 extends directly from the bottom wall 908 and may be formed as a single piece therewith.

Generally, the channel 932 allows the secondary wall 926 to be flexed inwardly (i.e., pressed towards the primary wall 910) upon application of a force to certain portions thereof (i.e., flex features 924 described below), thereby providing access to an edge 938 of the cover 904 to assist in removing the cover 904. See FIGS. 13A and 13B for additional details regarding the removal of the cover 904. The amount of force required may vary to suit a particular application and may depend on, for example, the wall thicknesses, materials of construction, and/or the size of the channel 932 or channel openings. The container 900 may be configured to meet any minimum force required to make the container child-resistant, such as, for example, materials of construction and number of and location of certain structural features.

As disclosed above, the secondary wall 926 includes at least one flex feature 924 that assists in separating the cover 904 from the body portion 902, but provides sufficient resistance to prevent the covers 904 and body portion 902 from being separated by a child. The flex feature 924 may be formed in the secondary wall 926 in different manners. In the depicted implementation, the container 900 includes two (2) flex features 924 disposed proximate one another and on one side of the container 900 (see FIGS. 10-12). Although two flex features are described, it is possible for the container 900 to include any number of additional flex features 924 to suit a particular application (e.g., the size and/or shape of the container) and the flex features may be spaced equidistant about the body portion, specifically the secondary wall 926.

FIGS. 12-15 depict the lateral extensions 962 and flex features 924 in greater detail. As shown, the lateral extension 962 generally extends horizontally outward from the primary wall 910/peripheral edge 906 of the bottom wall 908 and couples to the secondary wall 926. The lateral extension 962 is generally shown as extending about a substantial portion of the perimeter of the body portion 902; however, in some implementations, the lateral extension comprises a plurality of non-contiguous segments that define one or more gaps 976 where the secondary wall 826 is not directly coupled to the primary wall 910. As shown in FIG. 17, there is a portion 972 of the container 900 where the secondary wall 926 is not attached to the primary wall 910 of the body portion 902 (i.e., that portion of the secondary wall 926 "floats" relative to the primary wall 910). This arrangement provides for two floating corners of the secondary wall that form first and second flex features 924*a*, 924*b*. The flex features 924*a* of the secondary wall 926 include a tactile feature 974, such as, for example, a protuberance or other minimally raised structure that a user can feel when gripping the container 900. The feature 974 provides a press point for actuating the flex feature 924 (application of a force thereto) which will deflect the flex feature section of the secondary wall 926 towards the primary wall 910, thereby exposing the edge 938 of the cover 904. FIGS. 15 and 16 depict bottom views of the body portion 902 so as to illustrate the gaps 976 formed by the absence of the lateral extension 962 and/or removal of a portion of the secondary wall 926 extending from the peripheral edge 906 of the bottom wall 908.

Referring to FIG. 13A, the engagement between the body portion 902 and cover 904 is more clearly depicted. As shown and previously described, the body portion 902 includes a bottom wall 908 and a primary wall 910 extending upwardly therefrom to define the internal space 940. The body portion 902 includes a secondary wall 926 that defines one or more flex features 924. The cover 904 includes a top wall 916 and primary, inner, and outer sidewalls 918, 942, 968 extending downwardly therefrom and configured to engage the opening 914 of the internal space. In the depicted implementation, the primary wall 910 and primary sidewall 918 include mating structure 934 (e.g., retention mechanisms 1034*a*, 1034*b* as described above) to enable a snap fit between the cover 904 and the body portion 902. The bottom edge 938 of the cover 904 approximately abuts a top edge of or recess in the body portion primary wall 910 and, in some embodiments, the outer surface of the cover 904 sits flush with or slightly inward of the outer surface of the secondary wall 926 to make it difficult to engage with and remove the cover 904 from the body portion 902.

FIG. 13A illustrates operation of one of the flex features 924 for removing the cover 904 (feature 924*a*), with the enlarged view depicting the container rotated approximately 90 degrees to depict engagement between the walls at a location without a flex feature 924. Specifically, the enlarged view (FIG. 13B) depicts the primary sidewall 918 of the cover 904 disposed within the channel 932 defined by the primary wall 910 and the secondary wall 926 of the body portion 902 and retained therein via the retention mechanisms 934. In addition, the primary sidewall 918 and the inner sidewall 942 may define a receptacle 944 with a seal arrangement 984 disposed therein as described above with respect to container 1000.

To remove the cover 904, a user applies a force (F1) to an outer surface of the secondary wall 926 (i.e., presses the secondary wall 926) at one or more flex features 924, thereby exposing the edge 938 of the cover, as shown in FIG. 13A. This allows the user to apply a force (F2) to the edge 938 (e.g., via the use of a tool or finger nail) sufficient to overcome the holding force of the interference or snap fit, thereby separating the cover 904 from the body portion 902. In some implementations, the user may press both flex features 924 simultaneously to be able to apply the removing force F2 to two locations on the cover edge 938. Once the user releases (i.e., removes the applied force) the flex feature(s) 924 and the body portion 902 returns to its neutral/normal or unflexed configuration. The cover 904 can be reattached to the body portion 902 by pushing the cover back onto the body portion with sufficient force to reengage the interference or snap fit, which should be evident once the cover and body portion are back in an abutting configuration as described above.

FIGS. 18A, 18B, and 19, depict another implementation of a container 100 in accordance with one or more embodiments of the disclosure, with FIGS. 21A-21D depicting the base portion 102 in greater detail. The container 100 includes a base or body portion 102 that is typically configured to hold the consumer product and a lid or cover 104 configured to be securely, but removably, coupled to the body portion 102. As shown in FIG. 18A, the cover 104 and body portion 102 abut one another when engaged and their respective outer surfaces are substantially flush with one another, which makes it difficult to separate the two parts. In some implementations, the cover 104 is secured to the body portion 102 via a snap or interference fit, which provides additional resistance to separating the two parts. The engagement of the cover 104 and body portion 102 are shown in greater detail and described with respect to FIG. 19 below. The body portion 102 includes a bottom wall 108 and a sidewall 110 extending upwardly from, and about, a peripheral edge 106 of the bottom wall 108. The sidewall 110 has a top edge or upper rim 112 that in turn defines an opening 114 through which the contents of the container 100 may be accessed.

The cover 104 includes a top wall 116 (or 116*a* depending on configuration) and a sidewall 118 that extends downwardly, and about, a peripheral edge 120 of the top wall 116. In some implementations, the top wall 116 spans the entire area bounded by its peripheral edge 120, while in other configurations, the top wall 116 does not span the entire area and forms a frame for accepting an outer lid 116*a* secured thereto, as shown in FIG. 18B. In some implementations, the cover 104 includes a recess 122 or similar structure that may, for example, assist a user in handling the container 100 and/or manipulating the cover 104. For example, the recess 122 may allow a user to pry open the outer lid 116*a* (e.g., by using a tool or finger nail) to access a secondary space 150 between the top wall 116 and outer lid 116*a*. The secondary space 150 may be used to hold or store waste or spent materials.

FIGS. 20 and 21A-21D depict the body portion 102 in greater detail. The bottom wall 108 and sidewall 110 define an internal space 140, which may be accessible via the opening 114 when the cover 104 is removed therefrom. The internal space 140 of the body portion 102 may be configured to receive a consumer product, such as, for example, oral products made or derived from tobacco, incorporating tobacco, or tobacco-free. While the sidewall 110 depicted in the figures is a single, contiguous circular wall, the wall 110 may comprise multiple wall portions or linear segments as would be necessary, for example, if the container 100 had a non-cylindrical shape (e.g., rectangular, hexagonal, octagonal, etc.). The sidewall 110 includes at least one flex feature 124 that assists in separating the cover 104 and body portion 102, but provides sufficient resistance to the cover 104 and body portion 102 being separated by a child.

Figure 21A:
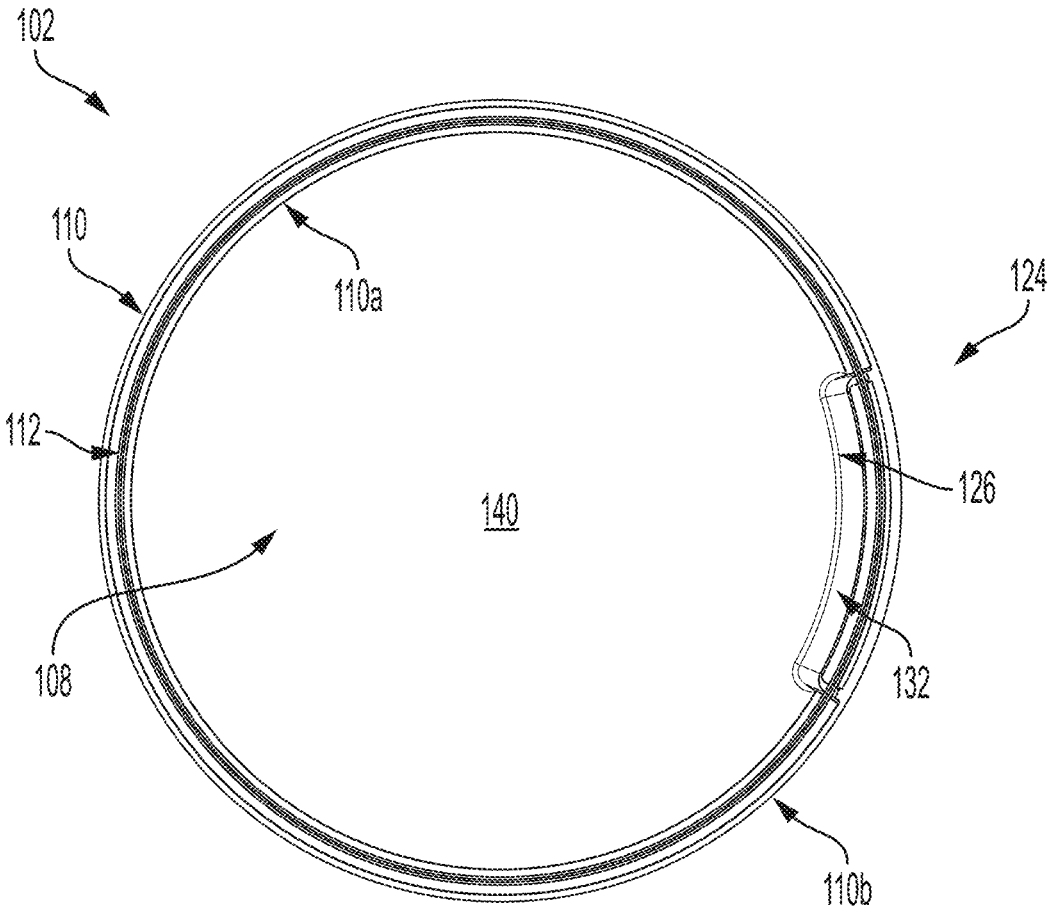
Figure 21B:
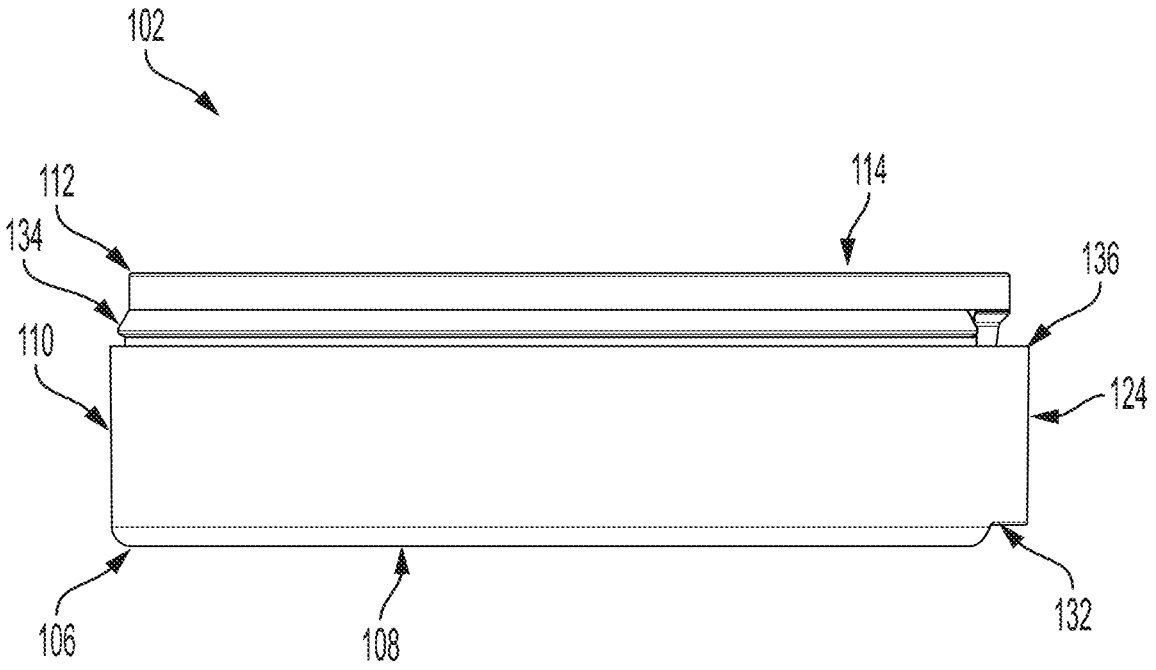
Figure 21C:
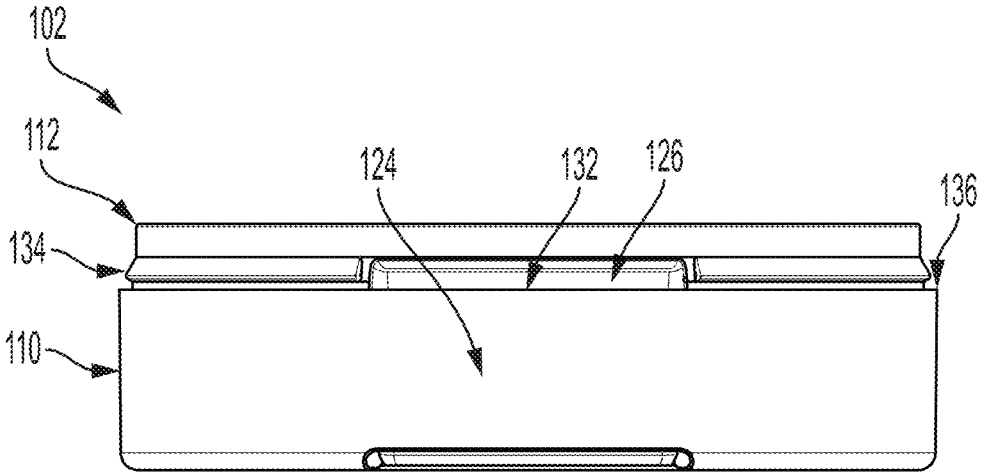
Figure 21D:
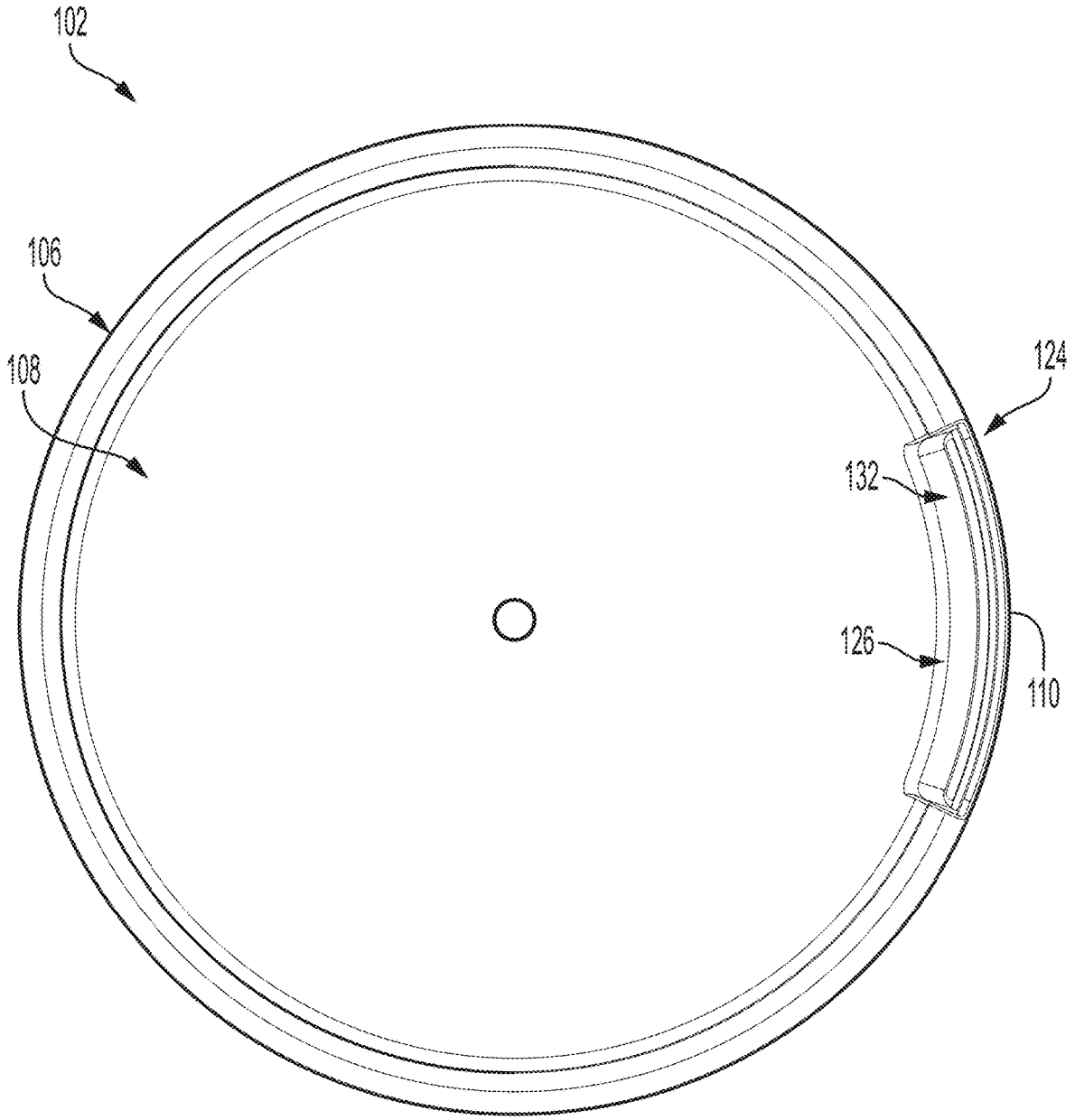

As shown in FIGS. 20 and 21A, the sidewall 110 extends around the entire perimeter of the body portion 102 and has an inner surface 110*a* and an outer surface 110*b*. The flex feature 124 may be formed in the side wall 110 in different manners. In one implementation, the sidewall 110 is the primary wall and the body portion 102 includes at least one secondary wall 126. The secondary wall 126 includes first and second vertical edges 128*a*, 128*b* and top and bottom horizontal edges 130*a*, 130*b*. The vertical edges 128*a*, 128*b* join with the inner surface 110*a* of the sidewall 110, such that the secondary wall 126 extends inwardly from the inner surface 110*a*, partially surrounds a portion of the primary sidewall 110, and defines a channel 132 between the primary and secondary walls. The bottom horizontal edge 130*b* of the secondary wall 126 joins with the bottom wall 108 at its peripheral edge 106. The channel 132 extends essentially the entire height of the body portion 102 with an upper opening of the channel 132 disposed proximate the top rim 112 of the body portion and a lower opening of the channel 132 disposed proximate the peripheral edge of the bottom wall 108.

The channel configuration allows the primary sidewall 110 to be flexed inwardly (i.e., pressed towards the secondary wall 126) upon application of a force to the outer surface 110*b*, thereby providing access to an edge 138 of the cover 104 to assist in removing the cover 104. See FIGS. 9 and 22A-22D for additional details regarding the removal of the cover 104. The amount of force required may vary to suit a particular application and may depend on, for example, the wall thicknesses, materials of construction, and/or the size of the channel 132 or channel openings. The container 100 may be configured to meet any minimum force required to make the container child-resistant, such as, for example, materials of construction and number of and location of certain structural features. Additionally, although only one flex feature 124 is shown in FIG. 20, essentially any number of flex features 124 may be included and disposed about the perimeter of the body portion 102, for example, they may be spaced equidistant about the body portion.

Furthermore, the size, shape, and visibility of the channel openings may vary to suit a particular application. For example, the height of the sidewall 110 at the flex feature 124 may be reduced so that the channel opening is larger and more readily visible to a user to, for example, provide a visible clue to the location of the flex feature 124 when the cover 104 is engaged with the body portion 102. In addition, a tactile feature may be included on the flex feature, such as, for example, a protuberance or other minimally raised structure that a user can feel when gripping the container. Additionally, or alternatively, the side wall of the body portion may include a structure that provides an audible cue when engaged, for example, a force is applied.

In another implementation of a flex feature 124, the sidewall 110 is a continuous wall having the aforementioned inner and outer surfaces 110*a*, 110*b* and including one or more gaps therebetween and extending along a length of the sidewall 110, thereby forming the channel(s) 132. Similar to the flex feature 124 described above the channel 132 extends essentially the entire height of the body portion 102 with an upper gap or opening of the channel 132 disposed proximate the upper rim 112 of the body portion and a lower gap or opening of the channel 132 disposed proximate the peripheral edge of the bottom wall 108.

Referring to FIGS. 19, 19A, and 22A-22D, the engagement between the body portion 102 and cover 104 are clearly depicted. As shown and previously described, the body portion 102, 702 includes a bottom wall 108, 708 and a sidewall 110, 710 extending upwardly therefrom and defining a flex feature 124, 724, and the cover 104 includes a top wall 116 and a sidewall 118 extending downwardly therefrom. An upper region of the body portion sidewall 110, 710 is configured to engage with at least a portion of the cover sidewall 118. As shown, an inner surface 118*a* of the cover sidewall 118 engages with the outer surface 110*b*, 710*b* of the body portion sidewall 110, 710 via an interference or snap fit. In some implementations, the sidewalls 110, 710, 118 include mating structure (e.g., a retention mechanism 134 similar to those described herein) to enable the snap fit. The bottom edge 138 of the cover sidewall 118 abuts against a top edge of or recess 136 in the body portion sidewall 110, 710 and, in some embodiments, the outer surface 118*b* of the cover 104 sits flush with or slightly inward of the outer surface 110*b*, 710*b* of the sidewall 110, 710 to make it difficult to engage with and remove the cover 104 from the body portion 102, 702. See FIGS. 22A and 22B.

To remove the cover 104, a user applies a force (F) to the outer surface 110*b*, 710*b* of the sidewall (i.e., depresses the sidewall 110) at the flex feature 124, 724 thereby exposing the bottom edge 138 of the cover sidewall 118, as shown in FIGS. 22C and 22D. This allows the user to apply a force to the bottom edge 138 (e.g., via the use of a tool or finger nail) sufficient to overcome the holding force of the interference or snap fit, thereby separating the cover 104 from the body portion 102, 702. For example, a finger nail can be used to apply the force (F) and, in some cases, inserted into the gap of the flex feature 124, 724 and/or into a space behind the sidewall 118 of the cover 104 to remove the cover/lid while the force is applied. The user can release (i.e., remove the applied force) the flex feature 124, 724 and the body portion 102, 702 returns to its neutral/normal or unflexed configuration. The cover 104 can be reattached to the body portion 102, 702 by pushing the cover back onto the body portion with sufficient force to reengage the interference or snap fit, which should be evident once the cover and body portion are back in an abutting configuration as described above.

FIG. 19A depicts the alternative embodiment of the body portion 702 in greater detail. The body portion 702 is substantially similar to the body portion 102 described above insofar as the body portion 702 is configured to hold a consumer product and a lid or cover as disclosed herein may be configured to be securely, but removably, coupled to the body portion 702. As shown, the sidewall 710 has an inner surface 710*a* (see 110*a*) and an outer surface 710*b*. The flex feature 724 may be formed in the side wall 710 in different manners. In one implementation, the sidewall 710 is the primary wall and the body portion 702 includes at least one secondary wall 726. The secondary wall 726 includes first and second vertical edges 728*a*, 728*b* (not shown) and top and bottom horizontal edges 730*a*, 730*b*. The vertical edges 728*a*, 728*b* join with the inner surface 710*a* of the sidewall 710, such that the secondary wall 726 extends inwardly from the inner surface 710*a*, partially surrounds a portion of the primary sidewall 710, and defines a channel 732 between the primary and secondary walls. The top horizontal edge 730*a* is coupled to the primary wall 710 via a bridge or extension 752 that extends therebetween and encloses an upper end of the channel 732. The bottom horizontal edge 730*b* of the secondary wall 726 joins with the bottom wall 708 at its peripheral edge 706 and defines an opening 732*a* to the channel. The channel 732 extends essentially the entire height of the body portion 702 with the upper end of the channel 732 terminating below the top rim 712 of the body portion and the lower opening 732*a* disposed proximate the peripheral edge of the bottom wall 708. Additional implementations are described with respect to 124.

The channel configuration allows the primary sidewall 710 to be flexed inwardly (i.e., pressed towards the secondary wall 726 upon application of a force (F) to the outer surface 710*b*, thereby providing access to an edge of a cover to assist in removing the cover. See FIGS. 22A-22D for additional details regarding the removal of a cover. The amount of force required may vary to suit a particular application and may depend on, for example, the wall thicknesses, materials of construction, and/or the size of the channel 732 or channel opening 732*a*. In some embodiments, the amount of force required may increase relative to the distance the flex feature is flexed inwardly. The container may be configured to meet any minimum force required to make the container child proof, such as, for example, materials of construction and number of and location of certain structural features. Additionally, although only one flex feature 724 is shown, essentially any number of flex features 724 may be included and disposed about the perimeter of the body portion 702, for example, they may be spaced equidistant about the body portion (e.g., three flex features 724 disposed about 120° apart about the perimeter of a body portion 702). Furthermore, the size, shape, and visibility of the channel opening may vary to suit a particular application. For example, the height of the sidewall 710 at the flex feature 724 may be reduced so that the channel opening 732*a* is larger and more readily visible to a user to, for example, provide a visible clue to the location of the flex feature 724 when a cover is engaged with the body portion 702.

Generally, the bridge 752 is provided to assist with sealing of a cover with this configuration of a body portion 702 and/or for aesthetic purposes and does not significantly contribute to the child-resistant characteristics of the container. As shown in FIG. 19A, the bridge 752 has a lesser thickness than the walls 710, 726, although the thickness of the bridge may vary to suit a particular application. In one implementation, the bridge may have a yield strength less than the various walls of the body portion 702, but still possess sufficient strength to remain intact during shipping and the marketing/selling process to preserve freshness of the product before an initial opening by a consumer. Depending on the amount of force required to remove a cover attached to the body portion 702 and/or the number flex cycles the wall is subjected to, the bridge may eventually break; however, this will have no impact on any product remaining therein.

FIGS. 23-33 depict yet another example implementation of a container 800 in accordance with one or more embodiments of the disclosure and similar to container 900 described above, with FIGS. 27-33 depicting a body portion 802 defining two separate internal spaces in greater detail. As shown, the container 800 includes the same or substantially similar covers 804 to the cover 904 described above. Accordingly, the covers 804 will not be discussed in any detail with respect to this implementation of the container 800. Generally, the container 800 is similar to the other containers described above, but includes the body portion 802 defining a first internal space 840*a* accessible via a first opening 814*a* and a second internal space 840*b* accessible via a second opening 814*b*. The first internal space 840*a* may be configured to hold a fresh product, such as chewing tobacco, snus, or oral products, and the second internal space 840*b* is configured to hold another product, such as a used or waste product. The container 800 includes first and second covers 804*a*, 804*b* configured to be securely, but removably, coupled to the body portion 802 so as to enclose their respective internal spaces 840. As shown in FIG. 25, the covers 804 and body portion 802 generally abut one another when engaged and their respective outer surfaces are substantially flush with one another, which makes it difficult to separate the parts. In some implementations, the covers 804 are secured to the body portion 802 via a snap or interference fit, which provides additional resistance to separating the parts. The engagement of the covers 804 and body portion 802 are described in greater detail below.

As shown in the figures, the body portion 802 of the container 800 includes a bottom wall 808 separating the first and second internal spaces 840, a sidewall 810 disposed about a peripheral edge 806 of the bottom wall 808 and extending upwardly (defining the first internal space 840*a*) and downwardly (defining the second internal space 840*b*) therefrom, and a secondary wall 826 comprising an upper edge 821*a* and a lower edge 821*b*. The secondary wall 826 is coupled to an outer surface of the primary wall 810 and spaced outwardly therefrom to define a channel between the primary and secondary walls 810, 826 such that one or more portions 824 of the secondary wall flexes relative to the primary wall 810 upon application of a force thereto.

As further shown in the figures, the container 800 includes the first cover 804*a* configured to securely and removably engage the first opening 814*a* of the body portion 802, where the first cover is removable by flexing one of the one or more portions of the secondary wall 826 inwardly to expose an edge 838*a* of the first cover 804*a*. Similarly, the second cover 804*b* is configured to securely and removably engage the second opening 814*b* of the body portion 802 so that the second cover 804*b* is removable by flexing one of the one or more portions 824 of the secondary wall 826 inwardly to expose an edge 838*b* of the second cover 804*b*.

With reference to FIGS. 27-29, in particular, the sidewall 810 of the body portion 802 comprises a top edge 812*a* and a bottom edge 812*b* with the bottom wall 808 disposed proximate the bottom edge 812*b* of the sidewall 810 so as to define two differently sized internal spaces. Specifically, the first internal space 840*a* comprises a first volume and the second internal space 840*b* comprises a second volume that is less than the first volume. The volume of the second internal space 840*b* is generally shown as much smaller than the first internal space 840*a*; however, the size of the second internal space relative to the first internal space may vary to suit a particular application. For example, the sizes (i.e., volume) of first and second internal spaces may be substantially equal or the volume of the second internal space may be about 90%, about 80%, about 70%, about 60%, about 50%, about 40%, about 30%, about 20%, about 10% of the volume of the first internal space 840*a*.

Referring to FIGS. 29-33, the structure and operation of the body portion 802 is described in greater detail. The bottom wall 808 is shown having a circular shape; however, the shape of the bottom wall 808 may vary to suit a particular application (e.g., type of product held by the container, aesthetic purposes, etc.). Similarly, the sidewall 810 depicted in the figures is a single, contiguous circular wall; however, the wall 810 may comprise multiple wall portions or linear segments as would be necessary, for example, if the container 800 had a non-cylindrical shape (e.g., rectangular, hexagonal, octagonal, etc.). The sidewall 810 extends around the entire perimeter of the body portion 802 and has an inner surface and an outer surface. In certain implementations, the outer surface of the primary wall 810 includes a plurality of raised structures 860 disposed thereon to form the alignment mechanism as described above, i.e., the structures 960 are disposed equidistant about the outer surface and spaced apart to define a plurality of grooves 949 about the outer surface of the primary wall 910 that are configured to mate with rib-like structures 948 within the cover 904. As shown, the primary wall 810 of the body portion 802 defines a generally cylindrical shape and the secondary wall 826 defines a generally hexagonal prismatic shape (see FIG. 33); however, the shapes of the primary and secondary walls may vary to suit a particular application.

In the depicted implementation, the secondary wall 826 surrounds the primary wall 810 and has an upper edge 821*a* and a lower edge 821*b* that are recessed relative to the top edge 812*a* and the bottom edge 812*b* of the primary wall 810. The secondary wall 826 is coupled to the outer surface of the primary wall 810 via one or more lateral extensions 862 and spaced outwardly therefrom so as to define a channel 832 between the primary and secondary walls such that one or more portions (or flex features) 824 of the secondary wall flex relative to the primary wall upon application of a force thereto. Generally, the channel 832 allows the secondary wall 826 to be flexed inwardly (i.e., pressed towards the primary wall 810) upon application of a force to certain portions thereof (flex features 824 described below), thereby providing access to an edge 838 of either cover 804 to assist in removing the cover 804. See FIGS. 28A and 28B for additional details regarding the removal of the covers 804. The amount of force required may vary to suit a particular application and may depend on, for example, the wall thicknesses, materials of construction, and/or the size of the channel 832 or channel openings. The container 800 may be configured to meet any minimum force required to make the container child-resistant, such as, for example, materials of construction and number of and location of certain structural features.

As disclosed above, the secondary wall 826 includes at least one flex feature 824 that assists in separating the covers 804 from the body portion 802, but provides sufficient resistance to prevent the covers 804 and body portion 802 from being separated by a child. The flex feature 824 may be formed in the secondary wall 826 in different manners. In the depicted implementation, the container 800 includes two (2) flex features 824 disposed proximate one another and on one side of the container 800 (see FIGS. 29-33), where both flex features 824 are configured for removal of the first cover 804*a* or the second cover 804*b*. Although two flex features are described, it is possible for the container 800 to include any number of additional flex features 824 to suit a particular application (e.g., the size and/or shape of the container) and the flex features may be spaced equidistant about the body portion, specifically the secondary wall 826.

FIGS. 28A, 28B, and 33 depict the lateral extensions 862 and flex features 824 in greater detail. As shown, the lateral extension 862 generally extends horizontally outward from the primary wall 810 and couples to the secondary wall 826 proximate a vertical midline of an inner surface thereof (left side of FIG. 28A). In the depicted implementation, the lateral extension 862 and secondary wall 826 are generally disposed midway up the primary wall 810; however, the exact placement of the secondary wall 826 may vary to suit a particular application (e.g., depths of the internal spaces or covers). The lateral extension 862 is generally shown as extending about a substantial portion of the perimeter of the body portion 802; however, in some implementations, the lateral extension comprises a plurality of non-contiguous segments that define one or more gaps where the secondary wall 826 is not directly coupled to the primary wall 810. As shown in FIG. 33, there is a portion 872 of the container 800 where the secondary wall 826 is not attached to the primary wall 810 of the body portion 802 (i.e., that portion of the secondary wall 826 "floats" relative to the primary wall 810). This arrangement provides for two floating corners of the secondary wall that form first and second flex features 824*a*, 824*b*. The flex features 824*a* of the secondary wall 826 include a tactile feature 874, such as, for example, a protuberance or other minimally raised structure that a user can feel when gripping the container 800. The feature 874 provides for a press point for actuating the flex feature 824 (application of a force thereto) which will deflect the flex feature section of the secondary wall 826 towards the primary wall 810, thereby exposing the edges 838 of the covers 804.

Referring to FIG. 28A, the engagement between the body portion 802 and covers 804 is more clearly depicted. As shown and previously described, the body portion 802 includes a bottom wall 808 and a primary wall 810 spanning the bottom wall 808 and defining two internal spaces 840. The body portion 802 includes a secondary wall 826 that defines one or more flex features 824. The first (upper) and second (lower) covers 804 include top walls 816 and primary, inner, and outer sidewalls 818, 842, 868 extending downwardly therefrom and configured to engage their respective openings 814 of the internal spaces. In the depicted implementation, the primary wall 810 and primary sidewall 818 include mating structure 834 (e.g., retention mechanisms 1034*a*, 1034*b* as described above) to enable a snap fit between the covers 804 and the body portion 802. The bottom edges 838 of the covers 804 approximately abut against the top and bottom edges 821 of or recess in the body portion primary wall 810 and, in some embodiments, the outer surfaces of the covers 804 sit flush with or slightly inward of the outer surface of the secondary wall 826 to make it difficult to engage with and remove the covers 804 from the body portion 802.

FIG. 28A illustrates operation of one of the flex features 824 for removing the bottom cover 804*b* and the top cover 804*a*, with the enlarged view depicting the container rotated approximately 90 degrees to depict engagement between the walls 810, 818 at a location without a flex feature 824. Specifically, the enlarged view (FIG. 28B) depicts the primary sidewalls 818 of the covers 804 disposed within the channel 832 defined by the primary wall 810 and the secondary wall 826 of the body portion 802 and retained therein via the retention mechanisms 834. In addition, the primary sidewall 818 and the inner sidewall 842 may define a receptacle 844 with a seal arrangement 884 disposed therein (see FIG. 28A) as described above with respect to container 1000.

To remove one of the covers 804, a user applies a force (F1) to an outer surface of the secondary wall 826 (i.e., presses the secondary wall 826) at one or more flex features 824, thereby exposing the edges 838 of the cover primary sidewalls 818, as shown in FIG. 28A. This allows the user to apply a force (F2) to the edge 838 (e.g., via the use of a tool or finger nail) sufficient to overcome the holding force of the interference or snap fit, thereby separating the cover 804 from the body portion 802. In some implementations, the user may press both flex features 824 simultaneously to be able to apply the removing force F2 to two locations on the cover edge 838. Once the user releases (i.e., removes the applied force) the flex feature(s) 824 and the body portion 802 returns to its neutral/normal or unflexed configuration. The cover 804 can be reattached to the body portion 802 by pushing the cover back onto the body portion with sufficient force to reengage the interference or snap fit, which should be evident once the cover and body portion are back in an abutting configuration as described above.

The material of construction of the various body portions disclosed herein may vary to suit a particular application. Exemplary materials include metal, synthetic plastic materials, and cellulosic materials (e.g., cardboard). Polymeric materials that can be extruded and/or molded into desired shapes are typically utilized, such as polypropylene, polyethylene, polystyrene, polyamide, and the like. Additionally, in some implementations, the containers are made from a flexible polymer, such as those belonging to the polyolefin class (e.g., polyethylene, polypropylene, polyisobutylene, polymethylpentene, etc.). In some implementations, the body portion may comprise a translucent or transparent material to allow a user to view the contents. The body portion may be manufactured via injection molding, blow molding, thermoforming, extrusion, bonding, machining, or combinations thereof, as known to a person of skill in the art.

In some implementations, the covers disclosed herein may be made of the same materials and by the same processes as the body portions. In certain implementations, the cover may be formed from a metallic material, such as, for example, aluminum or tinplate. In implementations incorporating an outer lid (e.g., 116*a*), it may be manufactured separately from and of a different material than the remainder of the cover to, for example, provide labeling or other indicia or to serve an aesthetic purpose.

In various implementations of the containers described herein, the containers may include additional features, such as a barrier film or membrane configured to cover the opening in the body portion, thereby enclosing the internal space. By way of example, the barrier film may comprise a foil or a film (e.g., a polymer film) and/or may contain a material selected and configured to be substantially fluid-impervious so as to prevent the flow of fluids from the internal space to an external environment or allow the transmission of gasses therethrough (e.g., diffusion of oxygen into the internal space) to maintain the freshness of the tobacco-containing material by supporting the health of aerobic microbes within the tobacco-containing material. Another feature that may be included is a vent mechanism disposed in the body portion, the cover, or both to help regulate an internal pressure or other environmental condition within the container.

Many modifications and other implementations of the disclosure will come to mind to one skilled in the art to which this disclosure pertains having the benefit of the teachings presented in the foregoing descriptions and the associated figures. Therefore, it is to be understood that the disclosure is not to be limited to the specific implementations disclosed herein and that modifications and other implementations are intended to be included within the scope of the appended claims. Although specific terms are employed herein, they are used in a generic and descriptive sense only and not for purposes of limitation.

What is claimed is:

1. A container comprising:

a body portion defining an internal space accessible via an opening, the body portion comprising a bottom wall and a sidewall extending upwardly from a peripheral edge of the bottom wall, wherein the sidewall comprises:

a primary wall extending along a perimeter of the bottom wall and having an inner surface, an outer surface, and an upper rim defining the opening, wherein a first alignment mechanism is disposed on the outer surface of the primary wall; and a secondary wall spaced outwardly from and at least partially surrounding the outer surface of the primary wall thereby defining an open channel between the primary and secondary walls, the open channel extending along a perimeter of the body portion, wherein the secondary wall comprises an upper edge and a lower edge and the secondary wall is coupled to the primary wall along at least a portion of the lower edge; and a cover configured to securely and removably engage the body portion, the cover comprising:

a top wall; and a primary sidewall extending downwardly from a peripheral edge of the top wall and having an inner surface, an outer surface, and a second alignment mechanism disposed on the inner surface of the primary sidewall, the second alignment mechanism configured to engage with the first alignment mechanism.

2. The container of claim 1, wherein the first alignment mechanism comprises a plurality of raised structures oriented about the outer surface of the primary wall of the body portion so as to define a plurality of grooves therebetween.

3. The container of claim 2, wherein the second alignment mechanism comprises a plurality of ribs disposed along the inner surface of the primary sidewall of the cover and oriented so as to mate with the plurality of grooves on the body portion in a particular orientation.

4. The container of claim 3, wherein each of the raised structures comprises an upper edge angled downwardly towards the defined grooves and configured to guide the ribs into their respective grooves.

5. The container of claim 1, wherein the first and second alignment mechanisms prevent rotational movement between the cover and body portion when engaged.

6. The container of claim 1, wherein the primary sidewall of the cover circumscribes the primary wall of the body portion when the cover engages the body portion.

7. The container of claim 1, wherein the cover further comprises an inner sidewall extending downwardly from the top wall and spaced inwardly from the primary sidewall, wherein the primary and inner sidewalls of the cover define a receptacle configured to engage at least a portion of the primary wall of the body portion.

8. The container of claim 7 further comprising a seal arrangement disposed within the receptacle and configured to sealingly engage the upper rim of the primary wall.

9. The container of claim 1, wherein the cover further comprises an outer sidewall extending outwardly from the peripheral edge of the top wall and configured so that an outer surface thereof is substantially flush with an outer surface of the secondary wall of the body portion when engaged.

10. The container of claim 1, wherein an inner surface of the secondary wall of the body portion comprises a retention mechanism configured to engage a mating structure on the cover to secure the cover to the body portion.

11. The container of claim 1, wherein one or more portions of the secondary wall flexes relative to the primary wall upon application of a force thereto and the cover is removable by flexing one of the one or more portions of the secondary wall inwardly to expose an edge of the cover.

12. The container of claim 1, wherein the cover engages the body portion via an interference fit or a snap fit.

13. The container of claim 1 further comprising a tamper evident feature.

14. The container of claim 13, wherein the tamper evident feature comprises:

a substrate disposed on at least one of the bottom wall or the top wall; and at least two tabs extending outwardly from the substrate and attached to the body portion and the cover, each tab spanning an interface between the body portion and the cover.

15. The container of claim 14, wherein the substrate comprises a label or other indicia.

16. The container of claim 14, wherein the at least two tabs are perforated.

17. A container comprising:

a body portion defining an internal space accessible via an opening, the body portion comprising a bottom wall and a sidewall extending upwardly from a peripheral edge of the bottom wall, wherein the sidewall comprises:

a primary wall extending along a perimeter of the bottom wall and having an inner surface, an outer surface, and an upper rim defining the opening; and a secondary wall spaced outwardly from and at least partially surrounding the outer surface of the primary wall thereby defining an open channel between the primary and secondary walls, the open channel extending along a perimeter of the body portion, wherein the secondary wall comprises an upper edge and a lower edge and the secondary wall is coupled to the primary wall along at least a portion of the lower edge; and a cover configured to securely and removably engage the body portion, the cover comprising:

a top wall;

a primary sidewall extending downwardly from a peripheral edge of the top wall;

an inner sidewall extending downwardly from the top wall and spaced inwardly from the primary sidewall, wherein the primary and inner sidewalls define a receptacle configured to engage at least a portion of the primary wall of the body portion; and a seal arrangement disposed within the receptacle and configured to sealingly engage the upper rim of the primary wall when the cover engages the body portion.

18. The container of claim 17, wherein the primary sidewall of the cover circumscribes the primary wall of the body portion when the cover engages the body portion.

19. The container of claim 17 further comprising:

a first alignment mechanism is disposed on the outer surface of the primary wall; and a second alignment mechanism disposed on the inner surface of the primary sidewall, the second alignment mechanism configured to engage with the first alignment mechanism.

20. The container of claim 19, wherein the first alignment mechanism comprises a plurality of raised structures oriented about the outer surface of the primary wall of the body portion so as to define a plurality of grooves therebetween and the second alignment mechanism comprises a plurality of ribs disposed along the inner surface of the primary sidewall of the cover and oriented so as to mate with the plurality of grooves on the body portion in a particular orientation.

21. The container of claim 20, wherein each of the raised structures comprises an upper edge angled downwardly towards the defined grooves and configured to guide the ribs into their respective grooves.

22. The container of claim 19, wherein the first and second alignment mechanisms prevent rotational movement between the cover and body portion when engaged.

23. The container of claim 17, wherein an inner surface of the secondary wall comprises a retention mechanism configured to engage a mating structure on the cover to secure the cover to the body portion.

24. The container of claim 17, wherein one or more portions of the secondary wall flexes relative to the primary wall upon application of a force thereto and the cover is removable by flexing one of the one or more portions of the secondary wall inwardly to expose an edge of the cover.

25. The container of claim 17, wherein the cover engages the body portion via an interference fit or a snap fit.

26. The container of claim 17 further comprising a tamper evident feature.

27. The container of claim 26, wherein the tamper evident feature comprises:

a substrate disposed on at least one of the bottom wall or the top wall; and at least two tabs extending outwardly from the substrate and attached to the body portion and the cover, each tab spanning an interface between the body portion and the cover.

28. The container of claim 27, wherein the substrate comprises a label or other indicia.

29. The container of claim 27, wherein the at least two tabs are perforated.

* * * * *